US010641031B2

(12) United States Patent
Koenitz

(10) Patent No.: US 10,641,031 B2
(45) Date of Patent: May 5, 2020

(54) MOUNTABLE COVER, BLIND AND/OR SHADE FOR GLASS/GLAZING PANELS IN WINDOWS, SKYLIGHTS, WALLS OR DOORS

(71) Applicant: Chris Koenitz, Flanders, NJ (US)

(72) Inventor: Chris Koenitz, Flanders, NJ (US)

( * ) Notice: Subject to any disclaimer, the term of this patent is extended or adjusted under 35 U.S.C. 154(b) by 116 days.

(21) Appl. No.: 16/045,084

(22) Filed: Jul. 25, 2018

(65) Prior Publication Data

US 2019/0048649 A1 Feb. 14, 2019

Related U.S. Application Data

(63) Continuation-in-part of application No. 14/756,375, filed on Sep. 3, 2015, now abandoned, which is a (Continued)

(51) Int. Cl.
*E06B 3/30* (2006.01)
*E06B 1/34* (2006.01)
(Continued)

(52) U.S. Cl.
CPC ..... *E06B 1/34* (2013.01); *E06B 1/32* (2013.01); *E06B 1/36* (2013.01); *E06B 1/60* (2013.01);
(Continued)

(58) Field of Classification Search
CPC ..... E06B 1/32; E06B 1/34; E06B 1/36; E06B 3/30; E06B 3/46; E06B 3/7001;
(Continued)

(56) References Cited

U.S. PATENT DOCUMENTS 2,407,632 A 9/1946 Dreyfus ..... 139/426 R
4,126,174 A 11/1978 Moriarty et al. ..... 160/266
(Continued)

FOREIGN PATENT DOCUMENTS

DE 20316919 3/2004 ..... E04D 13/03
WO WO 2009/114437 9/2009 ..... E04F 10/06
WO WO 2012/131472 10/2012 ..... E06B 3/67

OTHER PUBLICATIONS

Internet Publication "Skylight Blinds" found at http://www.homedepot.com/b/Doors-Windows-Windows-Skylights-Blinds/N-5yclvZe5f0.

*Primary Examiner* — Katherine W Mitchell
*Assistant Examiner* — Abe Massad
(74) *Attorney, Agent, or Firm* — Ernest D. Buff & Associates, LLC; Ernest D. Buff; Margaret A. LaCroix

(57) ABSTRACT

A mountable cover provides a shade or blind for glass/glazing panels for window structures, doors, walls, elevated windows, and skylights. The mountable cover comprises a mounting frame with a panel composed of a material adapted to block at least a portion of light external to and traversing the window glass, the panel sitting parallel to and covering a portion of the window glass to block the light that has traversed the window glass. At least one fastening mechanism comprises one or more magnets and metal plates having a top wall, bottom wall and side walls. Each of the magnets is located on the mounting frame and is adapted to engage with one of the metal plates, which are mounted on the window. When brought into engagement with the metal plates the magnets and plates operate to mount the mountable cover over the window.

11 Claims, 51 Drawing Sheets

Related U.S. Application Data continuation-in-part of application No. 14/121,448, filed on Sep. 8, 2014, now Pat. No. 9,970,232.

(51) Int. Cl.

| | |
|---|---|
| ***E06B 1/36*** | (2006.01) |
| ***E06B 3/46*** | (2006.01) |
| ***E06B 1/60*** | (2006.01) |
| ***E06B 1/32*** | (2006.01) |
| ***E06B 9/24*** | (2006.01) |
| *E06B 3/70* | (2006.01) |

(52) U.S. Cl.

CPC ..... *E06B 3/46* (2013.01); *E06B 9/24* (2013.01); *E06B 3/30* (2013.01); *E06B 3/7001* (2013.01)

(58) Field of Classification Search

CPC ..... E06B 9/24; E06B 2009/2482; E06B 2009/2488; E06B 2009/2494

See application file for complete search history.

(56) References Cited

U.S. PATENT DOCUMENTS

| | | | | | |
|---|---|---|---|---|---|
| 4,261,410 | A | | 4/1981 | Standiford | 160/269 |
| 4,272,934 | A | | 6/1981 | Cowden | 52/202 |
| 4,311,183 | A | | 1/1982 | Herbst et al. | 160/37 |
| 4,409,758 | A | * | 10/1983 | Dickerson | E06B 3/28 160/231.2 |
| 4,561,223 | A | * | 12/1985 | Gold | E06B 3/28 49/478.1 |
| 4,587,997 | A | | 3/1986 | Brooks | 139/420 R |
| 4,610,292 | A | | 9/1986 | Hausmann et al. | 160/120 |
| 4,883,109 | A | | 11/1989 | Sonderby | 160/132 |
| 5,088,543 | A | | 2/1992 | Bilbrey | 160/310 |
| 5,204,777 | A | | 4/1993 | Curshod | 359/596 |
| 5,226,466 | A | * | 7/1993 | Coddens | E06B 9/264 160/107 |
| 5,465,774 | A | | 11/1995 | Smith | 160/90 |
| 5,568,832 | A | | 10/1996 | Eddy | 160/374 |
| 5,850,861 | A | | 12/1998 | Silverberg | 160/107 |
| 6,223,804 | B1 | | 5/2001 | Toti | 160/199 |
| 6,601,637 | B2 | | 8/2003 | Toti | 160/199 |
| 6,672,366 | B1 | | 1/2004 | Wade | 160/371 |
| 6,705,379 | B1 | * | 3/2004 | Nien | E06B 9/303 160/172 R |
| 8,037,923 | B2 | | 10/2011 | Alkhovry | 160/90 |
| 8,074,698 | B2 | | 12/2011 | Allsopp | 160/107 |
| 8,365,799 | B2 | * | 2/2013 | Harris | H01F 7/0252 160/105 |
| 8,496,039 | B1 | * | 7/2013 | Barresi | E06B 7/09 160/107 |
| 8,813,264 | B2 | * | 8/2014 | Boos | A41F 1/002 2/132 |
| 2004/0154753 | A1 | | 8/2004 | Tagtow et al. | 160/23.1 |
| 2007/0261804 | A1 | | 11/2007 | Simpson | 160/369 |
| 2010/0288455 | A1 | | 11/2010 | Liscano | 160/372 |
| 2011/0056135 | A1 | | 3/2011 | Cochran | 49/62 |
| 2014/0060760 | A1 | | 3/2014 | Harris | 160/370.21 |
| 2014/0318048 | A1 | | 10/2014 | Dison | 52/203 |

* cited by examiner

X depth = Y depth

MOUNTABLE COVER, BLIND AND/OR SHADE FOR GLASS/GLAZING PANELS IN WINDOWS, SKYLIGHTS, WALLS OR DOORS

This application claims the benefit of U.S. patent application Ser. No. 14/756,375 filed Sep. 3, 2015, entitled "Mountable Cover, Blind and/or Shade for Glass/Glazing Panels in Windows, Skylights, Walls or Doors", which, in turn, claims the benefit of U.S. patent application Ser. No. 14/121,448 filed Sep. 8, 2014, now U.S. Pat. No. 9,970,232, the disclosures of which are hereby incorporated in their entirety by reference thereto.

1. FIELD OF THE INVENTION

The present disclosure generally relates to covers, blinds and/or shades for a window, door, or skylight; and more particularly, to framed covers, blinds and/or shades that are removably mounted on windows, doors, elevated and hard to reach windows and skylights.

2. DESCRIPTION OF THE PRIOR ART

Direct sunlight can cause fading, bleaching and darkening in furniture and flooring. It can additionally decrease the efficiency of cooling/heating systems, due substantially in part to the direct exposure to sunlight. While basic window treatments, such as blinds and curtains, are provided for typical home window structures, skylight and elevated windows are difficult to cover with window treatments.

Skylights and elevated windows are frequently installed in blinding constructs both for their aesthetic appeal and functionality in providing natural lighting to a room or area. However, these window constructs are particularly prone to energy inefficiency owing to solar heat buildup within the room. Additionally, skylights and elevated windows increase exposure to UV rays and light within the room causing fading, bleaching and darkening furniture and flooring over time. Often, these windows require specialized coverings formed for the particular skylight or elevated window structure. Even when more universal type coverings are provided, these coverings have disadvantages. Such coverings are generally either integrated within the window structure, causing the window construct to become much more expensive, or require separate installation and maintenance. These separately installed coverings are not only expensive, but they are difficult to install. If the installation is for an external/outside covering, then there exists an added concern that improper installation will result in water leakage, causing structural damage and property damage over time.

Examples of various window treatment products are set forth below in summation:

U.S. Pat. No. 2,407,632 to Dreyfus discloses a screening material, specifically relating to window screens woven of threads of artificial filamentary materials possessing high tenacity and improved dimensional stability.

U.S. Pat. No. 4,126,174 to Moriarty et al. discloses a flexible sheet roll-up window structure used in conjunction with a conventional window sash frame as an auxiliary or storm window. The invention includes an elongated sheet of thin, flexible plastic material (vinyl) which is designed to be supported and stored or dispensed by means of elongated spring rollers. An auxiliary guide roller is provided to direct the film into a straight-line plane.

U.S. Pat. No. 4,261,410 to Standiford discloses a self-adjusting, self-storing rollaway inside storm window for use on conventional windows, which can be quickly put up and taken down as desired. The rollaway inside storm window includes a transparent flexible panel mounted on and constantly tensioned at the top end by a spring-retracting roller in the manner of a window shade and deployable over a self-adjusting spring biased extension rod securable between the sides of a window frame at the top, and at the bottom loop-affixed around a similar self-adjusting spring biased extension rod also securable between the sides of the window frame; a special shock cord deployed along each side of the panel between the upper and lower self-adjusting spring loaded rods biases the vertical edges of the panel in a direction for sealing against the window frame structure; intermediate disconnects are provided in the shock cord, and special ends on the self-adjusting spring loaded rods adapt them for securance to window frame structures of different types.

U.S. Pat. No. 4,272,934 to Cowden discloses a panel structure for use in blocking glass panes against the passage of heat and cold. In one form the structure comprises first and second rigid foam panel sections joined together by a flexible sheet. The ends of the panels are exposed underneath the sheet so that they may be trimmed to fit the glass pane. Releasable means is also provided for mounting the panel sections in blocking relationship to the glass pane. In another embodiment one of the rigid foam panel sections is provided with a tapered edge so that the section will fit behind the lock on a double hung window. In a further embodiment of the invention a plurality of u-shaped channels are placed around the periphery of the rigid foam sections to form framework. Releasable means may then be secured to the framework to hold the panel structure in blocking relationship to the glass pane. A still further embodiment encompasses the use of a frame of rigid foam insulation which framework is placed around the glass pane and the releasable mounting means is secured thereto.

U.S. Pat. No. 4,311,183 to Herbst, et al. discloses a combination storm and screen door comprising an outer and inner frame, each having the entire configuration of a door, and being composed of totally integral molded plastic. Disposed between the frames along the lateral sides and bottom and top of the door are steel reinforcement beams. The upper portion of the door has an opening and the lower portion has a storage cavity, both defined by the outer and inner frames. A storm window and a screen are slidingly positioned within the door to be lowered within the storage cavity when not in use, and to be raised to the opening when in use. Both the window and screen may be removed for cleaning, repair, or replacement. The outer and inner frames are molded, preferably from a blown or porous insulated type plastic material. Weather stripping is provided and other insulation characteristics are included in the door.

U.S. Pat. No. 4,587,997 to Brooks discloses a woven screen fabric for blocking out undesirable light and glare but admitting air and desirable light. The fabric comprises 1000 denier high-tenacity polyester core fill yarn coated with a plasticized polyvinyl chloride plastic coating to a finished diameter of 0.0250±0.0010 inch. The plastic is extruded onto the core yarn and is pigmented and heat, light and UV stabilized and the fill mesh may be 16±1 ends per linear inch. An ECG 150 fiberglass core warp yarn is coated with a polyvinyl chloride plastisol coating to a finished diameter of 0.0115±0.0010 inch. The plastisol is drip-coated onto the core warp yarn and is pigmented, heat, light and UV stabilized to produce a strong, flexible, weather resistant and abrasion resistant coating. The warp mesh may be 63±2 ends per lineal inch. The fabric may be woven with individual warp yarn members arranged in an over and under relationship with the fill yarn members to provide a group of six individual strand members.

U.S. Pat. No. 4,610,292 to Hausmann et al. discloses an insulating window shade assembly including a first roller carrying an insulating shade and a second roller carrying a cover fabric. The shade and cover fabric are supported in essentially face to face relationship, and their bottoms are secured together by a Velcro-type fastener. The cover fabric conceals the insulating shade, it may be removed from the shade for cleaning or may be changed and it may be adjusted for smoothness and to compensate for any stretching which occurs in the materials.

U.S. Pat. No. 4,883,109 to Sonderby discloses a roller blind for skylights, having a roller blind compartment which can be fitted on the upper part of the blind, a winding shaft rotatably mounted in the compartment and a strap drum coaxially connected, for joint rotation, to the winding shaft for a pulling strap, has a plurality of strap deflecting elements arranged in the roller blind compartment, which elements deflect the pulling strap, extending from the strap drum, with axial strap twisting, firstly substantially parallel to the winding shaft, then substantially parallel to the central plane of the strap drum and then substantially perpendicular to the plane of exit of the roller blind toward the window, whence, in the installed position, it runs through a strap opening in the outer covering of the frame upper piece between the latter and a cover part engaging underneath its outer covering directly to a strap winder, preferable fitted above the window.

U.S. Pat. No. 5,088,543 to Bilbrey discloses a shade unit having a frame defining a skylight opening, to which is attached a motor assembly and a shade assembly, a control unit consisting of an open stop switch, a close stop switch controls the motor assembly with a relay switch charging the motors polarity. A wall switch controls the relay switch and a photoelectric switch which can also control the relay switch.

U.S. Pat. No. 5,204,777 to Curshod discloses an energy-efficient barrier utilizing thin slats, on one side of which are formed a number of reflective surfaces. The reflective surfaces are oriented at an angle, with respect to the face of the slat, to maximize reflection of the rays of the sun. The parallel reflective surfaces are formed as a series of ridges along the length of a slat and as the treads of a series of stair steps formed along the length of a slat. In a skylight assembly, one or more spacer members are provided having complementary slots formed therein for engagement with corresponding slots formed in the slats to properly align the slats with respect to the sun. The slats can be fixed as in a skylight, or variable such as in a Venetian blind.

U.S. Pat. No. 5,465,774 to Smith discloses a decorative window covering that provides privacy on sliding glass doors or windows without altering the walls surrounding the door or window. These privacy screens are functional as well as decorative, are removably attached to the window or door, and can remain within a sliding window or door frame when opening or closing the window or door.

U.S. Pat. No. 5,568,832 to Eddy discloses a skylight shade formed of a frame and engageable with the sides of a skylight opening and a filter sheet supported by the frame. The frame is formed from a plurality of adjustable rods which each have an outer member and an inner member which is adjustably received within the outer member and engages a spring therein. The outer member has an aperture extending perpendicularly therethrough adjacent one end and receives an end of an inner member of another rod therein. The filter sheet has attachment sleeves which are received around the rods for attaching the filter sheet to the frame. The rods contract via springs to allow each rod to be received within the skylight opening and are forcibly biased via springs the rod into secure engagement with the side of the skylight opening.

U.S. Pat. No. 5,850,861 to Silverberg discloses an electrostatically controlled blind system for use in limiting the passage of light through windows, doors, and skylights in building structures. The blind system comprises a plurality of elongated, electroconductive louvers which are pivotally supported within an electroconductive peripheral frame. The blind system is inserted between sheets of insulated glass having an electroconductive coating and is thereby insulated from the ambient atmosphere. A voltage converter converts alternating current to an electrostatic charge which is distributed on the surface of the louvers causing them to repel each other.

U.S. Pat. Nos. 6,223,804 and 6,601,637 to Toti disclose hinge mechanisms and window cover systems. The hinges and window covers generally include: a vertical slat blind arrangement including an upper traverse track; carriers or trolleys suspended from the traverse track; a mechanism for horizontally traversing the carriers along the track; and an array of vertically oriented slats suspended from the carriers for opening and closing traversing movement along the traverse track. Adjacent slats are pivotally joined along their vertical length by a hinge mechanism comprising a first generally c-shaped hook or hinge member extending along the length of a first of the adjacent slats and a second mating, generally c-shaped hook or hinge member extending along the length of the second of the adjacent slats.

U.S. Pat. No. 6,672,366 to Wade discloses a plurality of barriers that cover windows in French doors in which the window in each door has a first area smaller than a second area of the French door in which it is located. Each barrier includes a rigid frame defining a third area larger than the first area. First and second fabric covers stretched on opposite sides of the frame provide opacity and decoration. The barrier is hung on a French door so that the window is covered by the barrier without tools or manipulation of parts. The decorative fabric covers cooperate with one another to make a unitary decorative scene.

U.S. Pat. No. 8,074,698 to Allsopp discloses a window blind frame system comprising a window blind secured to a frame and optionally at least one frame-securing clip for releasably retaining the frame in position relative to the window casing. The frame may comprise at least two angle joints connecting at least three extruded portions to form a substantially rigid structure, wherein a window blind may be attached to the frame and wherein the frame is configured to interact with a frame-securing clip which releasably retains the frame in position relative to a window casing. The components of the window blind frame system may be provided in kit form. Methods of assembly and fitting of the window blind frame system are also provided.

U.S. Pat. No. 8,037,923 to Alkhoury discloses a magnetically attachable window screen system comprising a rectangular casement window having a casement window frame for removably attaching a rectangular window screen, the casement window frame comprising four window frame sides, the four window frame sides comprising a lower horizontal frame side, an upper horizontal frame side and two opposing vertical frame sides. Each window frame side comprises a front perimeter wall and a side perimeter wall.

At least one frame magnet attached to the casement window frame at least partly behind the plane defines the front perimeter wall or the plane defining the side perimeter wall. At least one support on the casement window frame supports the window screen. The window screen comprises a screen frame comprising four screen bars. The four-screen bars comprise a lower horizontal screen bar, an upper horizontal screen bar, and two vertical screen bars. The window screen further comprises at least one screen magnet attached to the window screen frame and positioned to magnetically co-operate with the at least one frame magnet attached to the casement window frame.

U.S. Patent Application No. 2004/0154753 to Tagtow et al. discloses a retractable flexible screen for installation to a frame of a fenestration product, the frame having opposite pairs of frame members. The flexible screen extending and retracting across an opening in the fenestration product and including flexible screen material and a roller system upon which the screen material is unwound and wound. A pair of mounting brackets are provided, each attachable to one of the pairs of frame members. A control bar connects to the screen material and moves along a pair of tracks each mountable to the same pair of frame members, the screen material extending from the roller system to one of the other pair of frame members. A gripper system mounts in the tracks and grips the screen material in a closed flexible screen. A spring tensioning system provides post-installation access to adjust the tension of a spring within the roller system.

U.S. Patent Application No. 2007/0261804 to Simpson discloses a window covering with improved light and thermal blocking abilities. The window covering may include a panel that is mountable over a window using magnetic coupling. In particular, the panel may include at least one of a magnetic material and a ferromagnetic material, such that the panel is secured in place over the window by a magnetic force. When not in use over the window, the panel may be secured to a wall as a display piece using magnetic coupling.

U.S. Patent Application No. 2010/0288455 to Liscano discloses an improved window screen configured to allow a person to easily and quickly remove the window screen from a window frame without damaging the window screen, window frame or window. The improved window screen has a screen frame comprising a first C-shaped section and a second C-shaped section that are configured to slidably engage each other to move the screen frame between an extended position in the window frame and a retracted position for removing or installing the window screen in the window frame. The screen frame also comprises a securing mechanism, which in the preferred embodiment is a ball detent device, that secures the screen frame in its extended position and which is disengaged to move the screen frame to its retracted position. The window screen is adapted to eliminate the need to bend, flex or twist the window screen to remove it from the window frame.

U.S. Patent Application No. 2011/0056135 to Cochran discloses an energy saving grate system installed outside a building or structure in warm weather that reduces heating due to infrared radiation (IR) from sunlight. For a window application the grate acts as a sunshade to block or diffuse the IR and ultraviolet (UV) portions of sunlight while passing visible light. The grate cell size, depth, cell surface characteristics, and mounting details near the sash determine system performance of sunlight control, of the view through the grate, and of the exterior appearance. The grate is removable for cool weather. The grate system can cool various surfaces and requires no operating adjustments. It can be applied near most windows (including skylights) on all sides of a building where impinging sunlight causes unwanted heating. Compared to external solar thin mesh screens the grate system can provide more open area for a given performance in reduced IR heating.

U.S. Patent Application No. 2014/0060760 to Harris discloses a window covering configured for attachment to a window frame of a vehicle to cover an opening defined in the window frame. The window covering includes a casing, a panel, a first magnet, and a second magnet. The casing includes a first member and a second member. The casing includes a ferromagnetic material. The panel is attached to first and second members and covers the hole. The first magnet and second magnet are magnetically attached to the respective first member and second member. The first and second magnets are configured to be magnetically attached to the window frame. The magnets are permanent magnets. Each magnet is configured to exert a pull force sufficient to retain the window covering to the window frame of the vehicle such that the casing of the window covering does not move relative to the window frame during motion of the vehicle.

U.S. Patent Application No. 2014/0318048 to Dison discloses various embodiments of systems and methods related to a removable solar panel insert for a window. In some embodiments the window is an architectural window. The removable solar panel insert may include an insert frame-shaped substantially equivalent to the frame of the window and a translucent solar material securely attached to the insert frame. The translucent solar material covers an opening defined by the insert frame. The solar panel insert may be easily removed from the window.

Foreign Patent Application No. DE20316919 to Colt Internat Holdings Ag Baar discloses a sun shade that comprises an adjustable angle support connected to the window and containing spaced apart sun blind slats. The skylight comprises a window frame which can be mounted in a setting frame in the roof and is pivotable about at least one substantially horizontal axis. The sun shade is on the outside of the window.

Foreign Patent Application No. WO/2009/114437 to Kirby et al. discloses a self-contained tensioned roller shade system that can be easily installed in an opening, such as a window or a skylight. The roller shade system includes a frame, a roller tube rotatably mounted between side channels of the frame adjacent a first end of the frame, and a shade fabric windingly received around the roller tube. A tensioning cord is operatively coupled between the roller tube and a fabric end of the shade fabric, and windingly received about the roller tube. A pulley is operatively coupled to the frame adjacent the second frame end and windingly receives the tensioning cord.

Foreign Patent Application No. WO/2012/131472 to Stoyke discloses a secondary interior window insert which comprises a frame, at least two panes, one or two flexible integral glass sealing lips, a spacer insert located between the panes, a sealing plate and means to tie up panes, frame, sealing plate and glass sealing lips. The device may further comprise integral friction fit seals, a jamb cover. The insert window contains several sheets of glass or plastic that creates additional dead air spaces. The insert window frame contains a groove to retain a cover strip that extends from the frame to insulate the cold window jamb. It also represents an improvement with respects to ease of assembly by having the seals extruded as integral part of the frame.

Internet Publication "Skylight Blinds" found at http://www.homedepot.com/b/Doors-Windows-Windows-Skylights-Skylight-Blinds/N-5yc1vZc5f0 discloses skylights and manually operated black-out blinds for skylights.

Despite the advent of the aforementioned skylight/window coverings, problems for specialized window coverings still exist. For example, several of the heretofore known and utilized covers are appointed to be integrated within the window structure itself. As a result, window structures having the covering or blind integrated into the construct or frame result in a product that is expensive to manufacture, package, install and replace, and more prone to damage owing to several moving parts. Some types of coverings utilize magnetic portions placed on both the window frame and the window covering. As a result, the user must align the magnets with the proper charge and owing to the magnet on magnet attachment, the magnetic field is increased thereby increasing the risk of affecting pacemakers and other medical devices. Other types of coverings require extensive installation and maintenance. Separately installed coverings are often complex and expensive, and difficult to install. Due to the required structural installation there exists an added concern that improper installation will result in structural damage to the window, window frame, and/or building itself. Such damage may adversely affect structural integrity and trigger potential water leakage, causing real and personal property damage over time.

Accordingly, there exists a need for a window covering particularly suitable for skylights and/or elevated windows, wherein the window covering includes a cover, blind, or shade composed of a lightweight material that it is easy to install and to clean. Further, there is a need in the art for a covering for a skylight/elevated window that is lightweight and readily placed in position with minimal effort by a layperson. Additionally, there is a need in the art for a window covering for skylights wherein the covering comes in conventional skylight/elevated window sizes and is readily inserted within the skylight frame resulting in a flush clean fitting that can be readily removed when desired or for cleaning.

SUMMARY OF THE INVENTION

The present invention is directed to a mountable cover, blind and/or shade for covering any glass/glazing panel(s) in windows, stationary and moving window, skylights, walls and/or doors. Briefly stated, the subject mountable cover is appointed to provide a window covering, particularly contemplating a skylight, door or window glass/glazing panel, cover, or blind, comprised of a lightweight material and for example having four pins, or four fastening materials or four fastening mechanisms so that it is easy to install and remove to clean. The subject mountable cover for windows, doors, walls or skylights which house the glass/glazing panels, provides a UVA/UVB filter, shade or decorative cover that is lightweight and readily placed in position. Attachment to the window is carried out by way of the fastening mechanism of the subject mountable cover, which comprises magnetic fastener attachment to metal plates adhesively secured to the window glass to mount the mountable cover directly onto the window glass. Alternatively the metal plates may be secured to the window frame directly abutting the window glass so that the subject mountable cover is mounted on the window frame/sash.

When used in position under a skylight in the tunnel or ceiling well or attached to the skylight, it keeps the surrounding environment cooler in summer and warmer in winter. It also prevents the sun's rays from fading carpets and upholstery. Generally, skylights come in conventional sizes and the subject mountable cover is offered in a variety of custom sizes, and including the conventional sizes of skylights and sizes to be placed anywhere in the skylight tunnel or well even with the ceiling. The pins or brackets fastening mechanism(s) can be made in different sizes and shapes. Another way of mounting the subject mountable cover utilizes a spring or pressure-loaded pin and latch adapted to mate. More preferably, the subject mountable cover utilizes magnetic fasteners with metal plates, wherein one or more magnets are attached to one or more metal plates adhesively secured to the window glass to mount the mountable cover to the window glass or the window frame or sash directly abutting the window glass.

The subject mountable cover shade/blind can be premade in the conventional sizes or can be custom made or sized to cover any percentage of a window, stationary and/or moving window, skylight, wall and/or door less than 100%. Materials composing the subject mountable cover can vary. The subject mountable cover preferably has a variety of functions, including blocking light, reducing heat buildup, insulating properties to keep heat in during colder/winter months, as well as a decorative function and privacy, full or partial. Pins are constructed as short pins or longer pins; similarly, wherein bracket mechanisms are utilized, the brackets are constructed as short or long brackets, ranging from 1" to 3" or different types like "L" or "Z" brackets.

The term window frame herein includes window frame structures formed in drywall and/sheetrock, window frames secured to a structures wall or ceiling, or window frame structures directly abutting window glass/glazing panel(s). The subject mountable cover may be mounted within any of the aforementioned frame structures and may be stationary or movable. Stationary structures include stationary windows such as skylights. Movable structures include movable windows such as sliding glass doors, all doors, or double hung or casement windows. Where the mountable cover is mounted within a movable window structure, the cover is mounted within the shallow frame directly abutting the glass/glazing panels. Alternatively, the mountable cover can be mounted directly onto the glass or glazing panel/material so that the cover, frame and window move together as a unit by way of magnetic plates adhered to the glass mated with magnets located on the subject cover. This can be achieved through use of magnets, hook and loop fastening materials (such as are sold under the trade name Velcro) or shallow suction cups. When being utilized with mounted windows, the frame of the mountable over itself is very shallow in depth so that it preferably sits substantially flush within the movable window frame.

Generally stated, the subject mountable cover is constructed having at least one mounting frame forming corners (flat, angled or curved), with an insert panel located therein. Insert panel is constructed as a blind, shade, window cover, heat reflective material, UV radiation filtering material (UVA, UVB, and/or UVC), heat insulation material, heat reflective material, or combinations thereof, adapted to provide a window glass/glazing panel covering for windows, doors or skylights. Materials contemplated include those utilized in constructing light filtering shades, cellular shades, cloth panels, light blocking shades, dark-out panels, etc.

Location of the fastening mechanism may vary. Preferably it is located on at least one side wall of the mounting frame. Alternatively, there may be at least two fastening mechanisms with one being located on each of the side walls, respectively, of the mounting frame. The fastening mechanism comprises apertures within the mounting frame and a pin adapted to be received within and traverse the aperture to protrude therefrom and abut against a window frame so that the subject mountable cover is secured within the window. It is noted that the term "pin", as used herein, refers to any short, slender, structure typically used to join things together and includes, but is not limited to, a spring pin, screw, tack, or nail.

The mounting frame can also be made in standard sizes to fit within the window frame. Alternatively, the mounting frame is sized and shaped to fit onto the window on the glass/glazing panels directly mounted by hook and loop fasteners such as those sold under the trade name Velcro or other products like Gripeez to hold it against the panel. Mounting frame can be composed of a plethora of materials, including but not limited to wood materials that correspond to typical wood colors/plastic colors utilized for current window frames.

A mountable cover for a window in a building that includes a window frame that holds a window sash housing a window glass and having a first side facing an interior portion of the building and a second side facing an exterior portion of the building is provided. The mountable cover comprises a mounting frame having a back side, front side, top wall, side walls and a bottom wall, the front side of the mounting frame facing an interior portion of the building and the each of the top wall, side walls and bottom wall of the mounting frame being removably mounted against the window sash. At least one panel is located within the mounting frame. The panel comprises a material adapted to block at least a portion of light external to and traversing the window glass, the panel sitting parallel to and covering a portion of the window glass to block the light that has traversed the window glass. At least one fastening mechanism comprising one or more magnetic strips and metal plates having a top wall, bottom wall and side walls is provided. The magnetic strip is located on the mounting frame and is adapted to engage with the metal plate that is adapted to be mounted on the window. The magnetic strip is adapted to engage with the metal plate on the window to mount the mountable cover over the window.

In a preferred embodiment, the bottom wall of the metal plate includes an adhesive surface adapted to be affixed to the window. Preferably, the bottom wall of the metal plate adhesive surface is adapted to be affixed to the window glass to abut and sit flush thereagainst. Preferably, the top wall of the metal plate includes at least one raised portion extending from the top wall of the metal plate. The raised portion may be formed as rounded raised bumps extending from the top wall of the metal plate. Alternatively, the raised portion comprises a rounded raised bar extending from the top wall of the metal plate. In another embodiment, the metal plate includes an aperture adapted for receiving a screw or nail for affixing the metal plate to the window sash of the window or the frame of the window. At least one spacer, Z-bracket, and/or at least one "L" shaped member may be provided.

The glass/glazing cover for windows, doors or skylights cover can additionally be attached to the window glass/glazing panel framing of standard and custom size glass panels windows to accomplish sun blocking and decorative functions. Ornamental framing can be utilized to form the mounting frame, and the panel may be decorated or painted to resemble an artwork, so that the mountable cover looks like a picture when it is placed on the window glass or glazing panel.

In yet another embodiment of the invention there is provided a mountable cover for a window in a building that includes a window frame that holds a window sash housing a window glass and having a first side facing an interior portion of the building and a second side facing an exterior portion of the building. In this embodiment, the mountable cover comprises a mounting frame having a backside, front side, top wall, side walls and a bottom wall, the front side of the mounting frame facing an interior portion of the building and each of the top wall, side walls and bottom wall of the mounting frame being adapted to be removably mounted directly to the window glass and against the window sash to abut and sit flush thereagainst. At least one panel is located within the mounting frame, the panel comprising a material that blocks at least a portion of light external to and traversing the window glass, the mounting frame and the panel sitting parallel to and covering a portion of the window glass and the panel blocking the light that has traversed the window glass. At least one fastening mechanism is located on the back side of the mounting frame only and not on the front side of the mounting frame or on the panel, the fastening mechanism constructed as magnetic fasteners wherein at least one magnet (and preferably 4 magnets) is attached to at least one metal plate (and preferably 4 metal plates) adhesively secured to the window glass to mount the mountable cover to the window glass.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE DISCLOSURE

Figure 1A:
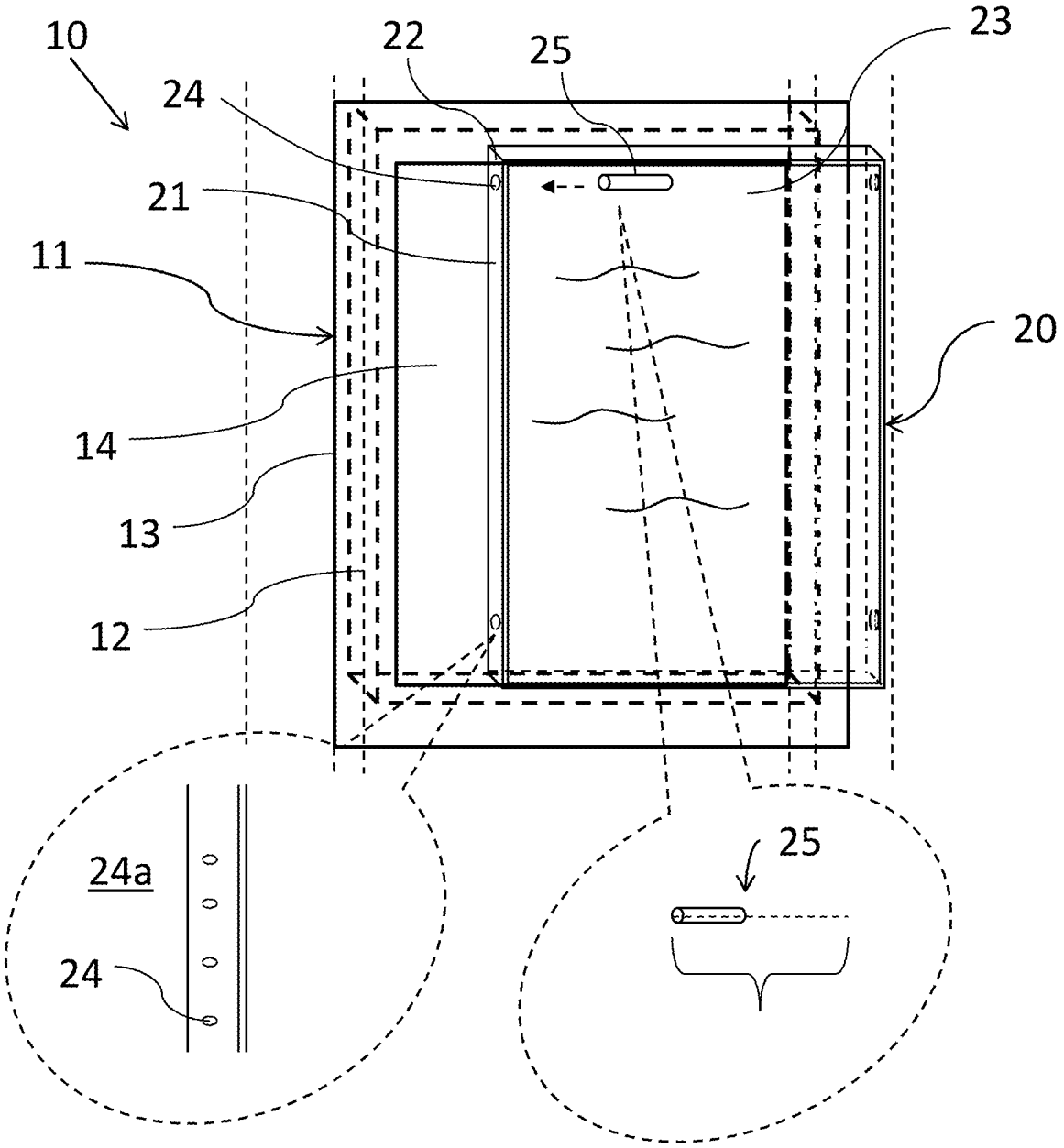
FIG. 1*a* illustrates a top plan view of an embodiment of the mountable cover being inserted onto a glass/glazing panel of a door, window/skylight.

The best mode for carrying out the present disclosure is presented in terms of the embodiments herein. The embodiments described herein in detail are for illustrative purposes and are subject to many variations. It is understood that various omissions and substitutions of equivalents are contemplated as circumstances may suggest or render expedient but are intended to cover the application or implementation without departing from the spirit or scope of the present disclosure. Further, it is to be understood that the phraseology and terminology employed herein are for the purpose of the description and should not be regarded as limiting. The headings utilized within the description are for convenience only and have no legal or limiting effect.

The subject invention is directed to a mountable cover, blind and/or shade for a window, door or skylight.

As used herein, the term "window frame" means a framed structure having one or more windows or glass panes or glazing panels therewithin, and having the form of a door, skylight, or a sliding or stationary window. The term "window frame" further means a vertical member of a panel or frame, as in a door or window sash or a frame in which the panes of a window or door are set.

As used herein, the term "window" means one or more glass panes or panels or glazing panels generally within a window frame, door, wall, skylight, and/or a sliding or stationary window.

The mountable cover, blind and/or shade for a window or skylight provides a window covering, particularly contemplating a skylight cover, or blind, composed of a lightweight material and having four pins/fastening mechanism so that it is easy to install and to clean. The mountable cover is designed to provide several advantages over other blind/shade devices. It functions to minimize solar heat and light from coming in through a skylight or window, to keep the heat in during the winter or colder months, and to keep the heat out in hotter months. It provides significant advantages over other blinds and shades in that it does not require extensive mounting parts and is not labor intensive. It does not require any manipulation of the existing window frame, leaving the existing window frame with just a pinhole or small hole. Ease of installation is achieved in a manner so that a layperson can mount the cover him/herself without the need to call in a contractor or professional. As a result, cost savings in installation are immediately realized. Additionally, the subject mount cover does not include any expensive moving parts, motors or reels. As a result, the subject mount cover is much more cost effective in manufacturing, packaging and transporting. Further, it is less susceptible to wear and tear and damage as it does not have any delicate moving parts or motors. The mount cover is easily installed as it is lightweight and preferably requires minimal drilling or nailing, if needed, to the glass/glazing panel of the window frame. It is attractive, and easy to clean or take care of and can readily be changed or switched out to suit a particular need or to change for decorative purposes. The panel may be composed of a plethora of materials having different colors and/or designs, and the material may be transparent, opaque or blackout, depending on the desired functions/needs of the user. The material may be constructed to provide the ability to still look out of the window, yet provide privacy in shading so that an outsider cannot look into the window. It also can provide partial protection. Due to its structure, it can be mounted in a matter of minutes, or removed and taken down for cleaning. Once the mount cover is removed from the window, the total glass/glazing panel of the window frame is exposed for cleaning.

Fastening or mounting of the mountable cover is carried out through use of a fastening mechanism.

In a preferred embodiment, the fastening or mounting mechanism includes magnets and metal plates to which the magnets attach. The magnets and mating metal plates, which preferably have matching shapes but not necessarily, can be circular, square, rectangular, or oval, etc., and can have sharp corners or slightly rounded edges. The magnets, as well as the plates, can be designed with a hole or a countersunk hole, or without any such hole and instead have an adhesive backing. The term "plates" herein refers to metal plates or iron-containing plates that attract a magnet. They can also have a flat surface or have a protruding line or bump. Advantageously, the plate construction and geometry allows the user to attach it practically anywhere. It can be attached via adhesive on the middle of a window glass; on the window frame (such as the frame or sash); to a wall surrounding a skylight; to a wall or surface surrounding a window. The metal plates can alternatively be attached via screw or nail to a painted surface, and/to an oily surface, aluminum surface, or any desired surface. Unlike magnet to magnet fastening configurations which cannot be readily attached to an oily or painted surface, the countersunk hole in a metal plate allows the user to attach the plate to a painted or oily surface. Moreover, the plate-to-magnetic configuration provides for easier alignment of the magnet to the plate, while providing less of a magnetic field, with the result that individuals with pacemakers and other medical devices do not undergo medical risk.

There are four categories of magnets: 1. Neodymium (NdFeB); 2. samarium cobalt (SmCo); 3. Alnico; and 4. Ceramic or ferrite. The mating steel plates can be attached to the frame around the glass on non-steel doors or windows. Magnets can be attached to the mountable cover in a multitude of ways including glued, screwed, taped, and the like. The magnets and plates can be mounted the opposite way, i.e., the plate attached to the mountable cover and the magnets mounted on the frame which surrounds the glass on doors and windows which are not of the steel composite variety.

Preferably the plate includes a rise or bumps resulting in the ability to use a lesser strength of a magnet, making it easier to align, place and remove the mating magnet, while preventing the magnet from sliding down so easily. In a preferred embodiment, the plate includes a double-sided tape so that it can be adhered to the window glass itself or the window frame. The magnet does not include double sided tape but is screwed or fixedly attached to the frame of the mountable cover. When one attaches two magnets together, the force is even stronger, so to lower the pulling power, a smaller magnet must be used.

Owing to the use of the subject plate, the magnet can be of different sizes, i.e., 1" by 1; ⅞×1¾. There are two reasons for this. Firstly, in use of the double-sided tape, the more surface of tape used, the stronger the bonding, thereby permitting placement of heavier weights upon it; i.e., for every 1" long by 1" wide, the double-sided tape can hold "x" amount of pounds. The more tape, the more poundage one can hold. Secondly, it is much easier and less expensive to provide a 1"×1¼" plate rather than another magnet. Also, magnets have a tendency to pull together hard and subsequently crack or break. However, a magnet-plate fastening mechanism does not exhibit this tendency. The plate thickness can come in variations of thickness, ranging from about 1/32 to 3/16 inches. Therefore, the magnet and plate configuration of the subject invention is superior to a magnet to a magnet fastening configuration. Moreover, the magnet and plate configuration provides a cleaner look. When taking the cover off, the user only has a flat plate sitting on the surface, not a magnet which could potentially hurt something as it is bulky and can be un-aesthetic. The plate can be made bigger and another important factor is that the subject cover can be put over grills that may sit on the window and the grills don't have to be taken out. In an alternative embodiment, spacers are provided that are adapted to be placed behind the magneto effect thickness adjustments. As a result, the subject cover can be put on or off in less than a minute.

The subject cover provides for the ability to place a covering over windows having molding holding glass in place that protrudes ⅜" to 9/16" on a door. The subject magnet spacers can be readily placed with the plates, without having to increase the pulling power. The material in the subject cover sits on the bottom of the cover's frame, so that with use of the spacers, the cover can be placed without raising the frame of the cover to the height of the molding. The other piece in a door window is a full glass door. For vertical placement, such as on a window or door, the subject covers can be attached at the bottom two corners of the frame, simply using a "Z" bracket with magnets as well as the top two corners of the bottom frame so that the covers can sit securely and beautifully on a door.

On horizontal hanging or placement of the subject covers, i.e., such as in skylight wells, an "L" bracket or a pin is preferably used which allows the user to lift the frame above the "L" bracket or pin and then set the subject cover on it. The "L" bracket, for convenience, has two holes, one of which a tiny nail can go through to hold the "L" bracket in place. In situations where the sheetrock is thicker, or the frame is heavier, one can use a screw to attach the bracket. This fastening mechanism is designed to prevent harm to an individual if the bracket is not secured correctly.

In an alternate embodiment, the fastening mechanism comprises four apertures in the frame that are adapted to receive four pins, four magnets, four Velcro, or other adhering materials, respectively, therein. In another embodiment, the fastener means is comprised of at least two, preferably four, "L" shaped brackets wherein the top portion of the L bracket (vertical portion) is screwed or pushed into sheet rock for a skylight and wherein the cover can sit on the lower portion of the L bracket (horizontal portion) or via magnet on the back of the mounting cover that mates with the lower portion of the L bracket. In another embodiment, metal plates can be attached to the ceiling and magnets located on the back of the frame of the mountable cover mate with the metal plates. In another embodiment, wherein the window is part of a door, "Z" brackets may be used. For windows that sit on the vertical plane (such as double hung windows, and/or windows in doors or walls) custom holding pins are used wherein the pins insert through apertures in the frame and window. Alternatively, for windows that sit on the horizontal plane, or any degree from the vertical plane, (such as skylights, etc.) custom supporting pins can be used wherein the mountable cover sits on the pin. In yet another embodiment, for skylights a horizontal supporting pin may be used instead of brackets and/or plates, that the mounting cover rests against and is held in place. Accordingly, when placed over the skylight, the mounting cover can cradle or sit on top of the L bracket, metal plates or securing pins may be used. In a first embodiment, the subject mountable cover is constructed having at least one mounting frame forming corners (flat, angled or curved), with an insert panel located therein. Insert panel is constructed as a blind, shade, window cover, heat reflective material, green material, UV radiation filtering material (UVA, UVB, and/or UVC), heat insulation material, heat reflective material, or combinations thereof, adapted to provide a window covering for window, door, or skylight. Materials contemplated include those utilized in constructing light filtering shades, cellular shades, cloth panels, light blocking shades, dark-out panels, etc.

At least one fastening mechanism is associated with the mounting frame. The fastening mechanism may be formed with at least one aperture drilled within the mounting frame adapted to receive a pin, spring pin, screw, nail, or latch adapted to mate with a mating latch portion on a window frame. In an alternative embodiment, the fastening mechanism comprises a tab with at least one aperture appointed for receiving a pin. Optionally, the fastening mechanism comprises a tri-fold spacer with at least one aperture appointed for receiving a pin, spring pin, screw, nail, or latch adapted to mate with a mating latch portion on a window frame. Particularly, the tri-fold spacer is constructed having a first, second and third mini-spacer section attached together at bendable or foldable seams. At least one aperture is located on each of the first and third mini-spacer sections each for receiving a pin, spring pin, screw, nail, or latch adapted to mate with a mating latch portion on a window frame. Rubber or felt spacers may be provided to facilitate a flush fit of the pin, spring pin (push-fit plunger; etc.) The first, second and third mini-spacer sections are configured to remain unfolded and to fold upon one another to yield different configurations.

In another embodiment, a mountable cover for a window comprising a plurality of mounting frames. Each mounting frame having a top wall, side walls and a bottom wall, said mounting frame and is adapted to be removably mounted within a window frame structure housing a glass/glazing panel on the window. The mounting frames are configured to abut and sit flush within said window frame structure. At least one panel is located within each of said mounting frames. The panel comprises a material adapted to block at least a portion of light external to and traversing the window, and is adapted sit parallel to said window. At least one fastening mechanism appointed to engage with the window frame structure for mounting and removing the mounting frame from the window frame structure. The plurality of mounting frames is joined together by way of at least one adjoining member. Preferably there are at least two mounting frames with panels, and the mounting frames are adjoined together by way of said adjoining members comprising hinges. More preferably, there are at least three mounting frames with panels adjoined together by way of the adjoining members, wherein the adjoining members comprise hinges. The adjoining members comprise hinges. Optionally, the fastening mechanism comprises a tab with at least one aperture appointed for receiving a pin. In another embodiment, the said fastening mechanism comprises a tri-fold spacer with at least one aperture appointed for receiving a pin, said tri-fold spacer comprising a first, second and third mini-spacer section. At least one aperture is located on each of said first and third mini-spacer sections. The first, second and third mini-spacer sections are configured to remain unfolded and/or to fold upon one another to yield different configurations for securing the plurality of mounting frames within the window.

The mountable cover provides a shade that is lightweight and readily placed in position under a sky light to keep the surrounding environment cooler in summer and warmer in winter. It also prevents the sun's rays from fading carpets and upholstery. Generally, skylights come in conventional sizes of skylights for flush clean fitting on skylight or anywhere in the ceiling tunnel or well which houses the skylight. The pins for fastening mechanism can be made in different sizes. The mountable cover shade/blind can be premade in the conventional sizes or can be custom made or sized. Materials comprising the mountable cover can vary. The mountable cover preferably has a variety of functions, including blocking light, reducing heat buildup, and insulating properties to keep heat in during colder/winter months. Pins are constructed as short pins or longer pins. "L" brackets may be constructed as short or longer having one or two holes to screw or pin into sheetrock or wood framing.

The term window frame herein includes window frame structures formed in drywall and/sheetrock, window frames secured to a structures wall or ceiling, or window frame structures directly abutting window glass/glazing panels. The subject mountable cover may be mounted within any of the aforesaid frame structures and may be stationary, such as for stationary windows including skylights generally, or on doors, or movable, such as for movable windows such as sliding glass doors or double hung windows. Where the mountable cover is mounted within a movable window structure, the cover is mounted within the shallow frame directly abutting the glass so that the cover, frame and window move together as a unit or can be mounted directly over glass/glazing panels. When being utilized with mounted windows, the frame of the mountable cover itself is very shallow in depth so that it preferably sits substantially flush within the movable window frame. For example, see FIGS. 10*a*-10*e* herein.

The mountable cover is appointed to be mounted directly on the face of the window frame or stile with a pin, screw, nail or object which will pass through the drilled hole or cover to affix or attach into the wood, vinyl, fiberglass or other material of the stiles. Bottom of the cover attaches to top face of the stiles (i.e. the top face being the forward-facing surface facing the interior of the building or construct which the window/door is fixed within) of the stiles, pretty much covers the whole top of stiles. Alternatively, no holes are needed. In which case the mountable cover bottom face can attach to the face/top of stiles with hook and loop fasteners such as that sold under the trade name Velcro, or through use of magnets, and or through use of special adhesive pads for holding low weight objects such as that sold under the trade name Gripeez, or other similar material which will allow you to install or remove cover with minimal effort. Metal windows will not need pre-drilled holes this is because cover can be attached, like to top face of the stiles with magnets already attached to cover. However, the cover can still be secured with a screw and bracket or screw through drilled holes into metal, or with Velcro or Gripeez or other similar products which need no holes drilled.

In application, the mountable cover can readily be placed where the window screen traditionally is placed abutting the window or door construct. The cover can be placed where the window screen goes with a pin, screw, nail etc. which will need holes drilled thru the cover, side to side, so that the nail, screw, pin can pass thru the cover and affixed or attach into the part of the window frame or molding where the screen sits or so allowing the window to be function able. Alternatively, the mountable cover can be placed where the window screen goes with a bracket which gets secured from cover to window with a pin, screw or nail which will not need holes drilled thru the cover. One part of the bracket attaches to the cover top, bottom or somewhere in between and the other part get attached to frame, or molding. A pressure push fit plunger can also be used whereas the plunger is placed in the cover and pushes against adjoining molding or frame.

When attaching cover directly on top of the stile with a pin, screw, nail holes are to be drilled through the cover so that the nail, screw, pin can pass through and affixed or attach into the wood, vinyl, fiberglass or other material of the stiles. Bottom of the cover attaches to face/top of the stiles, cover is sized/made with enough height so that the material, which blocks the light, clears the molding which surrounds the glass/glazing panel or panels. Cover also is sized to fit around molding giving room to shift up, down, left, and right so to accommodate different size moldings and glass/glazing panels. The mountable cover can be constructed as one size to fit several sizes of glass/glazing panels. The bottom face of the mountable cover is attached onto the face/top of stiles with Velcro, or Gripeez or other similar material to allow removal and placement of the cover with minimal effort. No holes are needed. This pertains to all composite of which the doors are made. Alternatively, the mountable cover can be placed right on the glass/glazing panel with a flat bracket on top of cover to top of stiles, molding or frame. This can also be done with other shaped brackets like "S"-"Z" or "L" shaped, where the cover is attached via the top, bottom or somewhere on the cover and attached to top of stile, molding or frame. Metal doors will not need pre-drilled holes this is because cover can be attached to top of stiles with Magnets which are already attached to cover. This requires no installing of any parts. However one can still secure cover with screws and brackets or screw placed through drilled holes into metal and one can also attach the cover to the stiles with Velcro or EZ-Grip or other similar product.

Attachment to the window frame is preferably achieved by placing the cover parallel to the window sash or frame and placing directly on-top-of the window sash or frame so that the cover and window frame are in a piggyback relationship. For vertical windows (such as double hung windows; doors; etc.) located on a wall/doorway the cover is preferably attached via front of the window (or interior facing portion of the window sash) to the back of the subject cover via either piggyback configuration on-top-of the window sash front or by insert configuration within the shallow depth of the window sash sidewalls perpendicular to the sash front. Preferably, a pin, dowel or low profile nail is used, with no hammer being needed. In a preferred embodiment, attachment is achieved by way of a magnet and plate configuration. Wherein the window is a skylight type window (hung at an angle from the vertical plane, such as in a roof/ceiling) the cover is attached by preferably utilizing brackets as discussed hereinafter in more detail.

Figure 1B:
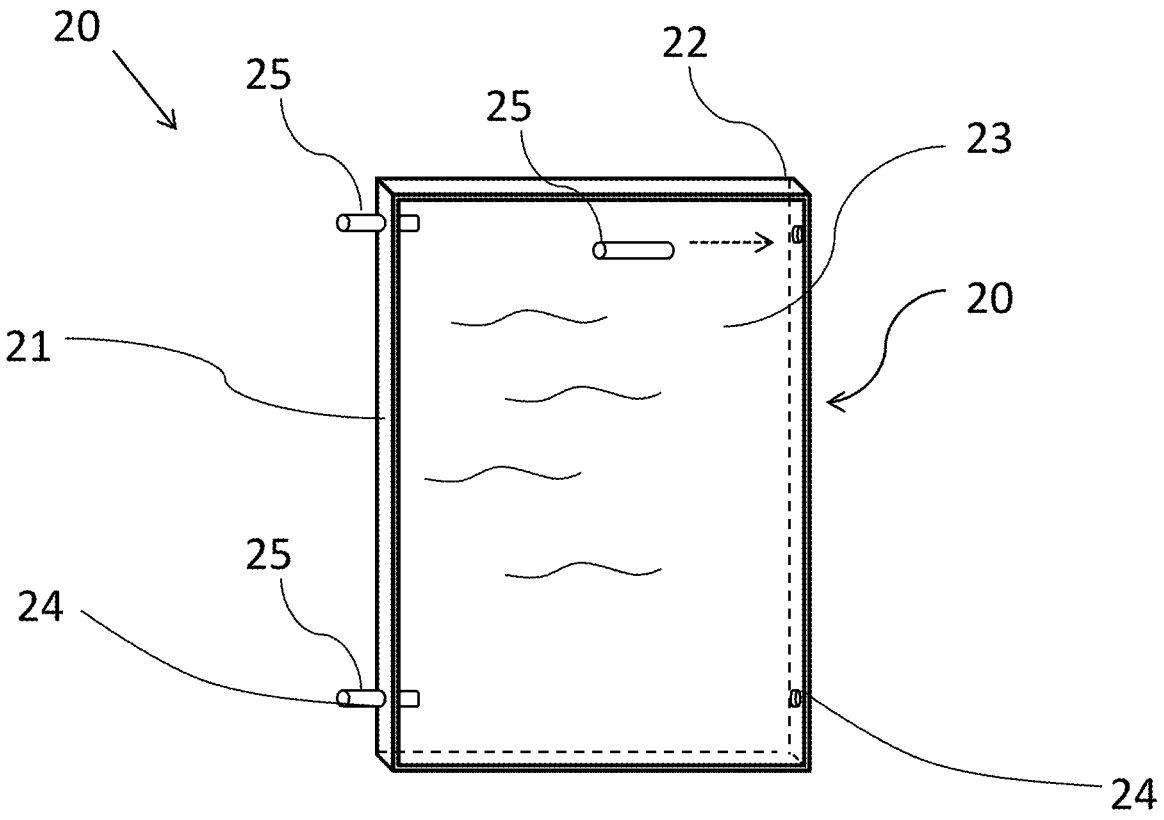
FIG. 1*b* illustrates a top plan view of the mountable cover of FIG. 1*a* removed from the window/DOOR/skylight.
Figure 1C:
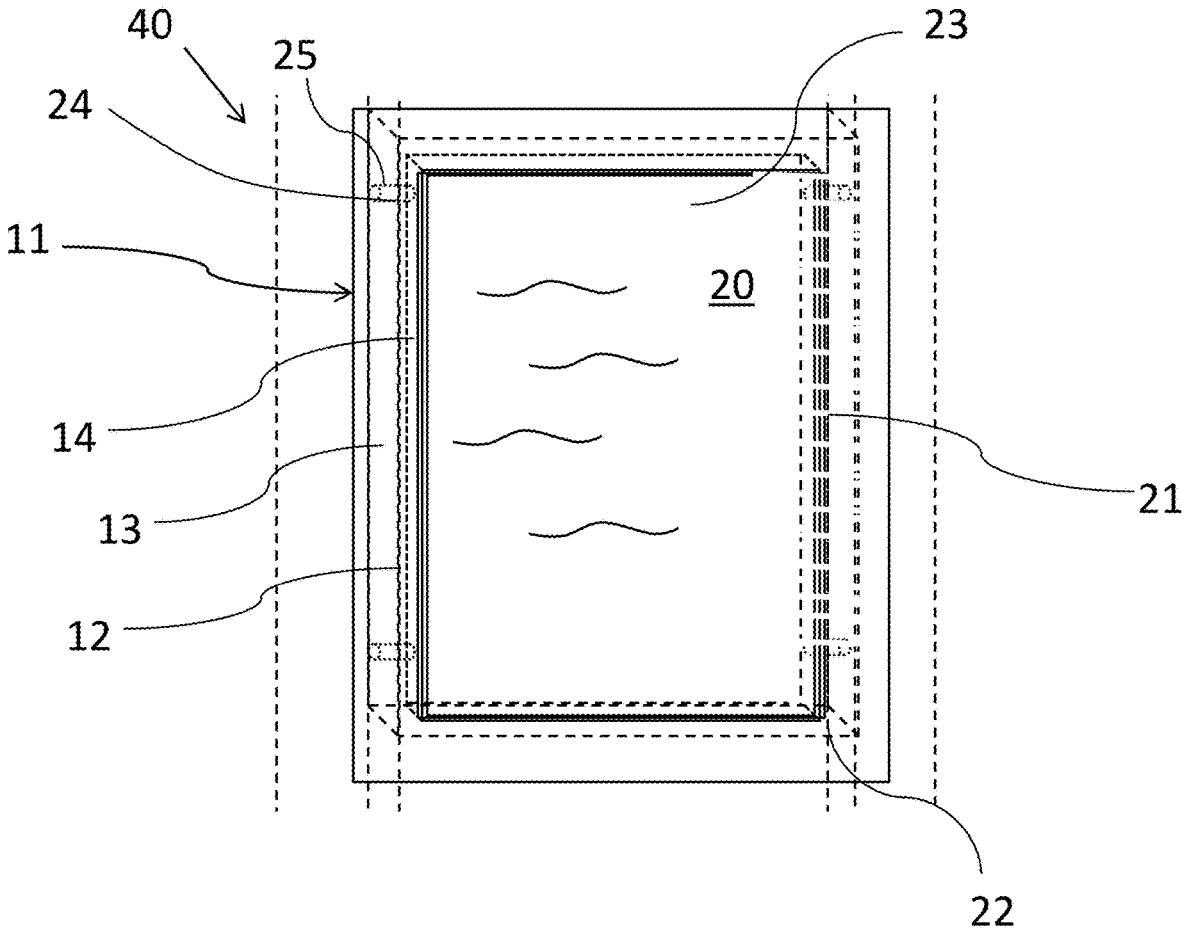
FIG. 1*c* illustrates the mountable cover of FIG. 1*a* mounted on the glass/glazing panel of a door/window/skylight.
Figure 2:
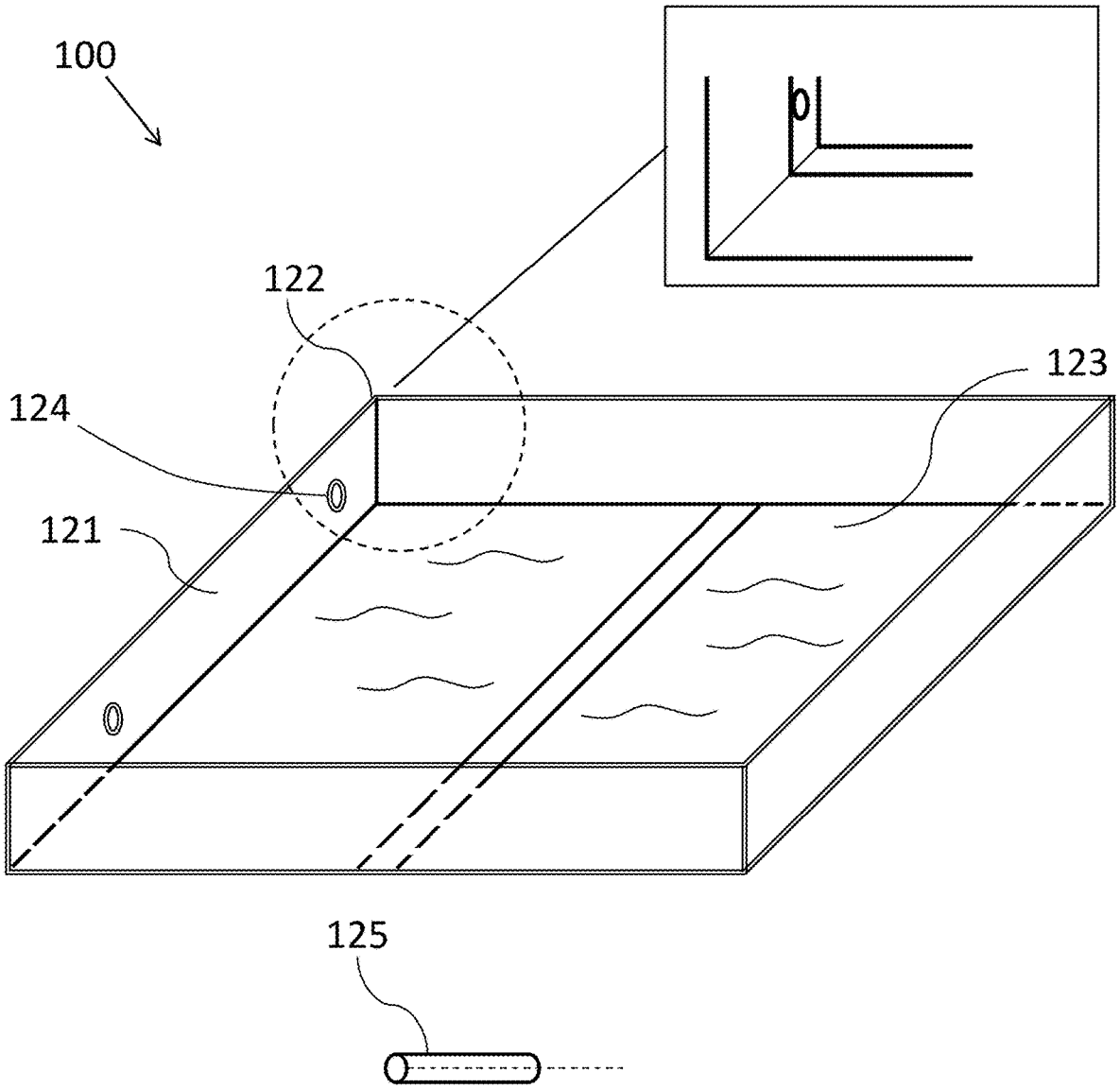
FIG. 2 illustrates a top plan view of an embodiment of the mountable cover.

FIGS. 1*a*-1*c* illustrate an embodiment of the mountable cover. FIG. 1*a* illustrates a top plan view of the mountable cover being inserted onto a glass/glazing panel of a door/window/skylight, shown generally at 10. FIG. 1*b* illustrates a top plan view of the mountable cover removed from the window/skylight, shown generally at 20. FIG. 1*c* illustrates the mountable cover 20 mounted the window/skylight, shown generally at 40. FIG. 2 illustrates another embodiment of the mountable cover, showing a top plan view of the mountable cover generally at 100.

As shown generally in FIGS. 1*a*-1*c*, the mountable cover is adapted to be removably and easily inserted into a window 11. Window 11 may be any window construct, but preferably is a skylight window. Window 11 is constructed as a typical window structure having a window frame 12, molding 13 and glass 14. Mountable cover 20 is adapted to be inserted within window frame 12 to sit flush within frame 12. Mountable cover 20 is constructed having a mounting frame 21 forming corners 22 (flat or angled), with an insert panel 23 located therein. Insert panel 23 is constructed as a blind, window cover, heat reflective material, and/or heat insulation material to provide a window covering for window 11. Mounting frame 21 includes at least one aperture 24 drilled therein adapted to receive a pin 25. A plurality of apertures may be provided as shown at 24*a*. Preferably, aperture 24 is located near a corner of frame 21 as shown. Preferably there are at least two apertures 24 located on at least one side of the mounting frame 21 as shown. Alternatively, there may be at least two more apertures 24 located on the opposing side of the mounting frame 21 as shown in FIGS. 1*a*-1*c*. Pin/dowel/nail 25 is adapted to be received within and traverse aperture 24 to protrude therefrom abutting tightly against window frame 12 so that the mountable cover 20 is secured within window 11. Pin 25 can be constructed having a variety of widths and lengths and can have a flat top or a pointed top for abutting the window frame 12 for securement. Mounting frame 21 can be composed of a plethora of materials, including, but not limited to wood materials that correspond to typical wood colors/plastic colors utilized for current window 11 frames 12.

In the embodiment shown, apertures 24 are located on a side wall of the frame, perpendicular to the front-facing wall of the frame (i.e., the front-facing wall of the frame faces the interior of the home/building, while the back wall of the frame rests against the window glass or window sash depending on the embodiment of the subject cover). In a more preferred embodiment, such as that shown in FIGS. 46*a*-*c*, the apertures (4624) are located on the front facing wall of the frame and pass through the aperture into a front-facing wall of the window sash frame to piggyback and rest parallel on top of the window sash frame, rather than being nested within the window sash as results in the embodiment shown in FIG. 1*a*-*c*.

Referring to FIG. 2, the mountable cover is generally shown at 100 and is adapted to be inserted onto a glass/glazing panel of a window as discussed hereinabove pertaining to FIGS. 1*a*-1*c*. Mountable cover 100 is adapted to be inserted within a window frame to sit flush therein. Mountable cover 100 is constructed having a mounting frame 121 forming corners 122, with an insert panel 123 located therein. Insert panel 123 is constructed as a blind, window cover, heat reflective material, and/or heat insulation material. Mounting frame 121 includes at least one aperture 124 drilled therein adapted to receive a pin 125. Preferably, aperture 124 is located near a corner of frame 121 as shown. Preferably there are at least two apertures 124 located on at least one side of the mounting frame 121 as shown. Alternatively, there may be at least two more apertures 124 located on the opposing side of the mounting frame 121. Pin 125 is adapted to be received within and traverse aperture 124 to protrude therefrom abutting tightly against the window frame (not shown) so that the mountable cover 100 is tightly secured on the glass/glazing panel of the window.

Figure 3:
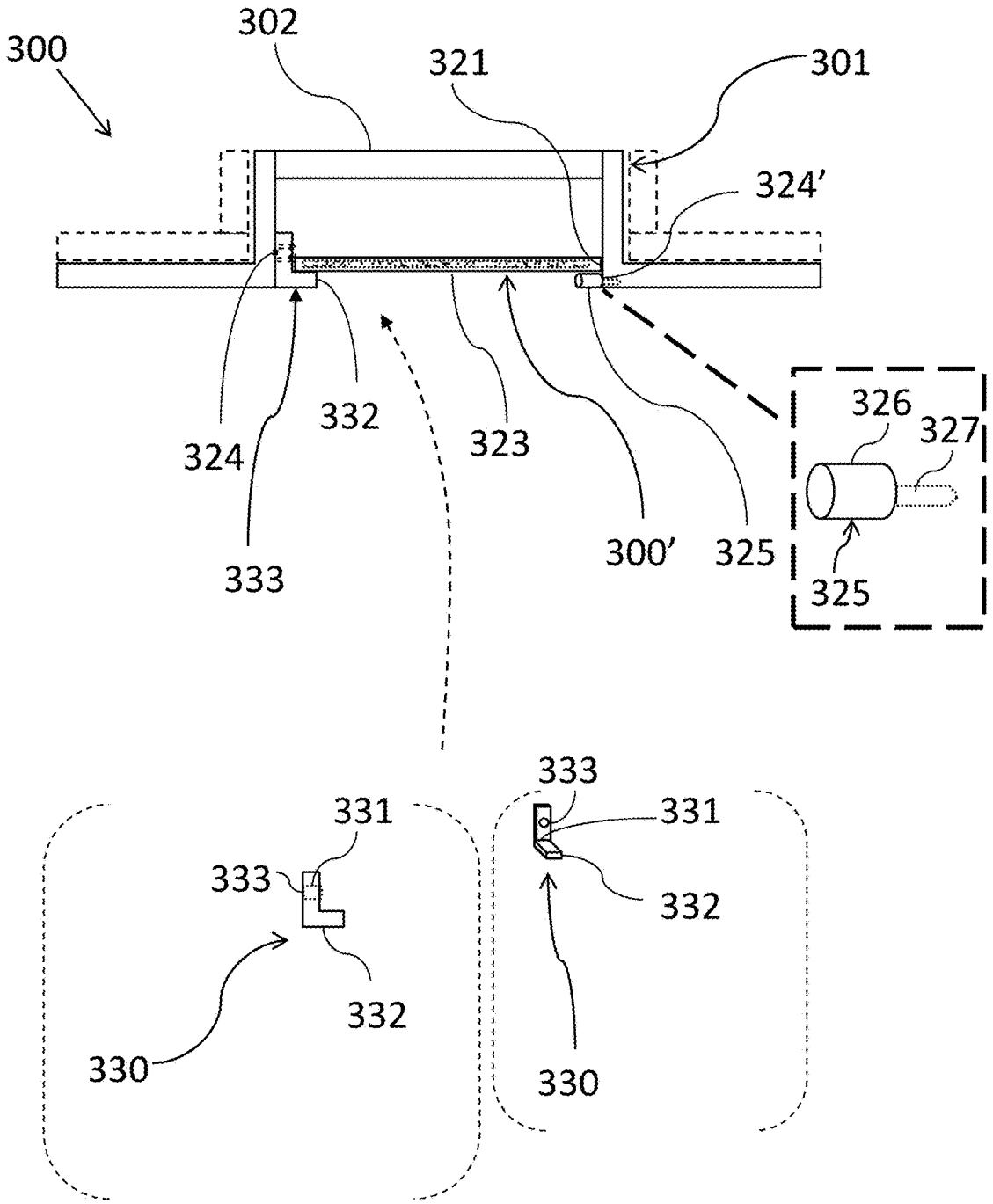
FIG. 3 illustrates a cross-sectional view of an embodiment of the mountable cover, showing an alternative embodiment of the fastening mechanism.

FIG. 3 illustrates a cross-sectional view of an embodiment of the mountable cover, shown generally at 300. In this embodiment, an optional fastening mechanism embodiment is shown. Mountable cover 300' is inserted into a window frame 301 with a window 302 therein, as discussed hereinabove pertaining to FIGS. 1*a*-1*c*. It is constructed having a mounting frame 321 with an insert panel 323 constructed as a blind, window cover, heat reflective material, and/or heat insulation material. An aperture 324 is drilled within window frame 301 which receives a screw that traverses a screw opening or hole 333 in an "L" shaped member 330. "L" shaped member 330 is constructed having a top portion 331 and bottom portion 332. Top portion 331 includes the apertures/screw hole 333 so that top portion 331 is tightened against the window frame 301 while bottom portion 332 acts as a shelf or support for mounting frame 321. An aperture 324' is located on the opposite side of the window frame 301 for receiving a pin 325 therein. Mounting frame 321 further rests on pin 325 which includes a peg portion 326 and a rod portion 327. Mounting frame 321 rests on the peg portion 326, which may be a square, rectangle or cylinder, while rod portion 327 is received within aperture 324' of window frame 301. In an alternative embodiment, at least two "L" shaped members are provided to be placed and mounted on the same side of the mounting frame 301; then on the opposite side thereof at least one aperture 324 is provided for receiving at least one pin 325. In this embodiment, the fastener means comprises at least one "L" shaped member that is screwed into the window frame to hold a portion or one side of the mounting frame, while the pin is inserted under the mounting frame on the opposite side, preferably being screwed into the sheetrock or abutting frame around the skylight/window. Accordingly, when placed over the skylight, the mounting cover can cradle or sit on top of the holder and/or pins may be used.

Skylight framing can be built in many different sizes, shapes and constructions. Framing for skylights can also have different dimensions, including flared framing. Moreover, spackling around a skylight often varies, and as a result different fastening methods for the subject cover are provided. The subject cover can be placed anywhere within the depth of the skylight framing. For example, "L" shaped members facilitate in preventing (1) minor damage of spackle over any corner metal guards; (2) the spackle being spread so thin that a pin can't go through; or (3) need for extra support if the cover is heavier in construct. The "L" shaped members allows the cover to mount flush to the ceiling by using four "L" shaped members or pins. It can also be easily fastened into the ceiling opening of the skylight by four pins, either pushed or screwed in place.

Figure 4A:
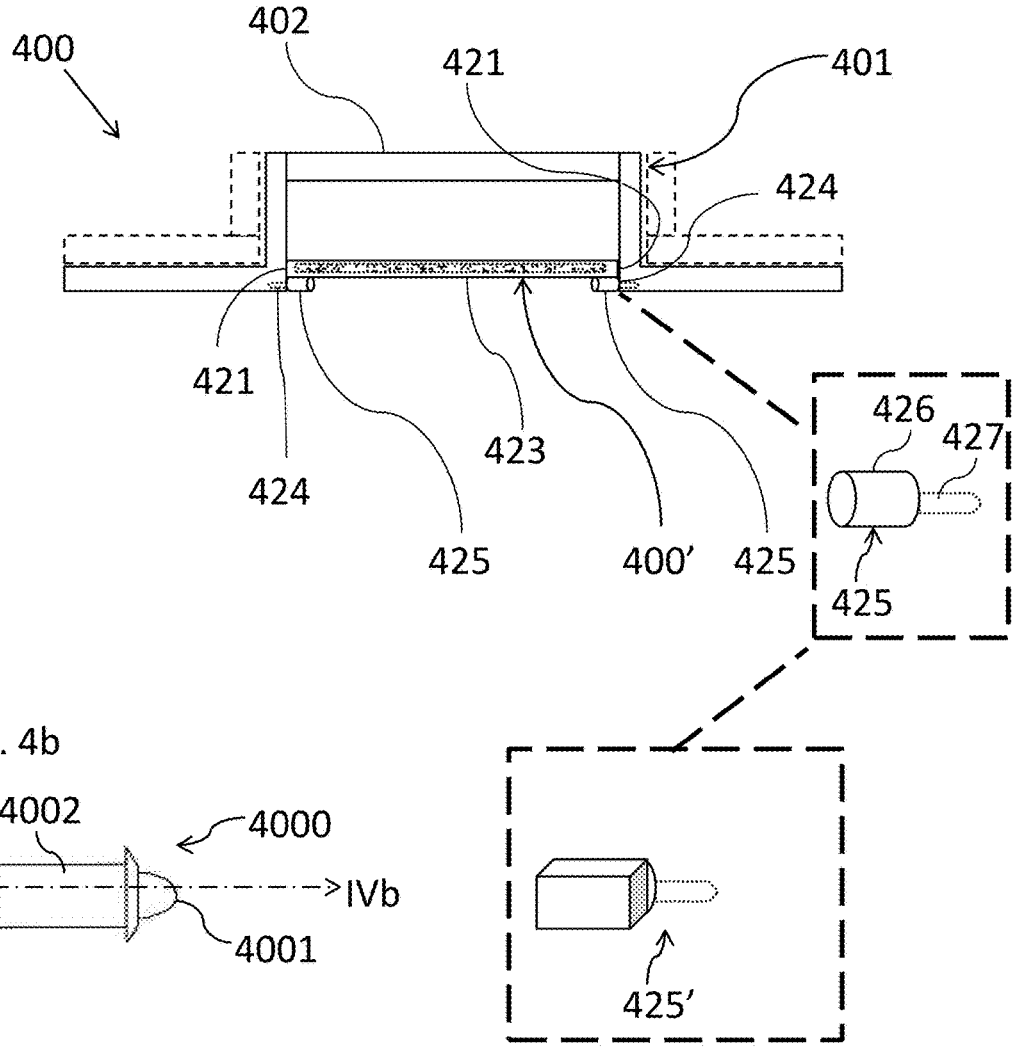
FIG. 4*a* is a cross-sectional view depicting horizontal hangs of the mountable cover, showing an alternative embodiment of the fastening mechanism.

FIG. 4*a* illustrates a cross-sectional view of an embodiment of the mountable cover, shown generally at 400. In this embodiment, an optional fastening mechanism embodiment is shown. Mountable cover 400' is inserted into a window frame 401 with a window 402 therein. Apertures 424 are drilled in window frame 401. Mountable cover 400' is constructed having a mounting frame 421 with an insert panel 423 constructed as a blind, window cover, heat reflective material, and/or heat insulation material. Once the mounting panel 400' is placed within the window frame 401 pins 425 are inserted within the apertures 424 in the window frame 401. Mounting panel 400' is then released so that mounting frame 421 rests on pins 425 to securely sit within window frame 401. Pins 425 include a peg portion 426 and a rod portion 427. Mounting frame 421 rests on the peg portion 426, which may be a square (shown at 425'), rectangle or cylinder (as shown at 425), while rod portion 427 is received within aperture 424 of window frame 401. Preferably, rod portion 427 terminates to a tip that is pointed to provide grab or hold within a wooden window frame. In a preferred embodiment, at least four aperture 424 are drilled in window frame 401 and at least four pins 425 are then inserted within the apertures 424 to secure mountable cover 400'. Accordingly, when placed over the skylight, the mounting cover sits on top of the pins.

Figure 4B:
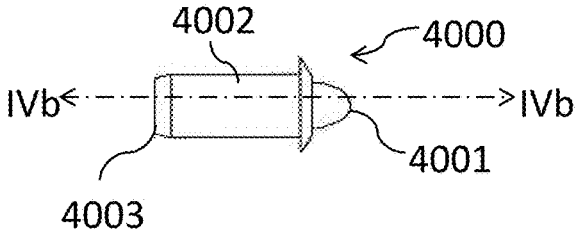
FIG. 4*b* illustrates a plan view of an embodiment of the fastening mechanism wherein the mechanism is a push-fit plunger or spring pin.
Figure 4C:
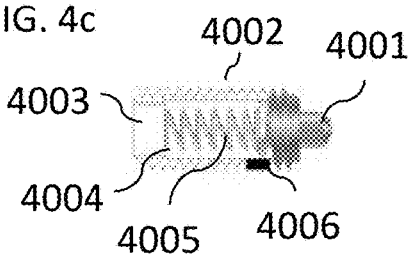
FIG. 4*c* illustrates a cross-sectional view of FIG. 4*b* taken at IVb-IVb.

FIG. 4*b* illustrate view of an embodiment of the fastening mechanism wherein the mechanism is a push-fit plunger or spring pin. FIG. 4*b* shows a plane view; FIG. 4*c* illustrates a cross-sectional view of FIG. 4*b* taken at IVb-Ivb. Pin 4000 includes a head 4001 spring loaded on a main body portion 4002 with an end 4003. Within main body portion 4002 is a cavity 4004 with a spring 4005 therein that pushes head 4001 forward when force is removed and allows a portion of head 4001 to enter into the cavity 4004 to cause the pin or plunger to lesson in length. A locking mechanism 4006 may also be provided.

Figure 5A:
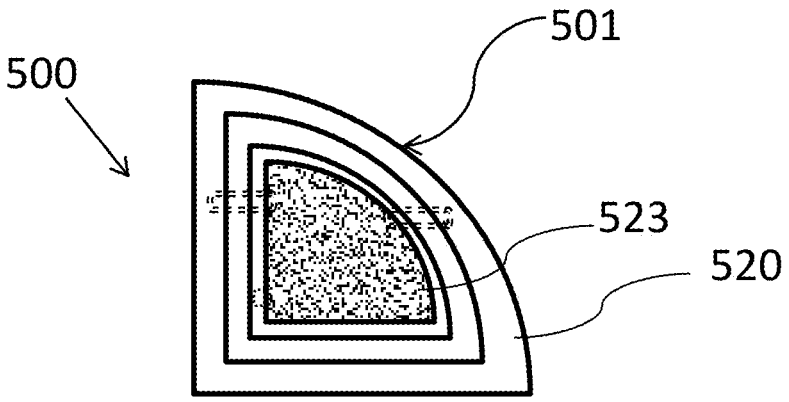
FIG. 5*a* illustrates a top plan view of an embodiment of the mountable cover.

FIG. 5*a* illustrates a top plan view of an embodiment of the mountable cover, shown generally at 500. In this embodiment, the mounting cover 501 is constructed having a quarter pie shape to address a particular window construct. The mounting cover 501 is shown as a rectangular frame assembly 521 with the panel 523 integrated therein. The figure illustrates an example of the plethora of shapes and configurations that the mountable cover can be formed as.

Figure 5B:
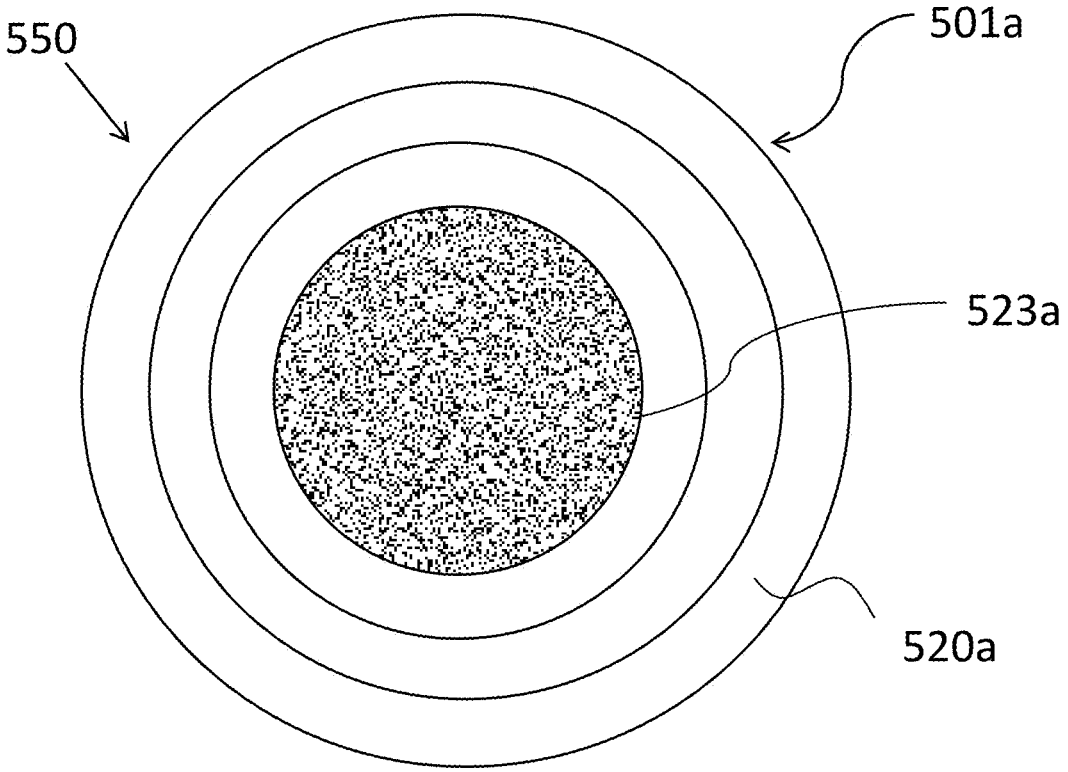
FIG. 5*b* illustrates a top plan view of an embodiment of the mountable cover.

FIG. 5*b* illustrates a top plan view of an embodiment of the mountable cover, shown generally at 550. In this embodiment, the mounting cover 501*a* is constructed having a quarter pie shape to address a particular window construct. The mounting cover 501*a* is shown as a rectangular frame assembly 521*a* with the panel 523*a* integrated therein. The figure illustrates an example of the plethora of shapes and configurations that the mountable cover can be formed as.

Figure 6:
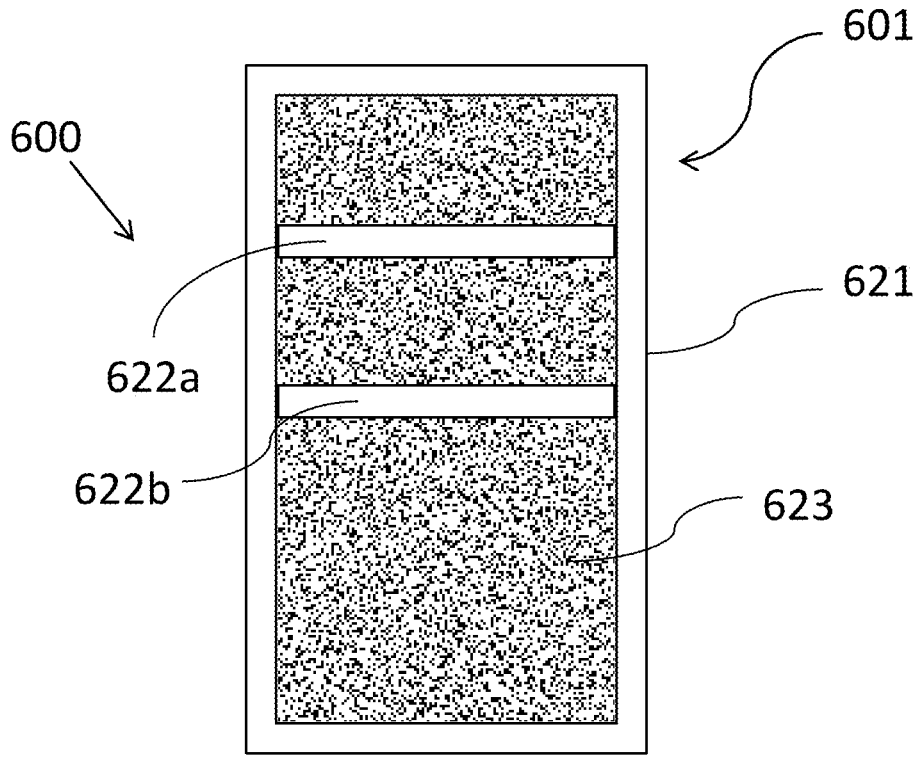
FIG. 6 illustrates a top plan view of an alternate embodiment of the mountable cover.

FIG. 6 illustrates a top plan view of an embodiment of the mountable cover, showing cover assembly 621 with the panel 623 integrated therein. The frame assembly 621 is shown having cross-bars 622*a*, 622*b* placed to provide both style and to provide structural support and strength to the mounting cover 601. These cross-bars 622*a*, 622*b* are preferably made of a light-weight material, providing light-weight support and/or decorative features.

Figure 7:
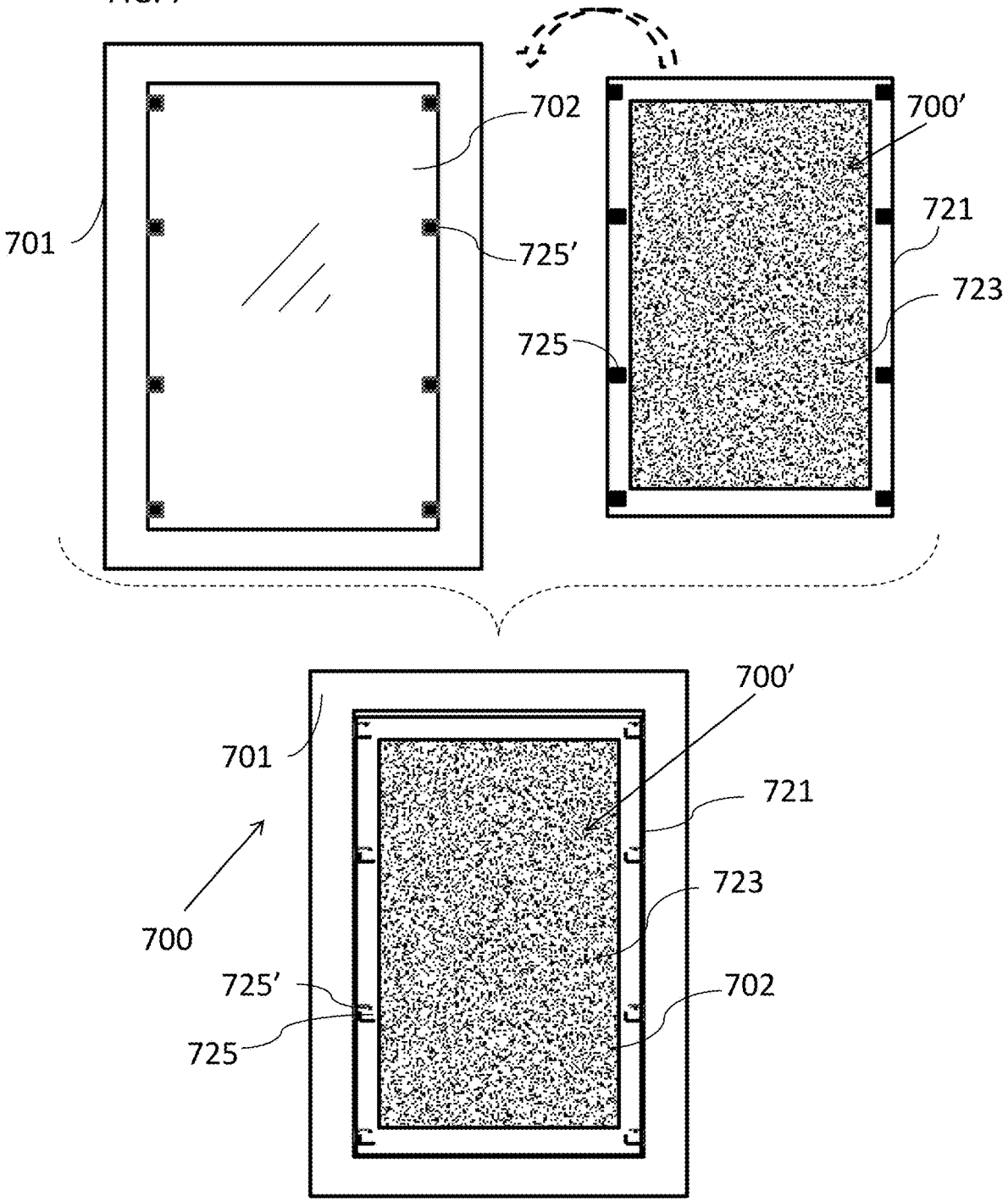
FIG. 7 illustrates a top plan view of an alternate embodiment of the mountable cover, showing an option for the fastening mechanism to mount the cover within the stationary glass/glazing panels of a window, wherein fastening mechanism is provided as hook and loop fasteners.
Figure 8:
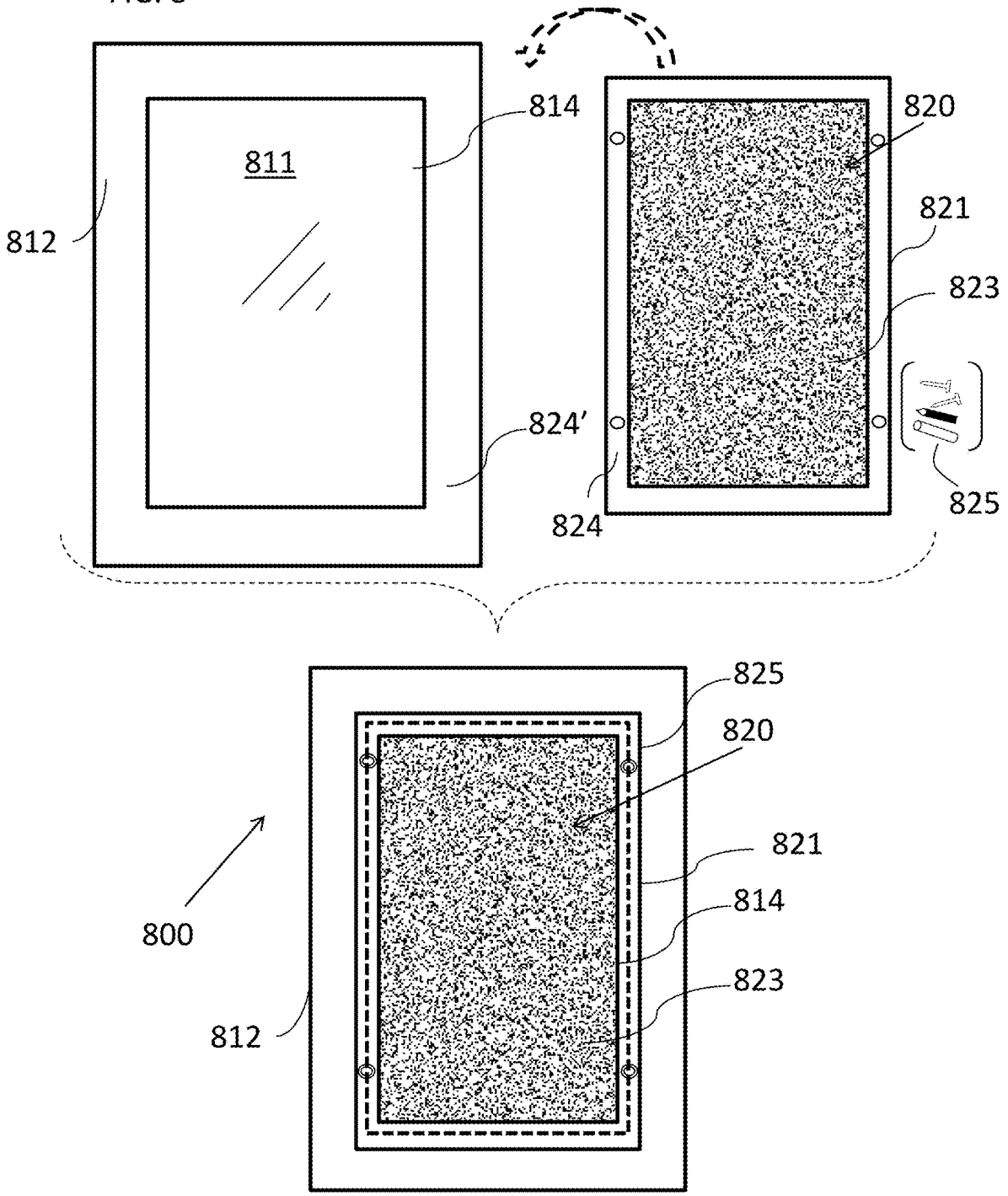
FIG. 8 illustrates a top plan view of an alternate embodiment of the mountable cover, showing an option for the fastening mechanism to mount the cover on the stationary glass/glazing panel on the window, wherein fastening mechanism are provided as apertures or drilled holes receiving a pin.
Figure 9:
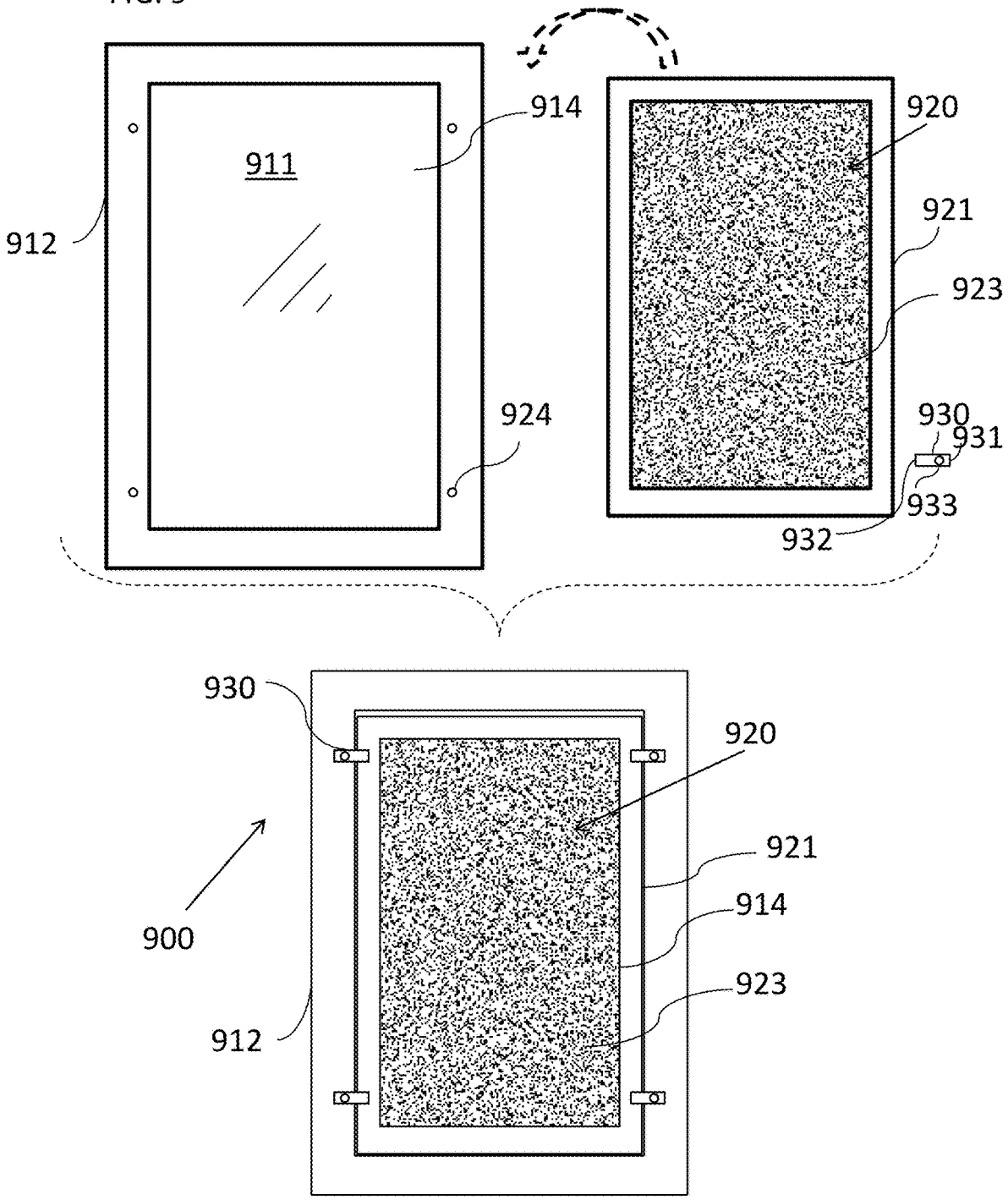
FIG. 9 illustrates a top plan view of an alternate embodiment of the mountable cover, showing an option for the fastening mechanism to mount the cover within the stationary glass/glazing panel on the window, wherein fastening mechanism is provided as a pin and a flat bracket.

FIGS. 7-9 illustrate various constructions of the fastening mechanism for the subject mountable cover.

FIG. 7 illustrates a top plan view of an alternate embodiment of the mountable cover, showing an option for the fastening mechanism to mount the cover within the stationary window or mounting the cover directly to any glass/glazing panes, shown generally at 700. Fastening mechanism 700 is provided, which preferably includes mating hook and loop fasteners such as those commonly sold under the trade name Velcro or other adhering materials such as Gripeez. Most preferably, the fastening mechanism is a magnet 725 with an adhesive backing that attaches to the back face of the mounting cover's frame and plate 725' with an adhesive backing that attaches to the front face of either the glass of the window (interior face of the window as shown) or on the front face of the window's sash frame. Wherein the plate 725' is attached to the front face of the glass of the window, as shown, the mounting cover sits within the window's sash with the side walls perpendicular to the front and back walls of the mounting frame abutting the shallow perpendicular side walls of the window sash (perpendicular to the window glass). Mountable cover 700' is inserted into window frame 701 with window 702 therein. Magnet fasteners 725 are adhered to the frame of the mounting cover and metal plates 725' are mounted onto the glass of the window 702.

Magnets and plates 725, 725' are constructed as thin discrete portions in a plethora of shapes, including for non-limiting example rectangles, squares or circles, and are formed having adhesive back surfaces and mating top surfaces. Adhesive back surfaces of the magnet and plate 725, 725' have a peel tab thereon which is removed so expose the adhesive back surface for adhering the magnet 725 and plate 725' to the mounting frame and the glass of the window 702, respectively. Herein, the plates 725' are shown adhered to the window glass/glazing panel itself, alternatively the plates 725' may be adhered to the window frame 701 abutting the window 702 or the window sash perpendicular to the glass of the window 702. Magnetic and plate fasteners 725, 725' are herein shown as small squares, alternatively they may be constructed as elongated strips corresponding to the shape of the window 702 upon which the cover 700' is to be mounted.

Mountable cover 700' is constructed having a mounting frame 721 with an insert panel 723 constructed as a blind, window cover, heat reflective material, and/or heat insulation material or decorative surface. Frame 721 includes mating magnetic fasteners 725 that mate with plates 725' on the window which correspond in construction, size, shape and orientation placement on the mounting frame 721 and on window 702. Once magnets and plates 725, 725' are adhered, alligned and placed on the window 702 and frame 721 of mountable cover 700' the fasteners are engaged so that the cover 700' is secured over window 702. It is noted that the plates 725' are not magnetic but are made of a mating metal material because if the plates are also magnetic, the magnetic bond actually becomes too strong and the cover is difficult to remove, the cost increases, direct alignment of the magnetic charges is needed, and increased magnetic force can be dangerous for vulnerable people when placing the cover (for example, people with medical devices such as Pacemakers can be adversely affected by magnetic force).

FIG. 8 illustrates a top plan view of an alternate embodiment of the mountable cover, showing an option for the fastening mechanism to mount the cover on the stationary glass/glazing panels of the window, shown generally at 800. In the embodiment shown at 800 fastening mechanisms are provided as apertures or drilled holes 824 adapted to receive a pin/dowel/or low profile nail, shown generally at 825. Window 811 is constructed having a window sash frame 812 with molding and glass window 814. Window sash frame 812 is a shallow frame that directly abuts the window glass, and is housed within the frame of the window which has tracks that the window sash with glass move up-and-down on the vertical plane when the window is a double hung window. Mountable cover 820 is adapted to be inserted over window sash frame 812. Mountable cover 820 is constructed having a mounting frame 821 with an insert panel 823 constructed as a blind, window cover, heat reflective material, and/or heat insulation material. Mounting frame 821 includes apertures 824 drilled therein adapted to receive a pin/dowel/or low profile nail 825. Window sash frame 812 may include correspondingly located drilled holes 824' or wherein a low profile nail, generally 825, is used a pointed end of the nail can penetrate the wood of the window sash frame 812 and secure it without the need for a drilled hole. Pin/dowel/nail 825 is adapted to be received within and traverse aperture 824 and drilled holes 824' in window frame 812 to secure mountable cover 820 within window frame 812. Pin/dowel/nail 825 can be constructed having a variety of widths and lengths as discussed hereinabove. Apertures 824 are located on the front face of frame 821 extending to the back face of frame 821.

FIG. 9 illustrates a top plan view for a moveable window/door of an alternate embodiment of the mountable cover, showing an option for the fastening mechanism to mount the cover within the stationary or moveable glass/glazing panel, shown generally at 900. In the embodiment shown fastening mechanism are provided as a pin and a flat bracket. Window 911 is constructed having a window frame 912 with molding and window glass/glazing panel 914. Mountable cover 920 is adapted to be inserted within window frame 912. Mountable cover 920 is constructed having a mounting frame 921 with an insert panel 923 constructed as a blind, window cover, heat reflective material, and/or heat insulation material. Holes 920 are drilled within mountable covering 920 which receives a screw that traverses a screw opening or hole 933 in bracket member 930, herein shown as a rectangular bracket constructed having a first portion 931 and second portion 932. First portion 931 includes the apertures/screw hole 933 so that top portion 931 is tightened against the window frame 912 while second portion 932 acts as a shelf or support for mounting frame 921.

FIGS. 10*a*-10*e* illustrate views of the subject mountable cover inserted in a manner so that it can move within a movable glass or glazing panel. Such movable glass/glazing panel frames are contemplated, but non-limiting include: sliding glass doors, French doors, glass doors, double hung or casement windows, etc. Varying sizes of the subject mountable cover can be provided so as to fit onto a single glass/glazing panel or to fit within the abutting window frame. Preferably, the mountable cover is offered having a thin or shallow thickness or depth so that it sits substantially flush within the abutting window frame and so that the cover is lightweight.

Figure 10A:
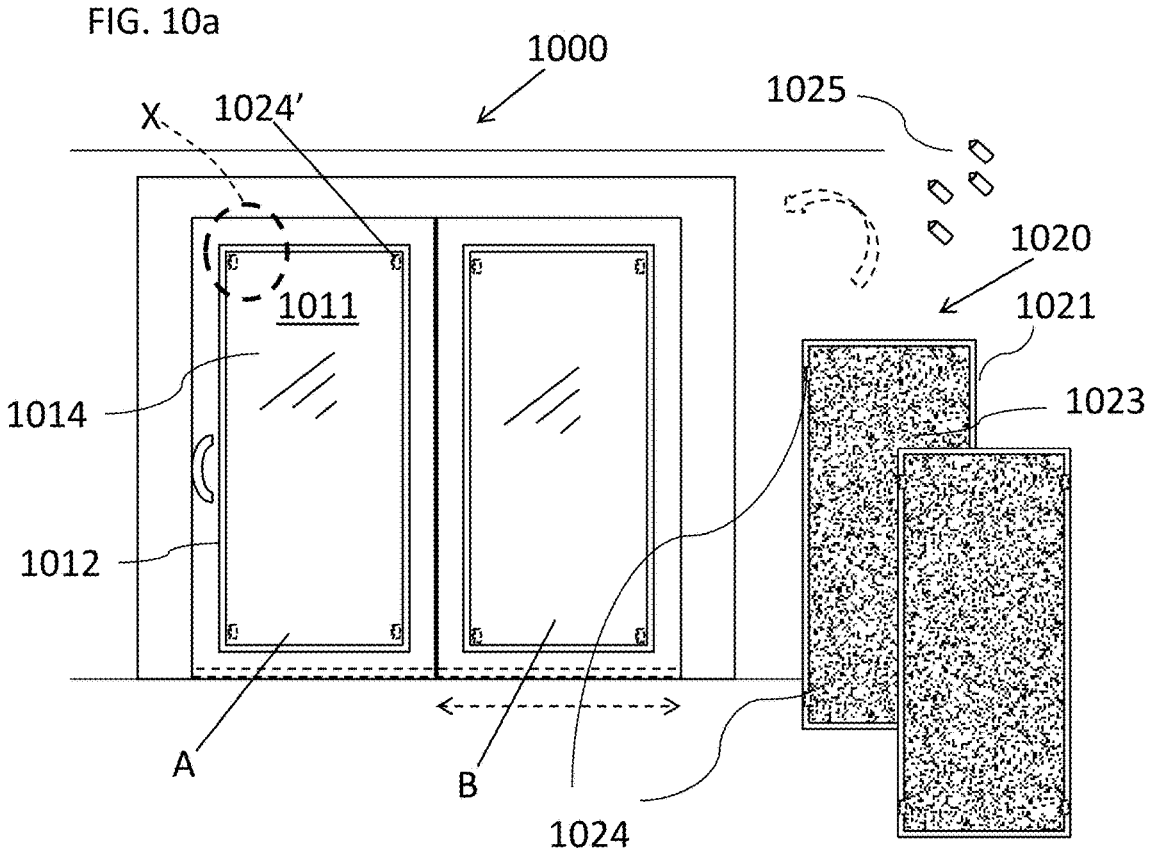
FIG. 10*a* illustrates a top plan view of an embodiment of the subject mountable cover, wherein the mountable cover is being mounted within a movable window frame structure, such as a sliding glass door.
Figure 10B:
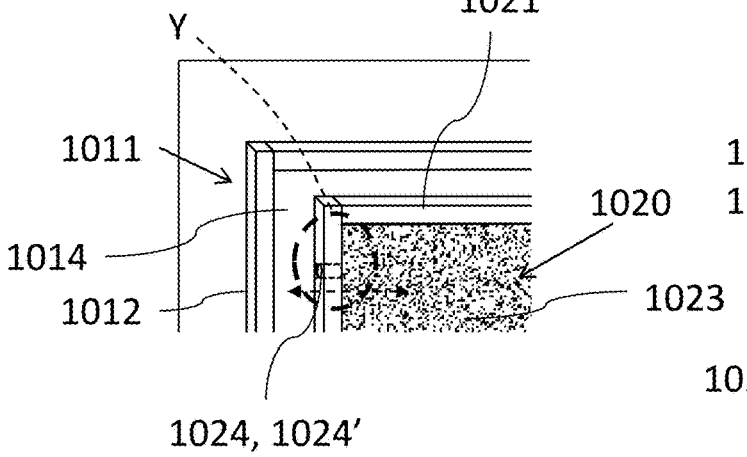
FIG. 10*b* illustrates a cross-sectional view taken at X in FIG. 10*a*, showing the mountable cover being mounted on a glass/glazing panel of the window frame structure/sliding glass door.
Figure 10C:
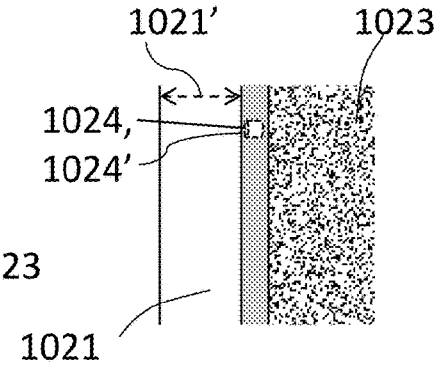
FIG. 10*c* illustrates a cross-sectional exploded side view of the mountable cover's frame taken at Y in FIG. 10*b;*
Figure 10D:
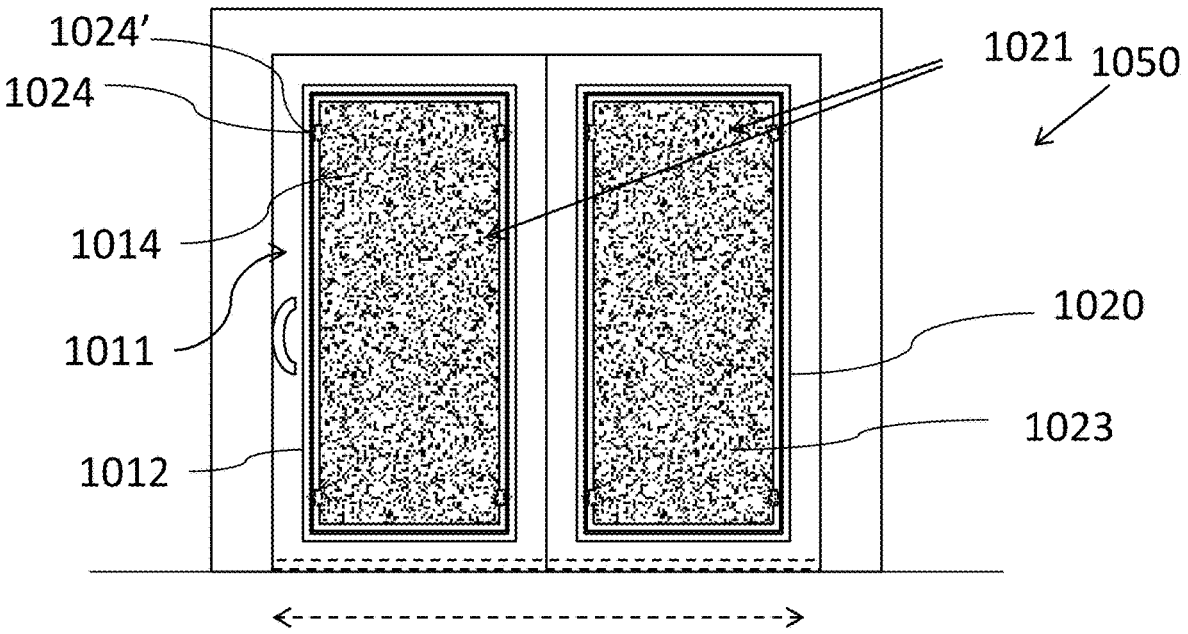
FIG. 10*d* illustrates a top plan view of the embodiment of FIG. 10*a* mounted within the movable glass/glazing panel of a window frame structure/sliding glass door with the doors in the closed configuration.

FIG. 10*a* illustrates a top plan view of an embodiment of the subject mountable cover, wherein the mountable cover is being mounted within a movable window frame structure, such as a sliding glass door, shown generally at 1000. FIG. 10*b* illustrates a cross-sectional view taken at X in FIG. 10*a*, showing the mountable cover being mounted window frame structure/sliding glass door. FIG. 10*c* illustrates a cross-sectional exploded side view of the mountable cover's frame taken at Yin FIG. 10*b*. FIG. 10*d* illustrates a top plan view of the embodiment of FIG. 10*a* mounted within the movable window frame structure/sliding glass door with the doors in the closed configuration, shown generally at 1050. Lastly, FIG. 10*e* illustrates a top plan view of the embodiment of FIG. 10*a* mounted within the movable window frame structure/sliding glass door with the sliding door slid to the open configuration, shown generally at 1055.

Referring to FIGS. 10*a*-10*e*, it is noted that in the embodiment shown fastening mechanism are provided as magnets with mating plates adhered to the mounting frame and glass of the door, respectively, however other fastening mechanism such as those described in detail herein may be implemented. Window 1011 is constructed as a sliding glass window structure with door A which is typically stationary and door B which slides parallel to door A along a track to open and rest upon or piggyback upon at least a portion of door A and sits next to door A when door B is closed. Each door has a window frame 1012 with molding via a sash that directly perpendicularly abuts with glass window 1014 and moves along with the window 1014. Frame 1012 is generally a shallow depth frame structure of roughly 1" to 3" in depth. It is noted that the metal mating plates are shown on the glass of the door so that the mounted cover is mounted flush within the window sash directly abutting and parallel the glass, but the plates can adhere to the front face of the sash of the door instead so that the mounted cover rests directly on the front face of the frame of the sash and is not directly on the glass but is parallel to the glass. The depth between doors A and B is typically narrow, so if the mounting cover is to remain on door A when door B moves over door A the mounting cover has a shallow depth, for example 11/46 inch depth. Otherwise, the mounting cover may be readily removed from door A when door B is open and piggybacked on door A, and readily replaced back on door A when door B is closed and no longer piggybacked on door A. It is noted that rather than magnets, other fastening methods as discussed herein may be used, such as apertures with pins/dowels/nails and/or flat brackets (see for example, FIG. 9).

Mountable cover 1020 is preferably adapted to be inserted within window frame 1012 mounted on the glass of the doors A, B. Mountable cover 1020 is constructed having a mounting frame 1021 with an insert panel 1023 constructed as a blind, window cover, heat reflective material, and/or heat insulation material. Mounting frame 1021 has a correspondingly shallow depth, generally having a shallow depth frame structure of roughly 0.1" to 3" inches in depth as shown at 1021' in FIG. 10*c*. Preferably, the frame has a frame width ranging from ½ inch to 5 inches wide; Mounting frame 1021 includes magnets 1024 mounted thereon via adhesive. Window frame 1012 correspondingly includes metal plates 1024' that are adhered via adhesive to the glass of the window. When the mounting frame 1021 is mounted, the magnets 1024 are aligned with the plates 1024' and magnetically fastened to the glass of the window frame 1012 of the doors A and B to adequately secure the cover 1020 on the glass of the doors A, B. Alternative fastening mechanisms, including the ones discussed herein, are also contemplated. For example, a bracket may be used adapted to receive a pin/low profile nail which may include a pointed tip for gripping the window frame 1012 (mounting the cover to the frame of the window rather than the window glass itself).

Figure 10E:
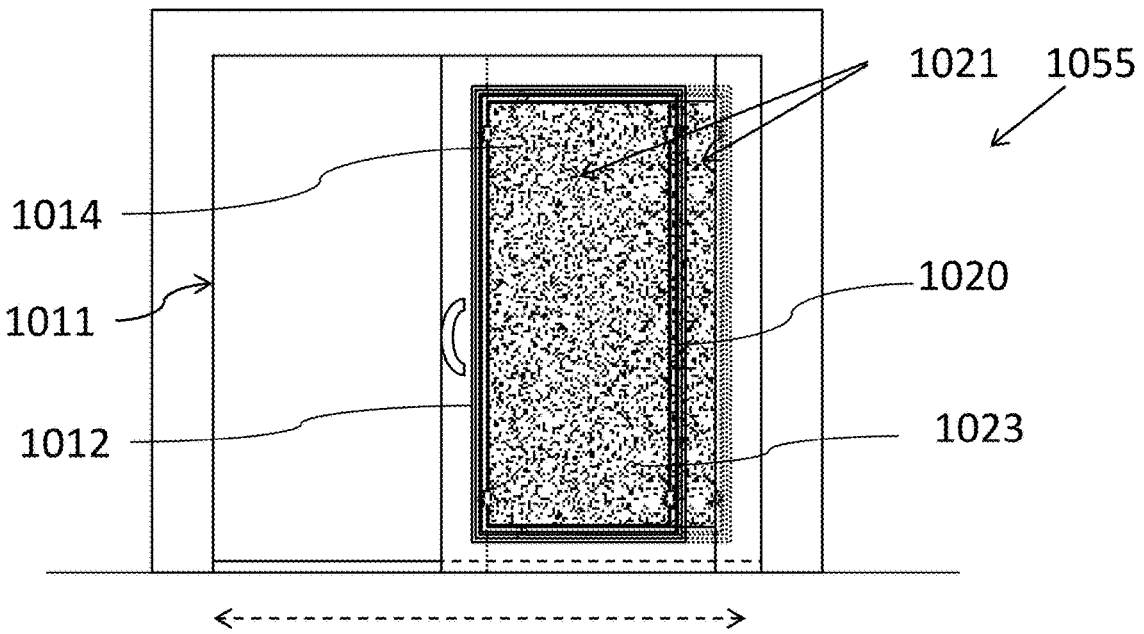
FIG. 10*e* illustrates a top plan view of the embodiment of FIG. 10*a* mounted within the movable glass/glazing panel of a window frame structure/sliding glass door with the sliding door slid to the open configuration.

As illustrated in FIG. 10*e*, as the cover 1020 is mounted within the movable window frame structure 1012 of the sliding glass door 1011 it moves on the movable door when the door us in the open configuration, shown generally at 1055. Due to the mounting frame's 1021 shallow depth, when the moving glass door is opened, it can still readily slide over the stationary door without interference of the mountable cover of the non-moving door window panel.

Figure 11A:
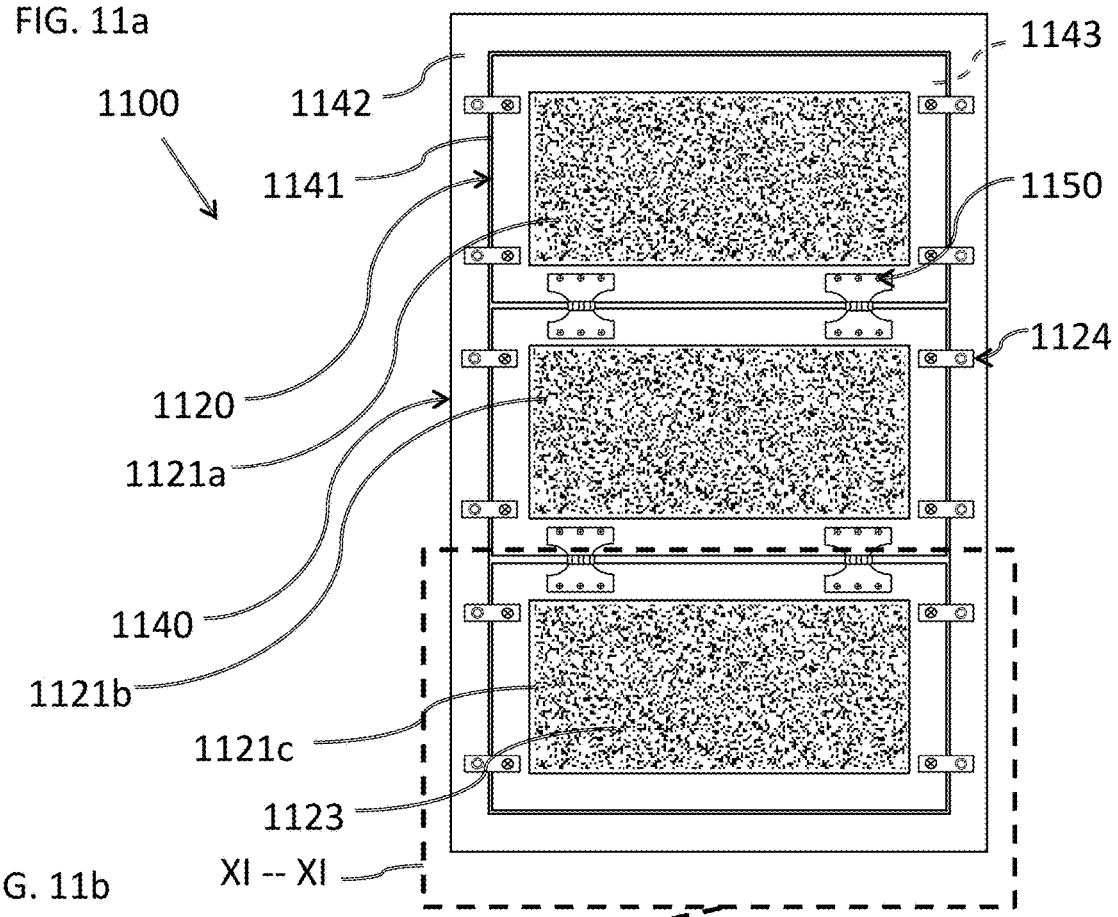
FIG. 11*a* illustrates a top plan view of an embodiment of the subject mountable cover, wherein the mountable cover is formed having a plurality of mounting frames specifically appointed for use for a large glass/glazing panel of a window or window within a door, and the mountable cover is shown mounted within a window frame structure, such as a double glass/glazing panel of a window or single pane glass/glazing panel of a window, or glass door window, skylight, large picture window, etc.
Figure 11B:
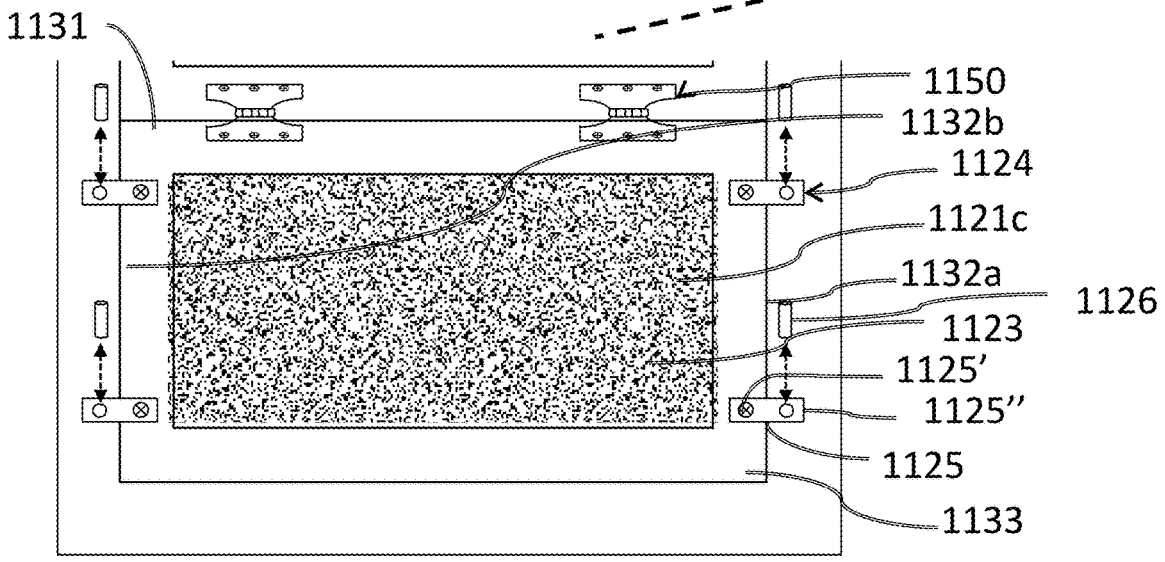
FIG. 11*b* illustrates a cross-sectional view of the mountable cover of FIG. 11*a*, taken along XI-XI, showing a close-up view of the mountable cover and fastening members wherein the fastening members comprise a tab.

FIG. 11 illustrates a top plan view of an embodiment of the subject mountable cover, shown at 1100. In the embodiment shown at 1100, the mountable cover 1120 is formed having a plurality of mounting frames mounted within a window/glass frame structure 1140, specifically appointed for use for a large window or window within a door. Mountable cover 1120 is adapted to be removably and easily inserted into window/glass frame structure 1140 constructed as a typical window structure having a window frame 1141, molding 1142 and glass 1143. Mountable cover 1120 is adapted to be inserted within window frame 1141 to sit flush therein. Mountable cover 1120 is constructed having a plurality of mounting frames, herein shown as three mounting frames, 1121*a*, 1121*b*, 1121*c*. Each mounting frames 1121*a*, 1121*b*, 1121*c* have a top wall 1131, side walls 1132*a*, 1132*b* and a bottom wall 1133. At least one panel 1123 is located within each of the mounting frames 1121*a*, 1121*b*, 1121*c*. Panels 1123 comprise a material adapted to block at least a portion of light external to and traversing the window 1140, and is adapted sit parallel to said window 1140.

Figure 19:
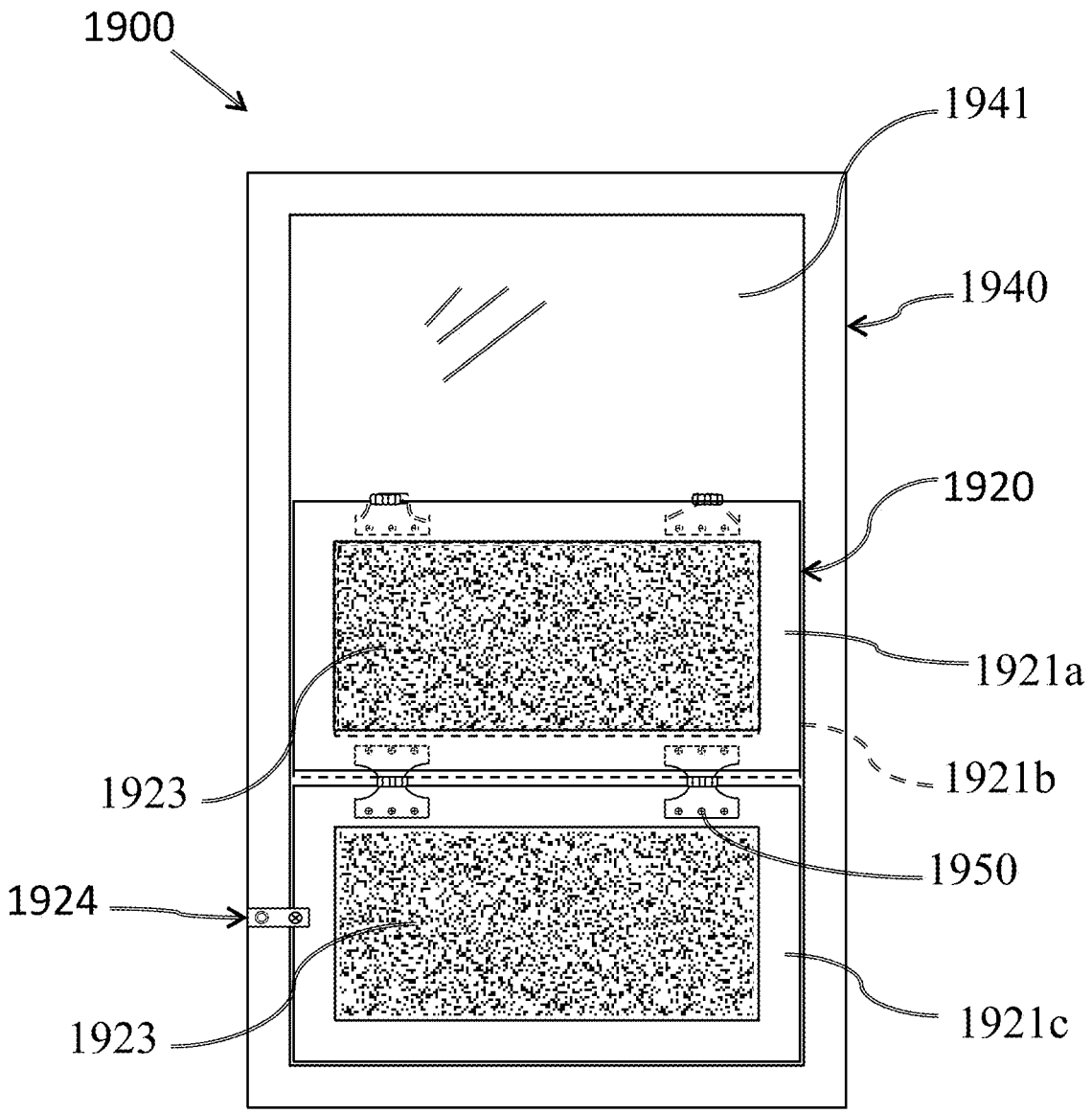
FIG. 19 illustrates a top plan view of an embodiment of the subject mountable cover, wherein the mountable cover is formed having a plurality of mounting frames, and the mountable cover is shown mounted within a window frame structure, a glass/glazing panel for a door window, skylight, large picture window, etc., and one of the panels is folded down to allow light into at least the top portion of the window.

The plurality of mounting frames 1121*a*, 1121*b*, 1121*c* are joined together by way of at least one adjoining member 1150. In the embodiment shown, the adjoining member 1150 is a hinge, and there are preferably at least two hinges located on each of the frames 1121*a*, 1121*b*, 1121*c*. Adjoining member 1150 via hinges allows the mounting frames 1121*a*, 1121*b*, 1121*c* to be folded upon one another for compact storage when not in use. It also allows the ability to have at least one of the panels open/folded down to allow light into at least a portion of the window, as shown in FIG. 19. Adjoining members 1150 are shown as hinges in this embodiment, it is noted that the adjoining members 1150 may be different connecting hardware, such as that shown in FIG. 12*a-c*.

At least one fastening mechanism 1124 is appointed to engage with the window/glass frame structure 1140 for mounting and removing the mounting frame 1120 from the window. In the embodiment shown, the fastening mechanism 1124 is constructed of a tab 1125 having a first end 1125' and a second end 1125" each having a tab aperture integrated therein. In turn, at least one wall, herein shown as the side walls 1132*a*, 1132*b* of mounting frames 1121*a*, 1121*b*, 1121*c* includes at least one aperture drilled therein each adapted to receive pins 1126 traversing through first end 1125' and second end 1125" of tab 1125, respectively, as shown. Preferably, the aperture is located near an edge of side walls 1132*a*, 1132*b* so that the tabs 1125 are low profile. Pins 1126 can be constructed having a variety of widths and lengths and can have a flat top or a pointed top for abutting the window frame for securement. Mounting frames 1121*a*, 1121*b*, 1121*c* can be composed of a plethora of materials, including wood materials that correspond to typical wood colors/plastic colors utilized for current window frames.

Figure 12A:
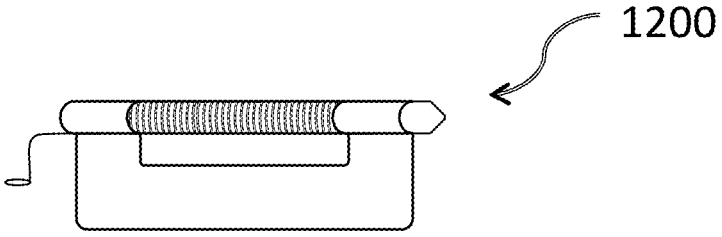
FIG. 12*a* illustrates a top plan view of another embodiment of an adjoining member/connecting hardware, wherein the adjoining member is a latch that may be used to adjoin the plurality of mountable covers together.
Figure 12B:
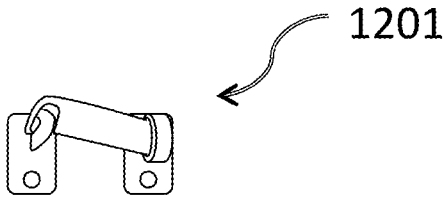
FIG. 12*b* illustrates a top plan view of another embodiment of an adjoining member/connecting hardware, wherein the adjoining member is a hook latch that may be used to adjoin the plurality of mountable covers together.
Figure 12C:
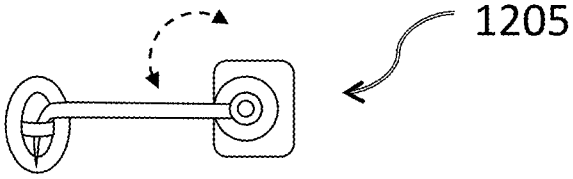
FIG. 12*c* illustrates a top plan view of another embodiment of an adjoining member/connecting hardware, wherein the adjoining member is a hook latch that may be used to adjoin the plurality of mountable covers together.

FIG. 12*a* illustrates a top plan view of another embodiment of an adjoining member/connecting hardware, wherein the adjoining member is a latch 1200 that may be used to adjoin the plurality of mountable covers together. FIG. 12*b* illustrates a top plan view of another embodiment of an adjoining member/connecting hardware, wherein the adjoining member is a hook latch 1201 that may be used to adjoin the plurality of mountable covers together. FIG. 12*c* illustrates a top plan view of another embodiment of an adjoining member/connecting hardware, wherein the adjoining member is a hook latch 1205 that may be used to adjoin the plurality of mountable covers together.

Figure 13:
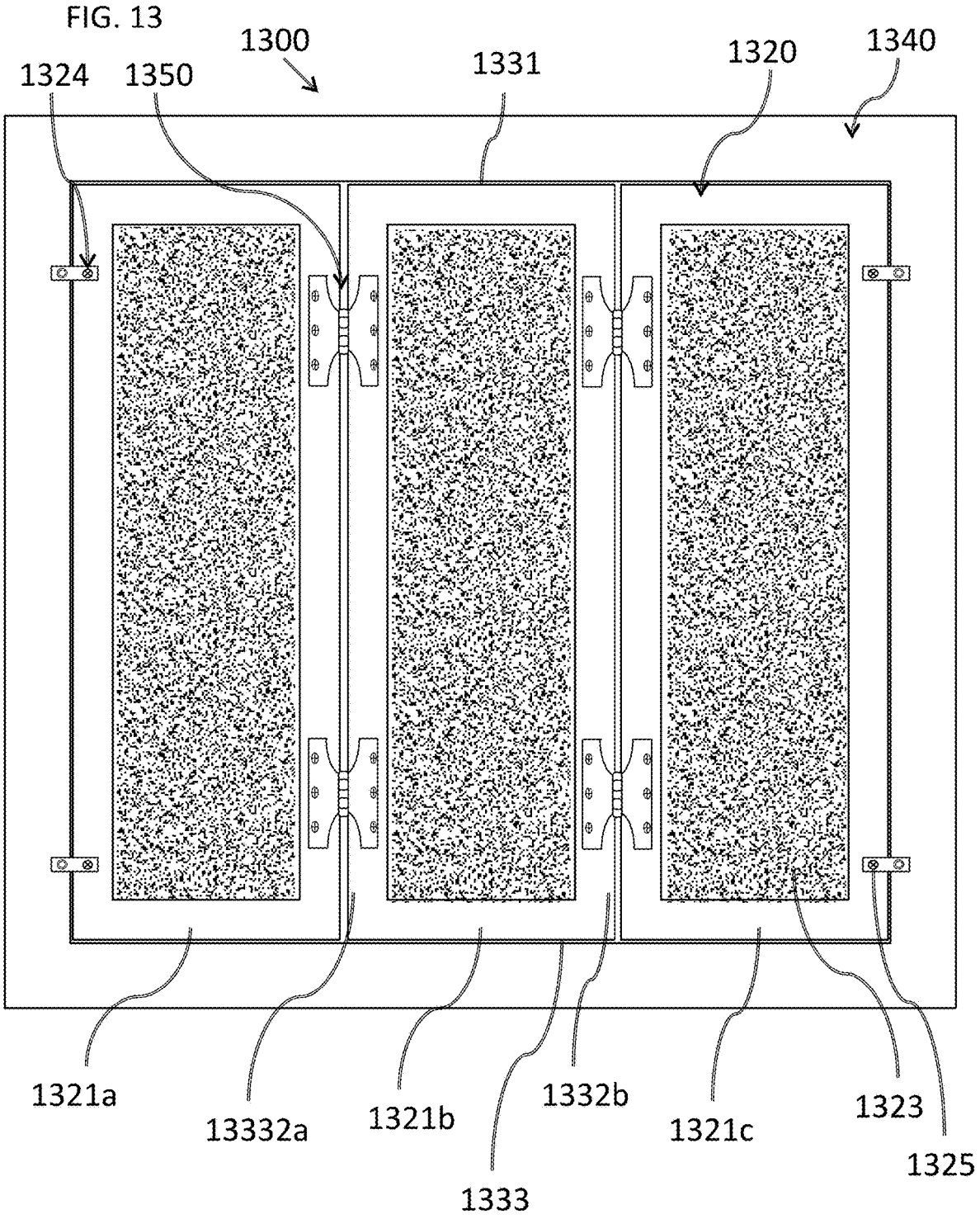
FIG. 13 illustrates a top plan view of an embodiment of the subject mountable cover, wherein the mountable cover is formed having a plurality of mounting frames, and the mountable cover is shown mounted within a large glass/glazing panel on the window frame structure, such as a picture window, etc.

FIG. 13 illustrates a top plan view of an embodiment of the subject mountable cover, shown at 1300. The mountable cover 1320 is formed having a plurality of mounting frames 1321*a*, 1321*b*, 1321*c* each having a top wall 1331, side walls 1332*a*, 1332*b* and a bottom wall 1333. In the embodiment shown, the mountable cover 1320 is mounted within a large window frame structure, such as a picture window, etc. At least one panel 1323 is located within each of the mounting frames 1321*a*, 1321*b*, 1321*c*. Panels 1323 comprise a material adapted to block at least a portion of light external to and traversing the window glass structure 1340, adapted sit parallel to said window 1340. Mounting frames 1321*a*, 1321*b*, 1321*c* are joined together by way of at least one adjoining member 1350. In the embodiment shown, the adjoining member 1350 is a hinge, and there are preferably at least two hinges located on each of the frames 1321*a*, 1321*b*, 1321*c*. Adjoining member 1350 via hinges allow the mounting frames 1321*a*, 1321*b*, 1321*c* to be folded upon one another for compact storage when not in use. It also allows the ability to have at least one of the panels open/folded vertically to allow light into at least a portion of the window. At least one fastening mechanism 1324 is appointed to engage with the window frame structure 1340 for mounting and removing the mounting frame 1320 from the window. In the embodiment shown, the fastening mechanisms 1324 are constructed of tabs 1325 as discussed hereinabove regarding FIG. 11*a*-11*b*.

Figure 14A:
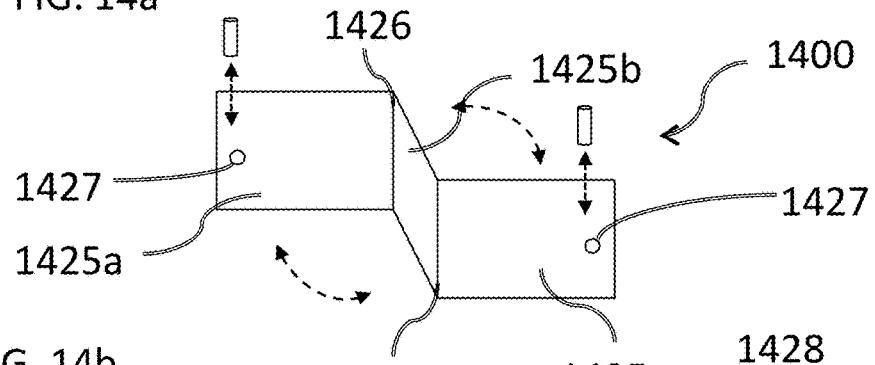
FIG. 14*a* illustrates a top plan view of an embodiment of a fastening mechanism wherein the fastening mechanism comprises a tri-fold spacer with at least one aperture appointed for receiving a pin, said tri-fold spacer comprising a first, second and third mini-spacer section, and wherein the tri-fold spacer is shown in a "Z-configuration"
Figure 14B:
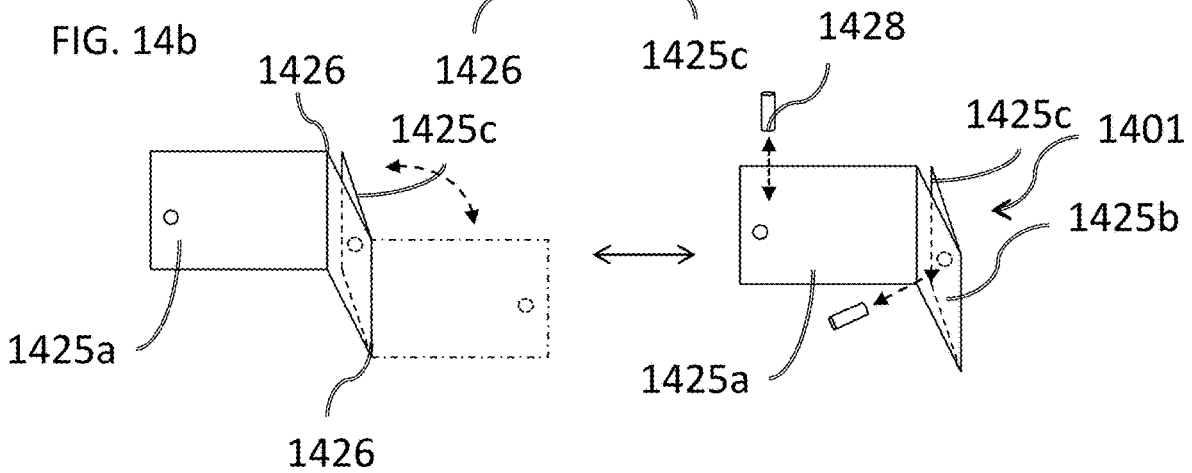
FIG. 14*b* illustrates a top plan view of the fastening mechanism of FIG. 14*a*, wherein the third mini-spacer section is folded back forming an "L-configuration"
Figure 14C:
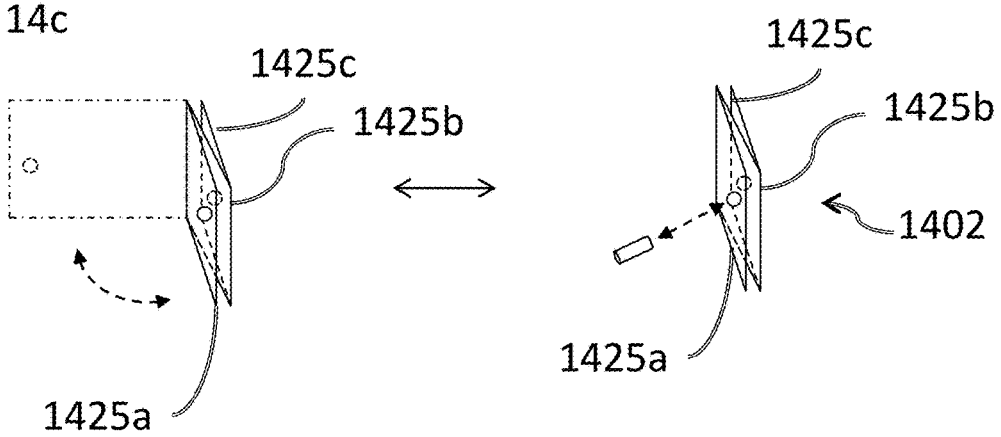
FIG. 14*c* illustrates a top plan view of the fastening mechanism of FIGS. 14*a* and 14*b*, wherein the first mini-spacer section is folded forward and the third mini-spacer section is folded back forming a "I-configuration"

FIG. 14*a* illustrates a top plan view of an embodiment of a fastening mechanism wherein the fastening mechanism comprises a tri-fold spacer, in a "Z-configuration," shown generally at 1400. FIG. 14*b* illustrates a top plan view of the fastening mechanism of FIG. 14*a*, wherein the third mini-spacer section is folded back forming an "L-configuration," shown generally at 1401. FIG. 14*c* illustrates a top plan view of the fastening mechanism of FIGS. 14*a* and 14*b*, wherein the first mini-spacer section is folded forward and the third mini-spacer section is folded back forming an "I-configuration," shown generally at 1402.

Regarding FIGS. 14*a*-14*c*, a fastening mechanism 1424 is shown formed as a tri-fold spacer having a first, second and third mini-spacer section, 1425*a*, 1425*b*, 1425*c*, divided by folding seams 1426. In FIG. 14*a*, the tri-fold spacer is shown in a "Z-configuration" at 1400. In FIG. 14*b*, the third mini-spacer section 1425*c* is folded back forming an "L-configuration," shown generally at 1401. In FIG. 14*c*, the first mini-spacer section 1425*a* is folded forward and the third mini-spacer section 1425*c* is folded back forming an "I-configuration," shown generally at 1402. An aperture 1427 is integrated within each of the first and third mini-spacer sections, 1425*a* and 1425*c*, respectively. Aperture 1427 is appointed to receive a pin 1428 (or nail, tack, or screw portion) for securing a mounting frame of the subject invention into a window frame as shown in detail in FIGS. 15-19.

Figure 15A:
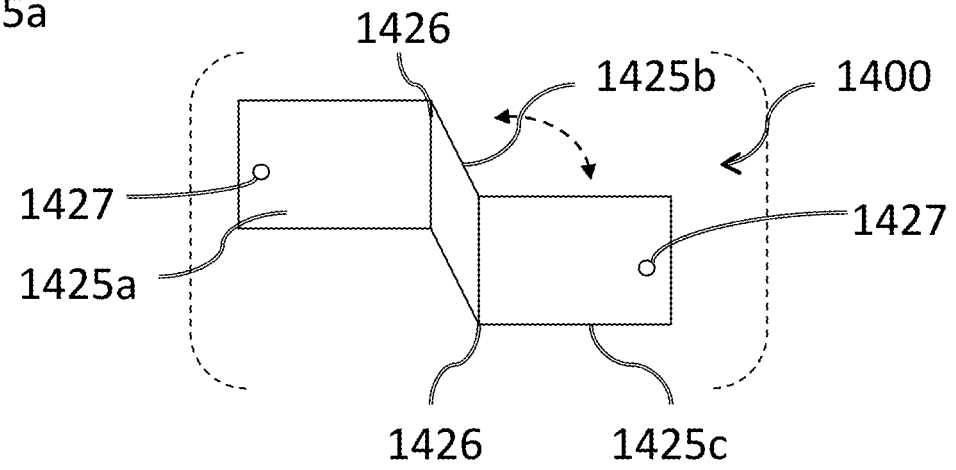
FIG. 15*a* illustrates a top plan view of the fastening mechanism embodiment of FIG. 14*a*, showing the "Z-configuration" prior to placement of pins.
Figure 15B:
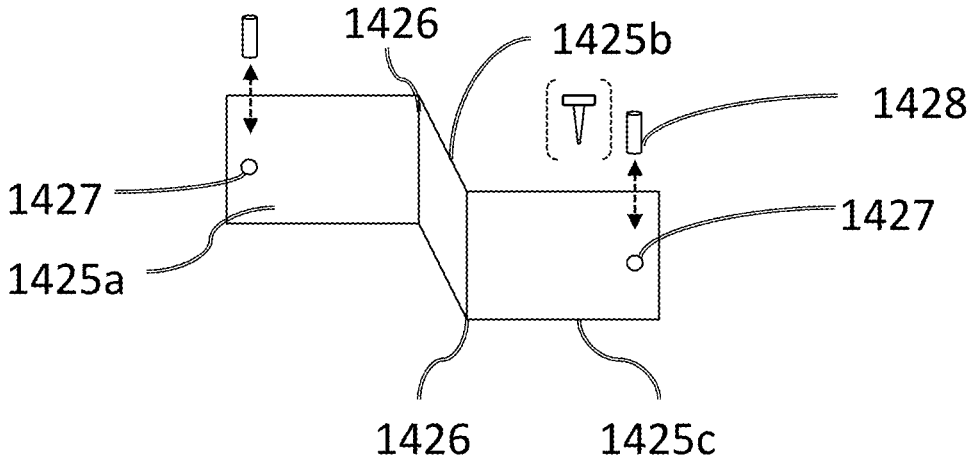
FIG. 15*b* illustrates a top plan view of the fastening mechanism embodiment of FIG. 14*a*, showing the "Z-configuration" with the pins being placed.
Figure 15C:
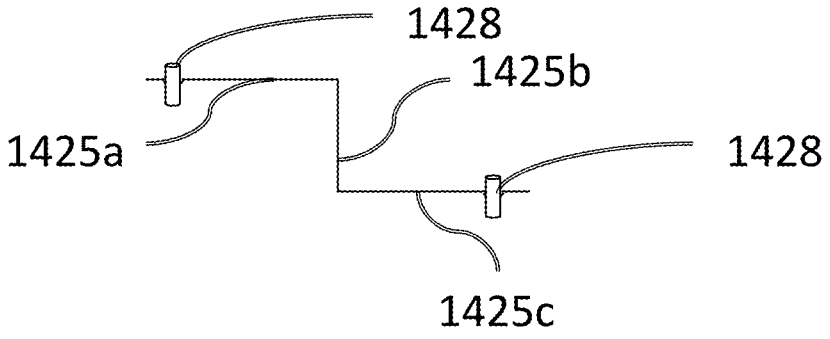
FIG. 15*c* illustrates a top wall view of the fastening mechanism embodiment of FIG. 14*a*, showing the "Z-configuration" with the pins inserted.

FIG. 15*a* illustrates a top plan view of the fastening mechanism embodiment of FIG. 14*a*, showing the "Z-configuration" 1400 prior to placement of pins. FIG. 15*b* illustrates a top plan view of the fastening mechanism embodiment of FIG. 14*a*, showing the "Z-configuration" 1400 with the pins 1428 being placed. FIG. 15*c* illustrates a top wall view of the fastening mechanism embodiment of FIG. 14*a*, showing the "Z-configuration" 1400 with the pins 1428 inserted.

Figure 16A:
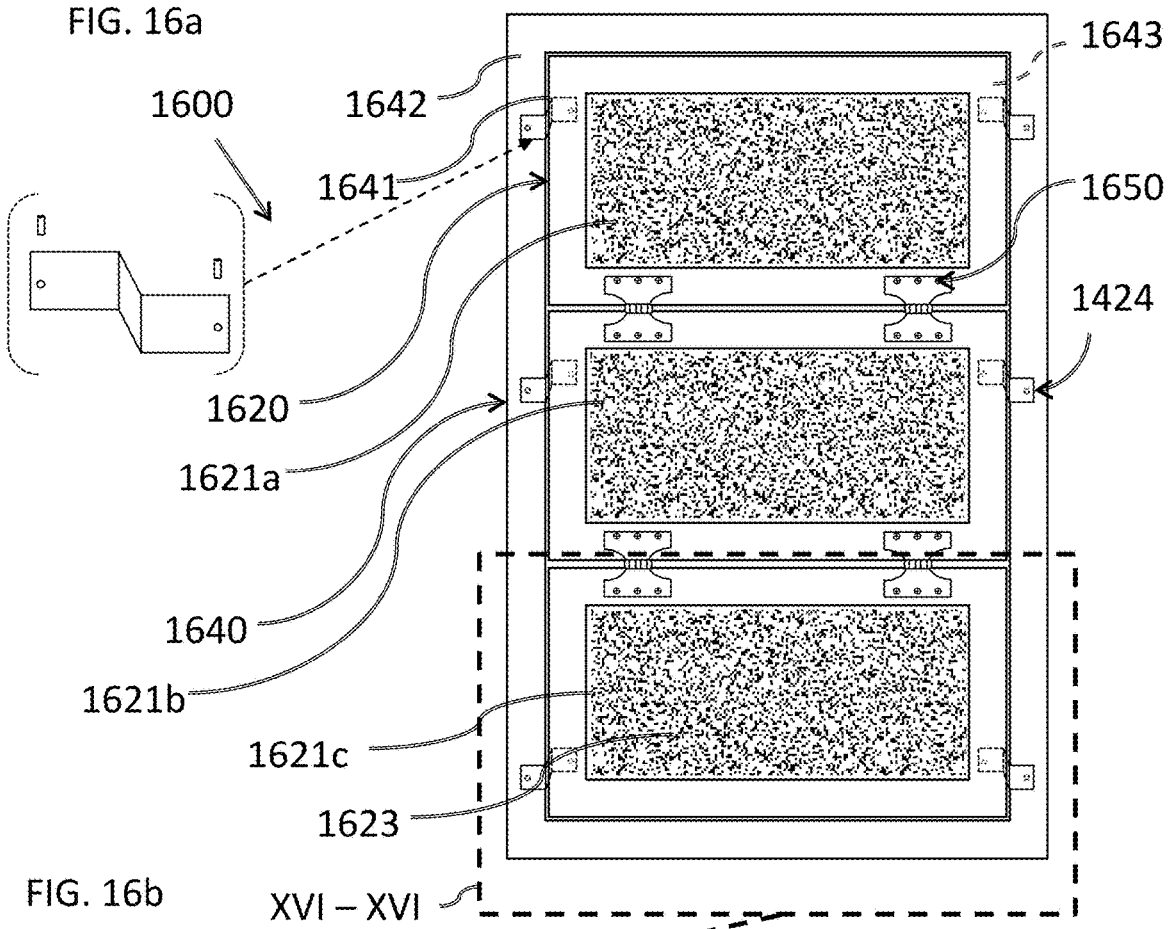
FIG. 16*a* illustrates a top plan view of an embodiment of the subject mountable cover, wherein the mountable cover is formed having a plurality of mounting frames, and the mountable cover is shown mounted within a window frame structure, such as a glass/glazing panel of a door window, skylight, large picture window, etc.
Figure 16B:
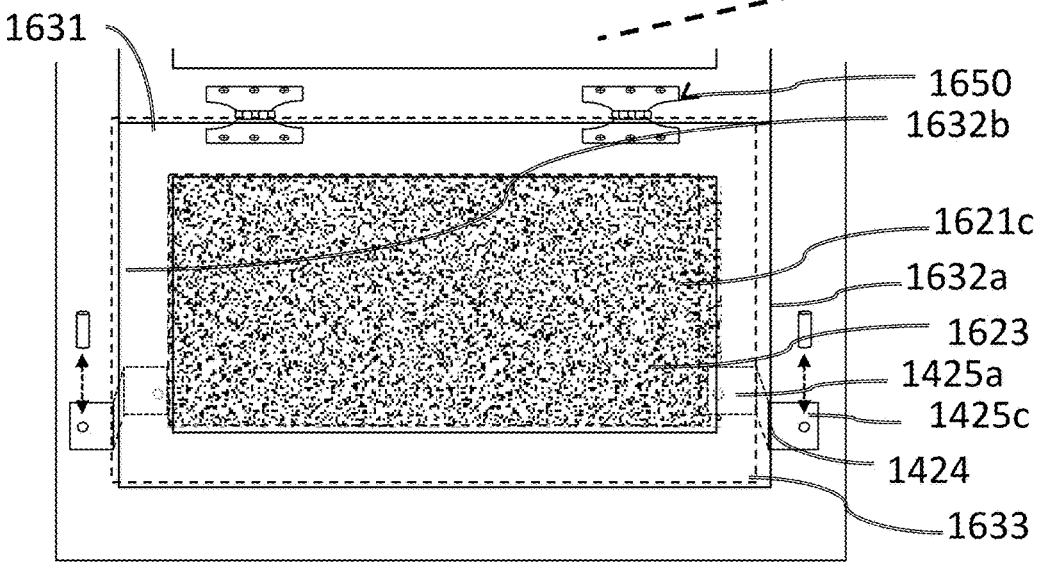
FIG. 16*b* illustrates a cross-sectional view of the mountable cover of FIG. 16*a*, taken along XVI-XVI, showing a close-up view of the mountable cover and fastening members wherein the fastening members are configured as the fastening mechanism embodiment of FIG. 14*a*, the "Z-configuration"

FIG. 16*a* illustrates a top plan view of an embodiment of the subject mountable cover, wherein the mountable cover is formed having a plurality of mounting frames, and the mountable cover is shown mounted within a window frame structure, such as a glass door window, skylight, large picture window, etc., shown generally at 1600. FIG. 16*b* illustrates a cross-sectional view of the mountable cover of FIG. 16*a*, taken along XVI-XVI, showing a close-up view of the mountable cover and fastening members wherein the fastening members are configured as the fastening mechanism embodiment of FIG. 14*a*, the "Z-configuration".

Regarding FIGS. 16*a*-16*b*, the mountable cover 1620 is formed having a plurality of mounting frames 1621*a*, 1621*b*, 1621*c* each having a top wall 1631, side walls 1632*a*, 1632*b* and a bottom wall 1633. In the embodiment shown, the mountable cover 1620 is mounted within a window frame structure 1640. At least one panel 1623 is located within each of the mounting frames 1621*a*, 1621*b*, 1621*c*. Panels 1623 comprise a material adapted to block at least a portion of light external to and traversing the window 1640, adapted sit parallel to said window 1640. Mounting frames 1621*a*, 1621*b*, 1621*c* are joined together by way of at least one adjoining member 1650. In the embodiment shown, the adjoining member 1650 is a hinge, and there are preferably at least two hinges located on each of the frames 1621*a*, 1621*b*, 1621*c*. Adjoining member 1650 via hinges allow the mounting frames 1621*a*, 1621*b*, 1621*c* to be folded upon one another for compact storage when not in use. It also allows the ability to have at least one of the panels open/folded vertically to allow light into at least a portion of the window (see for example, FIG. 19).

At least one fastening mechanism 1424 is appointed to engage with the window frame structure 1640 for mounting and removing the mounting frame 1620 from the window/glass. In the embodiment shown, the fastening mechanisms 1424 are constructed as the tri-fold spacer of FIGS. 14*a*-14*c*. The tri-fold spacer is in its "Z-configuration" 1400 of FIG. 14*a*. The first mini-spacer section, 1425*a* is attached via a pin through an aperture in the back/rear of a side wall of each mounting frame. The second mini-spacer section 1425*b* abuts and is adjacent to the side wall of the mounting frame and window frame. The third mini-spacer section 1425*c* is placed on top of a portion of the window frame and another pin (screw etc.) is placed through its aperture for securing the mounting frame in the window.

Figure 17A:
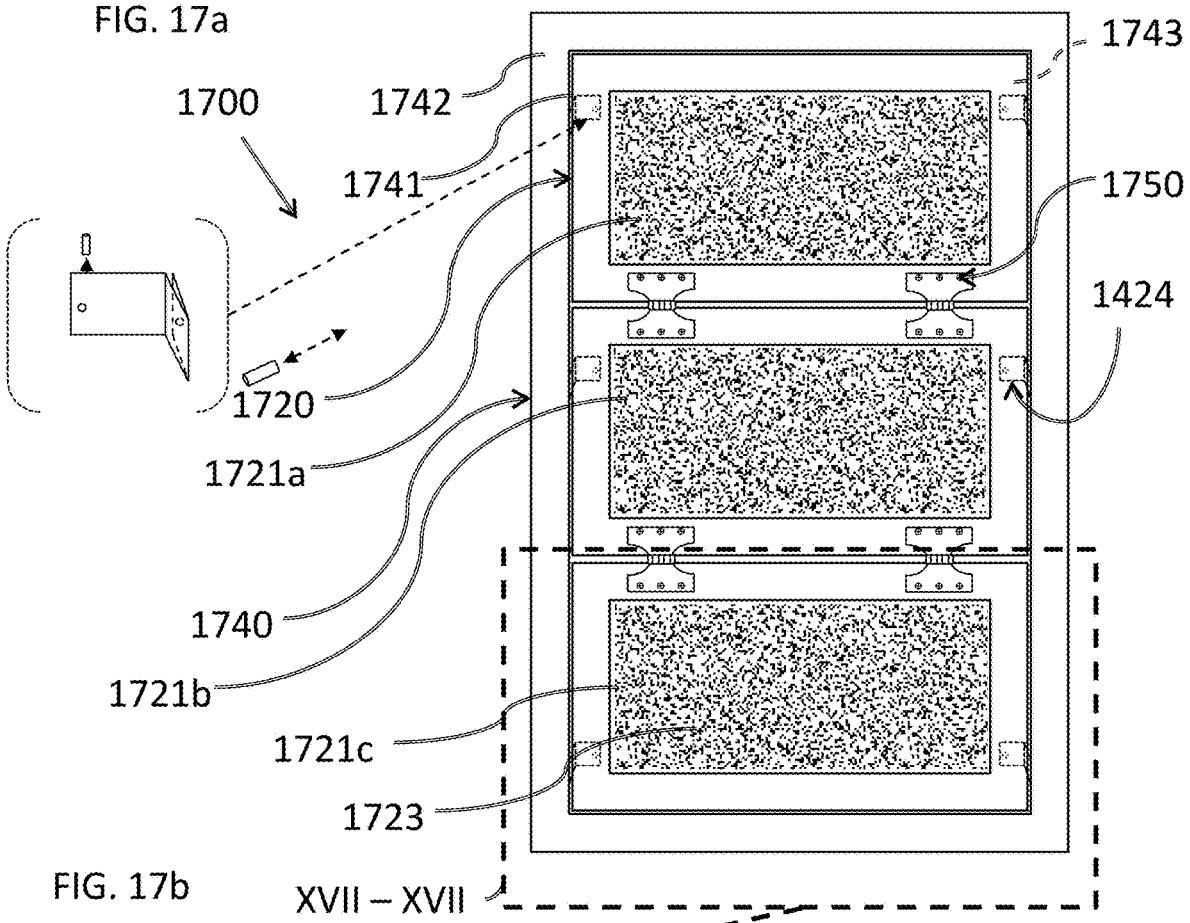
FIG. 17*a* illustrates a top plan view of an embodiment of the subject mountable cover, wherein the mountable cover is formed having a plurality of mounting frames, and the mountable cover is shown mounted within a window frame structure, such as a glass/glazing panel of a door, window, skylight, large picture window, etc.
Figure 17B:
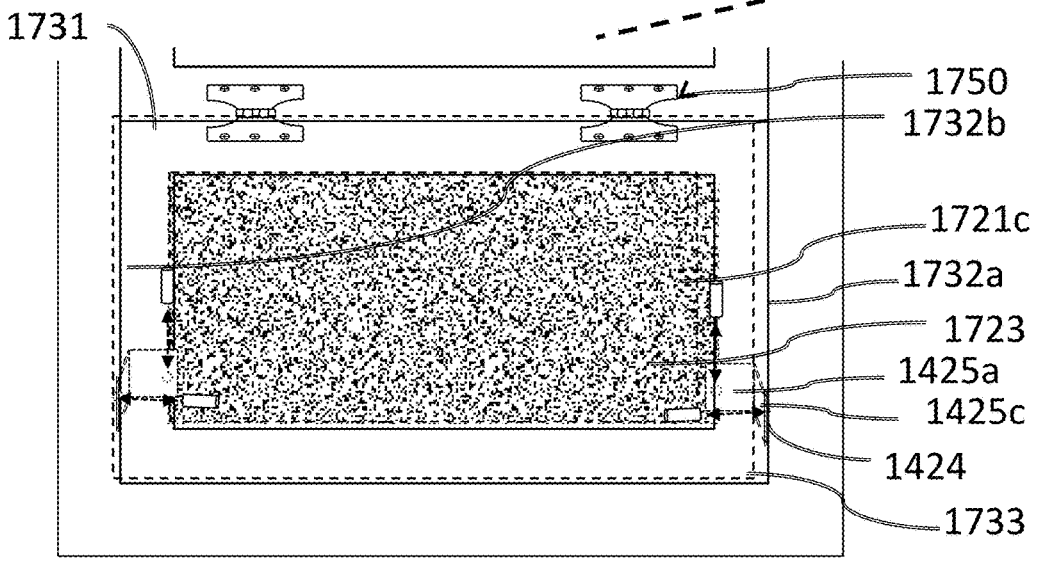
FIG. 17*b* illustrates a cross-sectional view of the mountable cover of FIG. 17*a*, taken along XVII-XVII, showing a close-up view of the mountable cover and fastening members wherein the fastening members are configured as the fastening mechanism embodiment of FIG. 14*b*, wherein the third mini-spacer section is folded back forming an "L-configuration"

FIG. 17*a* illustrates a top plan view of an embodiment of the subject mountable cover, wherein the mountable cover is formed having a plurality of mounting frames, and the mountable cover is shown mounted within a window frame structure, such as a glass door window, skylight, large picture window, etc., shown generally at 1700. FIG. 17*b* illustrates a cross-sectional view of the mountable cover of FIG. 17*a*, taken along XVII-XVII, showing a close-up view of the mountable cover and fastening members wherein the fastening members are configured as the fastening mechanism embodiment of FIG. 14*b*, wherein the third mini-spacer section is folded back forming an "L-configuration".

Regarding FIGS. 17*a*-17*b*, the mountable cover 1720 is formed having a plurality of mounting frames 1721*a*, 1721*b*, 1721*c* each having a top wall 1731, side walls 1732*a*, 1732*b* and a bottom wall 1733. In the embodiment shown, the mountable cover 1720 is mounted within a window frame structure 1740. At least one panel 1723 is located within each of the mounting frames 1721*a*, 1721*b*, 1721*c*. Panels 1723 comprise a material adapted to block at least a portion of light external to and traversing the window 1740, adapted sit parallel to said window 1740. Mounting frames 1721*a*, 1721*b*, 1721*c* are joined together by way of at least one adjoining member 1750. In the embodiment shown, the adjoining member 1750 is a hinge, and there are preferably at least two hinges located on each of the frames 1721*a*, 1721*b*, 1721*c*.

At least one fastening mechanism 1724 is appointed to engage with the window frame structure 1740 for mounting and removing the mounting frame 1720 from the window. In the embodiment shown, the fastening mechanisms 1724 is constructed as the tri-fold spacer of FIGS. 14*a*-14*c*. The tri-fold spacer is in its "L-configuration" 1401 of FIG. 14*b*. In this configuration, the first mini-spacer section 1425*a* is attached via pin 1428 through aperture 1427 in the back/rear of a side wall of each mounting frame. The second mini-spacer section 1425*b* and third mini-spacer section 1425*c* abut one another and are adjacent to the side wall of the mounting frame and window frame. A pin may be inserted within the third mini-spacer section's 1425*c* aperture 1427 for securing the mounting frame in the window. Alternatively, if the second and third mini-spacers cause enough of a tight fit/frictional fit, then no pin would be necessary as the mountable cover would stay snug. Alternatively, in this configuration the first mini-spacer section 1425*a* may be attached via pin 1428 through aperture 1427 in the top of the window frame and the second mini-spacer section 1425*b* and third mini-spacer section 1425*c* abut one another, and abut and are adjacent to the side wall of the mounting frame and window frame, and a pin is also placed in the third mini-spacer section 1425*c* on the side of the mounting cover side wall.

Figure 18A:
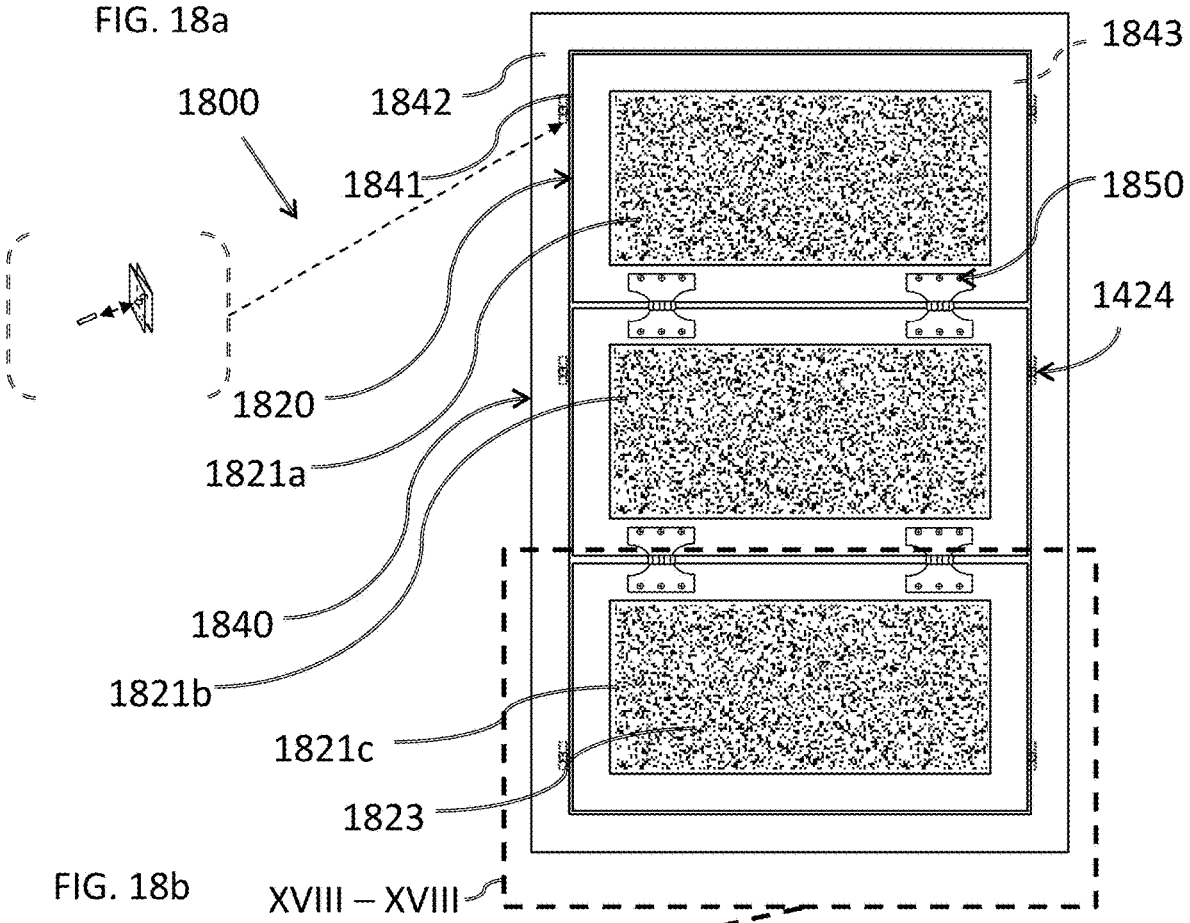
FIG. 18*a* illustrates a top plan view of an embodiment of the subject mountable cover, wherein the mountable cover is formed having a plurality of mounting frames, and the mountable cover is shown mounted within a window frame structure, glass door window, skylight, large picture window, etc.
Figure 18B:
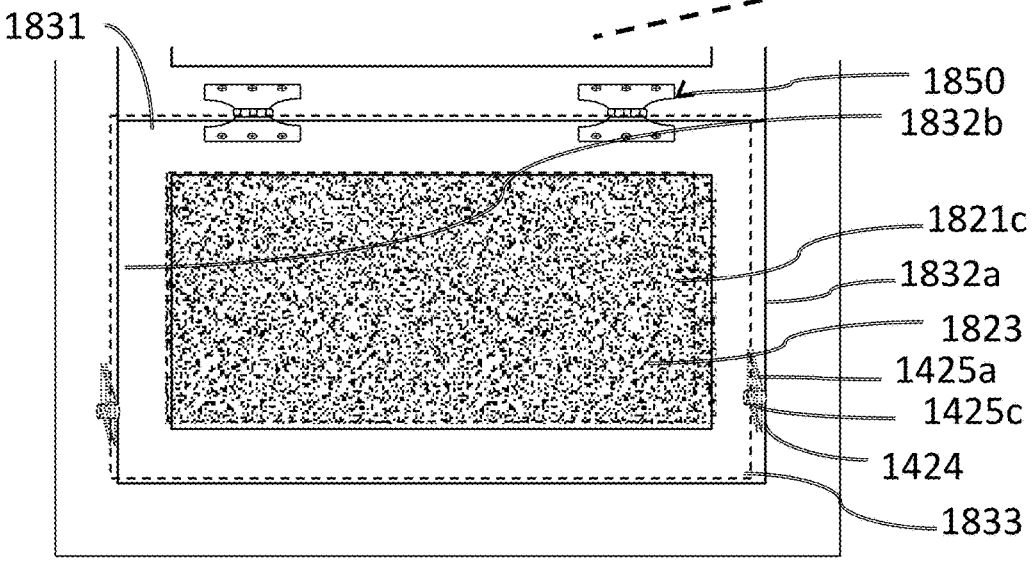
FIG. 18*b* illustrates a cross-sectional view of the mountable cover of FIG. 18*a*, taken along XVIII-XVIII, showing a close-up view of the mountable cover and fastening members wherein the fastening members are configured as the fastening mechanism embodiment of FIG. 14*c*, wherein the first mini-spacer section is folded forward and the third mini-spacer section is folded back forming an "I-configuration"

FIG. 18*a* illustrates a top plan view of an embodiment of the subject mountable cover, wherein the mountable cover is formed having a plurality of mounting frames, and the mountable cover is shown mounted within a window frame structure, such as a glass door window, skylight, large picture window, etc., shown generally at 1800. FIG. 18*b* illustrates a cross-sectional view of the mountable cover of FIG. 18*a*, taken along XVIII-XVIII, showing a close-up view of the mountable cover and fastening members wherein the fastening members are configured as the fastening mechanism embodiment of FIG. 14*c*, wherein the first mini-spacer section is folded forward and the third mini-spacer section is folded back forming an "I-configuration."

Regarding FIGS. 18*a*-18*b*, the mountable cover 1820 is formed having a plurality of mounting frames 1821*a*, 1821*b*, 1821*c* each having a top wall 1831, side walls 1832*a*, 1832*b* and a bottom wall 1833. In the embodiment shown, the mountable cover 1820 is mounted within a window frame structure 1840. At least one panel 1823 is located within each of the mounting frames 1821*a*, 1821*b*, 1821*c*. Mounting frames 1821*a*, 1821*b*, 1821*c* are joined together by way of at least one adjoining member 1850. In the embodiment shown, the adjoining member 1850 is a hinge. At least one fastening mechanism 1824 is appointed to engage with the window frame structure 1840 for mounting and removing the mounting frame 1820 from the window. In the embodiment shown, the fastening mechanisms 1824 is constructed as the tri-fold spacer of FIGS. 14*a*-14*c*. The tri-fold spacer is in its "I-configuration" 1402 of FIG. 14*c*. In this configuration, the first mini-spacer section 1425*a* is attached via pin 1428 through aperture 1427 in the side of a side wall of each mounting frame causing a tight/snug fit. The second and third mini-spacers cause enough of a tight fit/frictional fit, then no pin would be necessary as the mountable cover would stay snug.

The tri-fold fastening members are configured so that the mini-spacers can be attached on front of the mountable frames, or inside the mountable frames, or on the back of the mountable covers by way of a curved metal or plastic spacer. A pin, small screw, or push nail can attach the tab to the molding of what is surrounding or holding the glass. A curved spacer or tab can be mounted inside the design of the mountable covers or on the rear of the mountable covers and against the molding of the glass or window.

FIG. 19 illustrates a top plan view of an embodiment of the subject mountable cover, wherein the mountable cover is formed having a plurality of mounting frames, and the mountable cover is shown mounted within a window frame structure, such as a glass door window, skylight, large picture window, etc., and one of the panels is folded down to allow light into at least the top portion of the window, shown generally at 1900. The mountable cover 1920 is formed having a plurality of mounting frames 1921*a*, 1921*b*, 1921*c*. In the embodiment shown, the mountable cover 1920 is mounted within a window frame structure 1940 having glass 1941. At least one panel 1923 is located within each of the mounting frames 1921*a*, 1921*b*, 1921*c*. Panels 1923 comprise a material adapted to block at least a portion of light external to and traversing the window 1940, adapted sit parallel to said window 1940. Mounting frames 1921*a*, 1921*b*, 1921*c* are joined together by way of at least one adjoining member 1950. In the embodiment shown, the adjoining member 1950 is a hinge. At least one fastening mechanism 1924 is appointed to engage with the window frame structure 1940 for mounting and removing the mounting frame 1920 from the window. In the figure shown, one of the mountable frames 1921*a* is opened or folded downward over the lower mounting frame 1921*b* so that a portion of the window glass 1941 is shown to allow a greater amount of sunlight into the interior of the house/building.

FIGS. 20*a*-20*g* generally illustrates cross-sectional side views of embodiments of the subject mountable cover to demonstrate ways that the insert panel (i.e. material/fabric) is placed within and attached to the mounting frame in constructing the mounting cover, preferably similar to framing of a canvas painting.

Figure 20A:
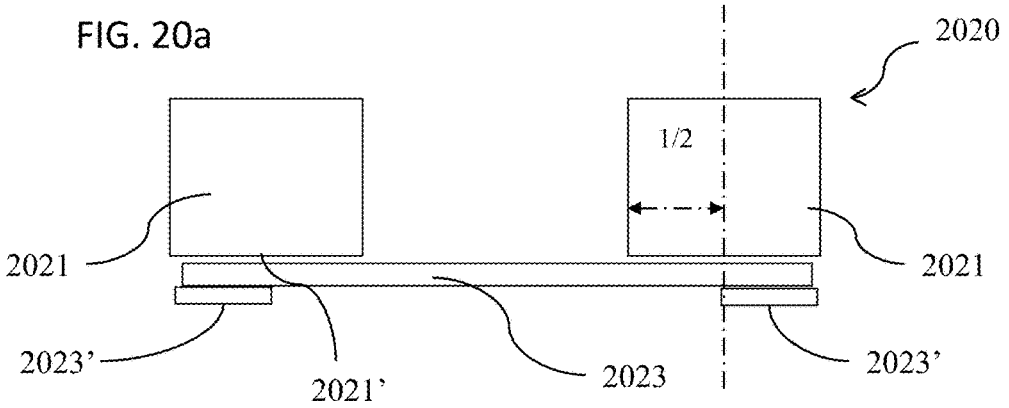
FIG. 20*a* illustrates a cross-sectional side view of an embodiment of the subject mountable cover, demonstrating one way that the insert panel (i.e., material/fabric) is placed within and attached to a support frame which, in turn, is placed within a frame to construct a mounting cover.

FIG. 20*a* illustrates a cross-sectional side view wherein an insert panel 2023 is mounted in a support frame 2021 to construct a panel inset adapted to be received within a frame to form a mountable cover 2020. In this embodiment the fabric/material of the insert panel 2023 is attached to the bottom of the support frame as shown at 2021' by way of the insert's dress pieces or sections 2023'. The dress pieces 2023', 2023*b*' are preferably ½ of frame 2021 width. Panel 2023 is preferably constructed as a long rectangle material. Dress pieces 2023', 2023*b*' may include thin molding, material tape, etc.

Figure 20B:
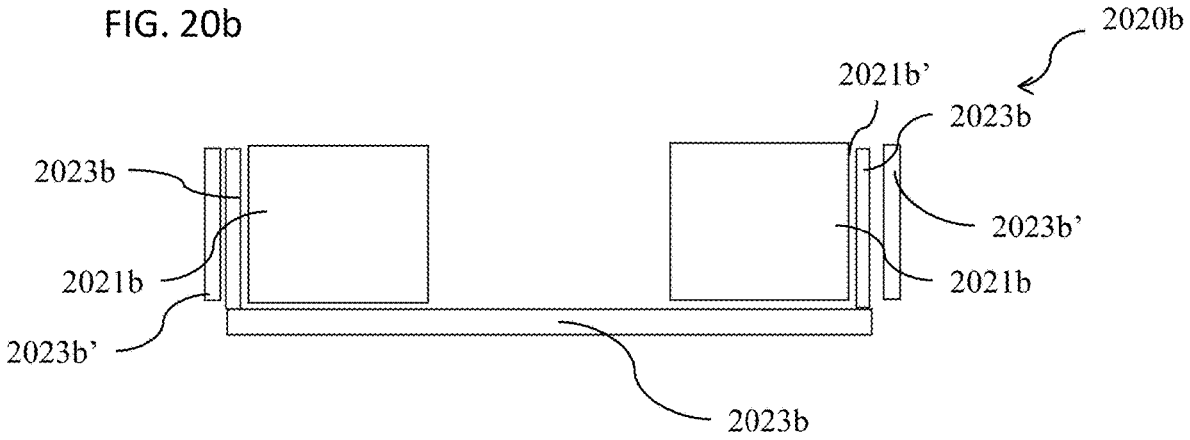
FIG. 20*b* illustrates a cross-sectional side view of an embodiment of the subject mountable cover, demonstrating another way that the insert panel (i.e., material/fabric) is attached to a support frame which, in turn, is placed within a frame to construct a mounting cover.

FIG. 20*b* illustrates a cross-sectional side view wherein an insert panel 2023*b* is mounted in a support frame 2021*b* to construct a panel inset that is then received within a frame to form a mountable cover 2020*b*. In this embodiment the fabric/material of the insert panel 2023*b* is attached to sides of frame 2021*b* as shown at 2021*b*' by way of the insert's dress pieces or sections 2023*b*'.

Figure 20C:
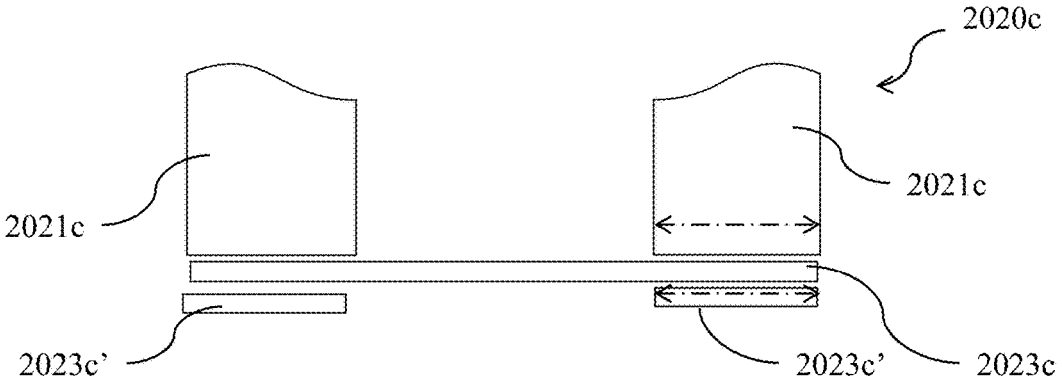
FIG. 20*c* illustrates a cross-sectional side view of an embodiment of the subject mountable cover, demonstrating another way that the insert panel (i.e., material/fabric) is attached to a support frame which, in turn, is placed within a frame to construct a mounting cover.

FIG. 20*c* illustrates a cross-sectional side view wherein an insert panel 2023*c* is mounted in a support frame 2021*c* to construct a panel insert that is then received within a frame to form a mountable cover 2020*c*. In this embodiment the fabric/material of the insert panel 2023*c* is attached to bottom of frame 2021*c* as shown at 2021*c*' by way of the insert's dress pieces or sections 2023*c*'. Dress pieces 2023*c*' are sized corresponding to the full width of frame.

Figure 20D:
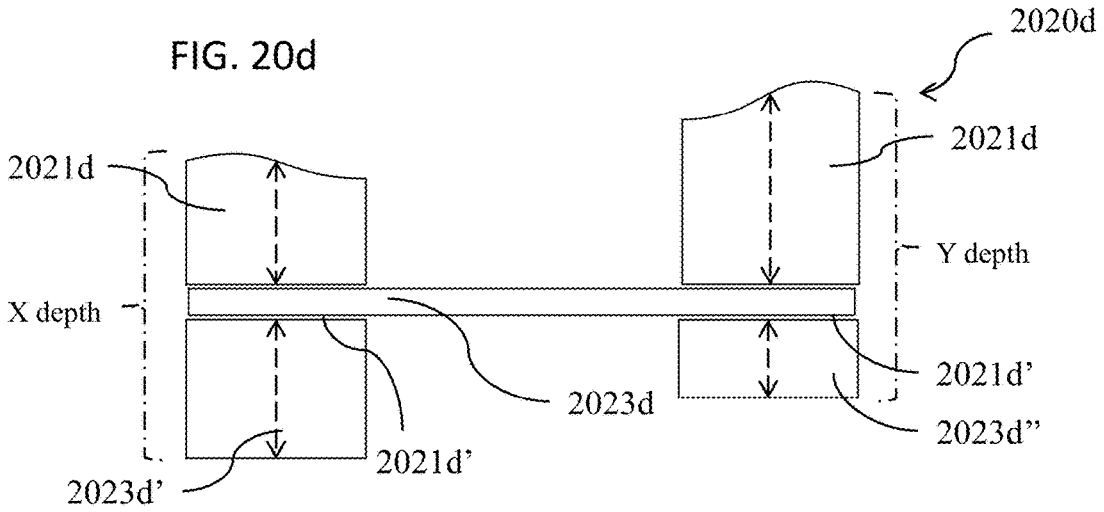
FIG. 20*d* illustrates a cross-sectional side view of an embodiment of the subject mountable cover, demonstrating another way that the insert panel (i.e., material/fabric) is attached to a support frame which, in turn, is placed within a frame to construct a mounting cover.

FIG. 20*d* illustrates a cross-sectional side view wherein an insert panel 2023*d* is mounted in a support frame 2021*d* which is then appointed to be mounted in a frame to finally construct a mountable cover 2020*d*. In this embodiment the fabric/material of the insert panel 2023*d* material is attached to bottom of support frame 2021*d* as shown at 2021*d*' by way of the insert's dress pieces or sections 2023*d*' and 2023*d*" and/or staples. Dress piece 2023*d*' is shown thicker than dress piece 2023*d*" acting a spacer to accommodate different heights, this increased thickness creates a rise of material dress piece 2023*d*' to accommodate things like molding around door glass/glazing panels—even thicker on thereby giving more height to material. Support frame 2021*d* is preferably cut out with an L-shaped cut-out where material/panel 2023*d* is attached over and behind frame 2021*d* to form the panel inset which is then mounted within a frame to form the mountable cover of the subject invention.

Figure 20E:
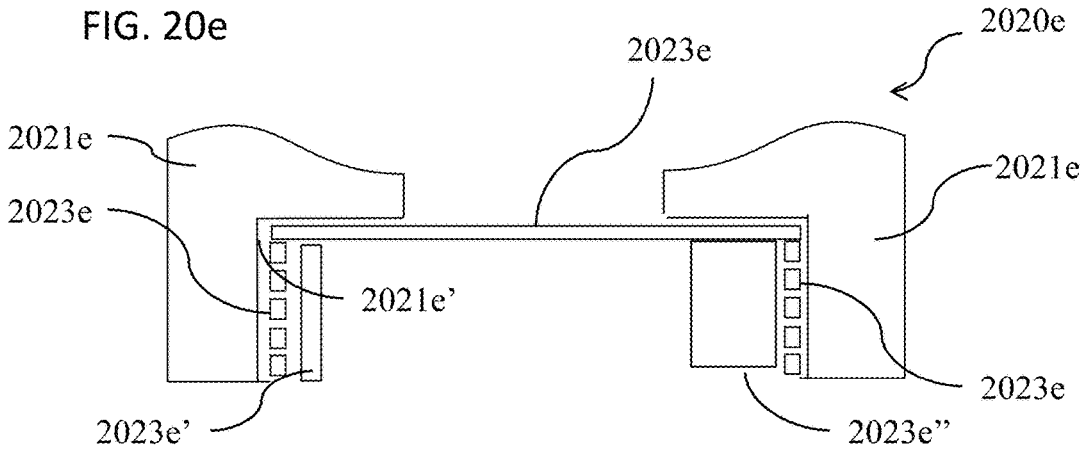
FIG. 20*e* illustrates a cross-sectional side view of an embodiment of the subject mountable cover, demonstrating another way that the insert panel (i.e., material/fabric) is attached to a support frame which, in turn, is placed within a frame to construct a mounting cover.

FIG. 20*e* illustrates a cross-sectional side view wherein an insert panel 2023*e* is mounted in a support frame 2021*e* to form a panel inset that is mounted in a frame to construct a mountable cover 2020*e*. In this embodiment the fabric/material of the insert panel 2023*e* is attached to sides of frame 2021*e* as shown at 2021*e*' by way of the insert's dress pieces or sections 2023*e*' and 2023*e*". Dress piece 2023*e*" is shown thicker than dress piece 2023*e*', this increased thickness creates a rise of material dress piece 2023*e*" to accommodate things like molding around door glass/glazing panels—even thicker on thereby giving more height to material. Mounting frame 2021*e* is shown as a rabbet cut or lip cut such as that sh. Rabbet cut or lip cut which is another way of cutting the frame molding so that the insert panel sits higher enabling to clear the door pre-attached molding around the glass/glazing panels.

Figure 20F:
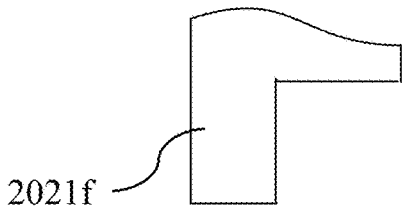
FIG. 20*f* illustrates a cross-sectional side view of an embodiment of the subject mountable cover, showing a portion of a mounting frame demonstrating a rabbit cut or lip cut.

FIG. 20*f* illustrates a cross-sectional side view of an embodiment of the subject mountable cover, showing a portion of a molding/mounting frame 2021*f* demonstrating a rabbit cut or lip cut (like a picture frame). In this manner the insert panel sits higher enabling to clear the door pre-attached molding around the glass/glazing panels. The panel is not attached to the mounting frame itself but is attached to the support frame to form the panel inset which can then be interchanged between different frames to form different decorative mounting frame covers for windows/doors. For example, the panel inset may be changed-up for holidays. The panel inset is secured within the final frame by way of tabs/screws.

Figure 20G:
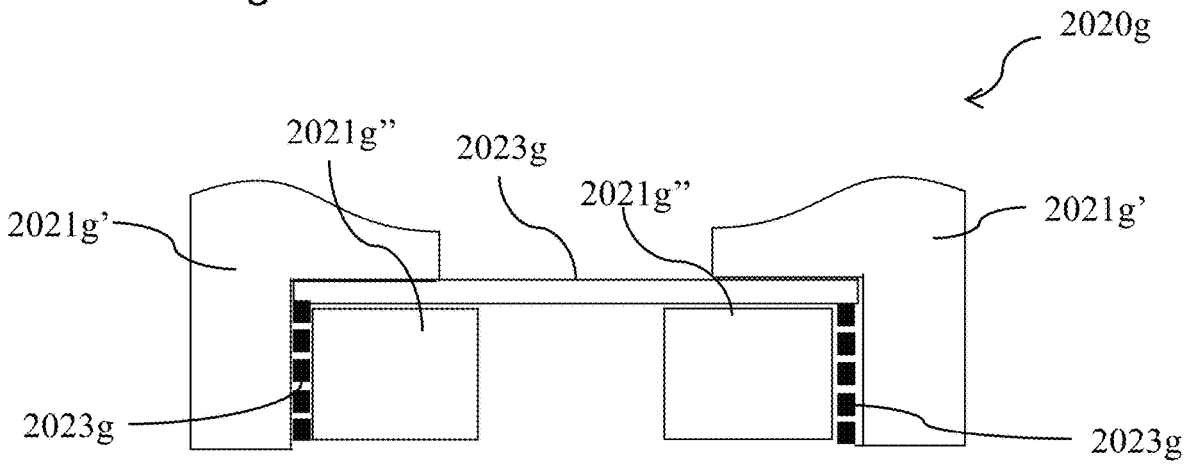
FIG. 20*g* illustrates a cross-sectional side view of an embodiment of the subject mountable cover, demonstrating another way that the insert panel (i.e. material/fabric) is placed within a support frame appointed to be attached to a mounting frame when constructing the mounting cover.

FIG. 20*g* illustrates a cross-sectional side view wherein an insert panel 2023*g* is mounted in a mounting frame 2021*g* constructed having a frame one 2021*g*' and frame two 2021*g*" to construct a mountable cover 2020*g*. In this embodiment the fabric/material of the insert panel 2023*g* is mounted to the top or side of frame two 2021*g*". Optionally, it can attach to bottom or side of rabbet cut of frame one 2021*g*'. The embodiment in FIG. 20*g* illustrates a frame inside frame construct (i.e. frame one inside frame two). Material/Fabric can be attached to either frame and then frames can be attached together.

Further regarding FIGS. 20*a*-20*g*: How to attach the fabric: 1) fabric/material can be attached to the frame by gluing. (all ways heat gun, rolled glue, sprayed glue etc.); 2) fabric/material can be attached to the frame by staples, nails, pin, pin nails or tacks; 3) fabric/material can be attached to the frame by screws; 4) fabric/material can be attached to the frame by different types of tapes; 5) fabric/material can be attached to the frame by wood/plastic or any composite that you can secure dress piece on top of material to hold it in place; 6) fabric/material can be attached to the frame even by glue on hook and loop fasteners, such as that sold under the trade name Velcro.

Further regarding FIGS. 20*a*-20*g*: Regarding FIGS. 20*a*, 20*b* and 20*c*, the thickness of dress pieces of fabric for the panel insert discussed below can range from thickness of the fabric to several inches thick; preferably, the thickness ranges from about ⅛ to ¼ inch thick. The length of the fabric for the panel insert is preferably the full length of the mounting frame. The width of the fabric for the panel insert is preferably equal to or lesser than (≤) the full width of the mounting frame. Dress pieces of the material of the insert panel are designed for several reasons and made from different substances/materials. It can be made of the same composite in which the frame is made of or other composites like bamboo, woods, plastics, cloth, etc. A dress piece may be made to hide the cloth edges. Depending on the thickness as shown in FIGS. 20*d* and 20*e* raise the cover and material so the user wouldn't need to use a rabbet cut in the frame molding if preferred. To secure the fabric as well as when using material like wood when one secures the dress piece it also can secure the fabric.

Figure 21A:
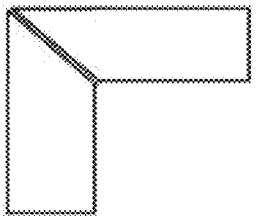
FIG. 21A illustrates a top plan view of a corner section of an embodiment of the mounting frame of the subject mounting cover showing the frame corners cut and joined via a 45 degree miter angle corner cut.
Figure 21B:
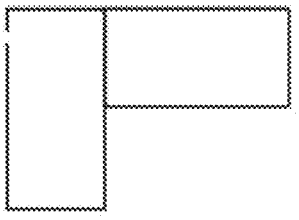
FIG. 21B illustrates a top plan view of a corner section of an embodiment of the mounting frame of the subject mounting cover showing the frame corners cut flat.

FIGS. 21*a* and 21*b* illustrate cuts of the mounting frame corners. FIG. 21A shows the frame corners cut and joined via a 45-degree miter angle corner cut. FIG. 21B shows the frame corners cut and joint via flat.

Figure 22A:
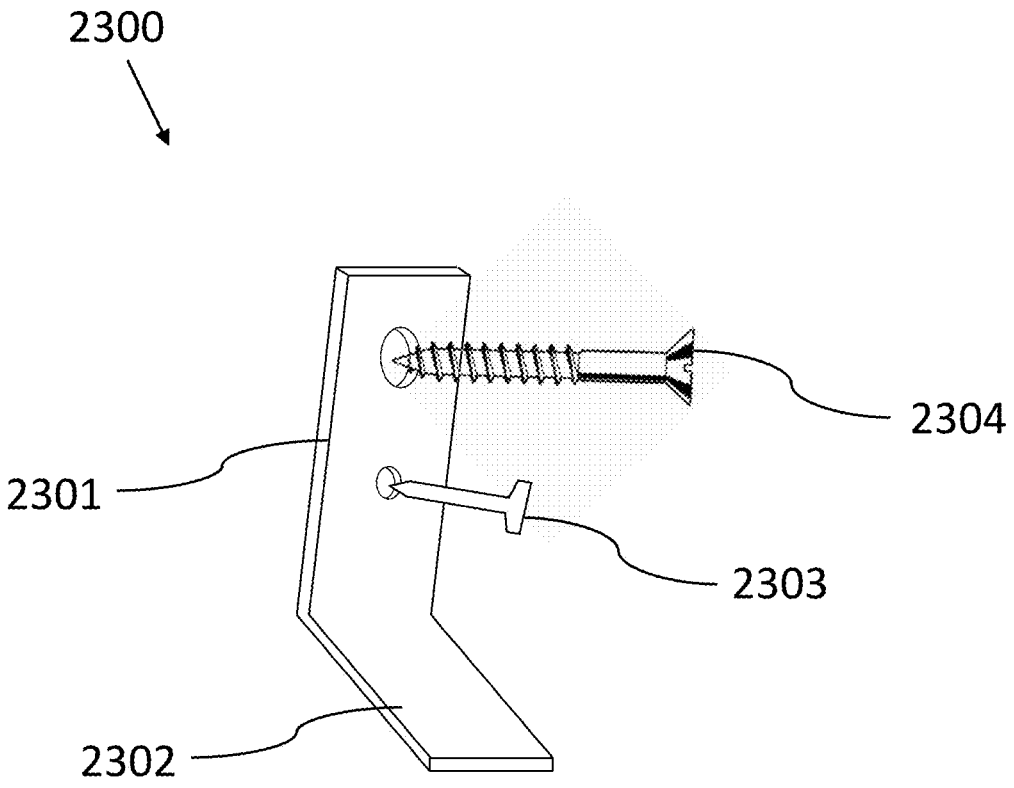
FIG. 22*a* illustrates a top plan view of an L-shaped fastening mechanism.
Figure 22B:
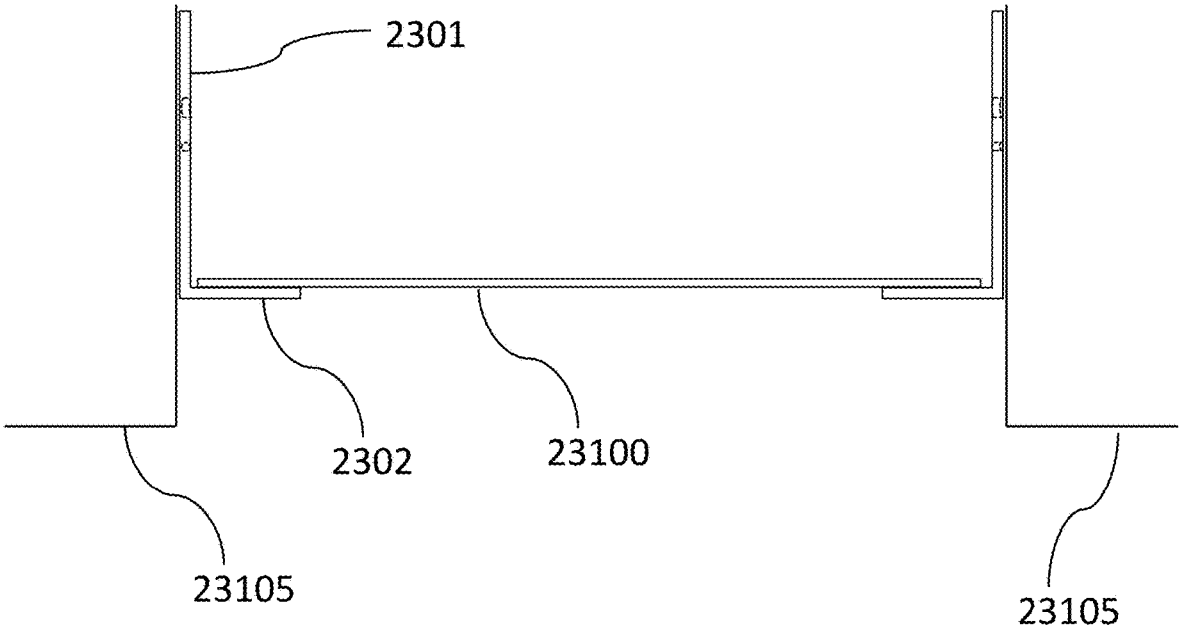
FIG. 22*b* illustrates a view of the L-shaped fastening mechanism wherein the mountable cover sits above and rests on the lower portion of the L-shaped fastening mechanism.
Figure 22C:
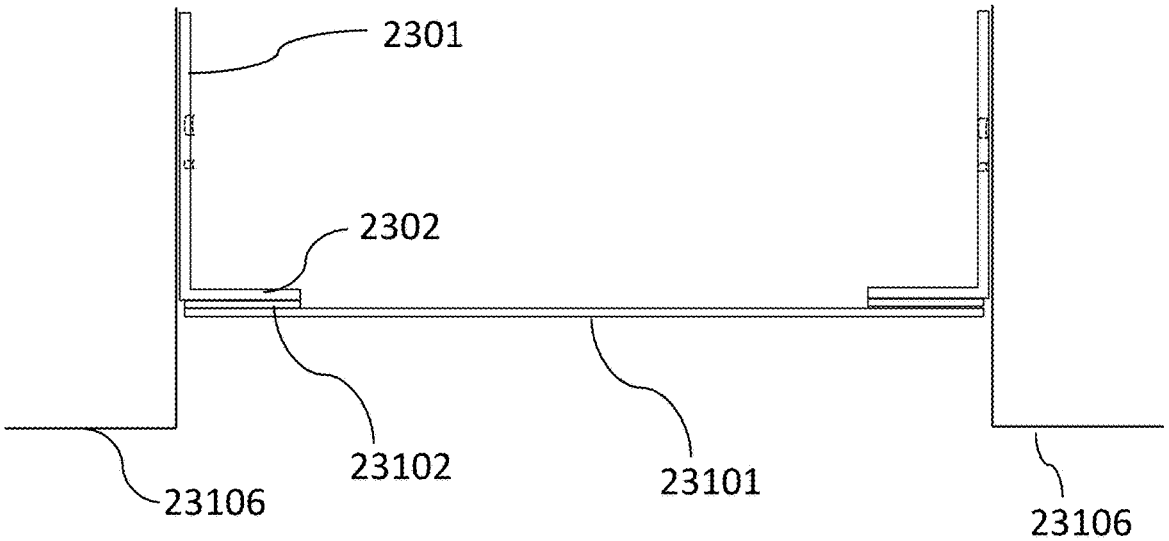
FIG. 22*c* illustrates a view of the L-shaped fastening mechanism wherein the mountable cover sits below and is magnetically attached to the lower portion of the L-shaped fastening mechanism.
Figure 22D:
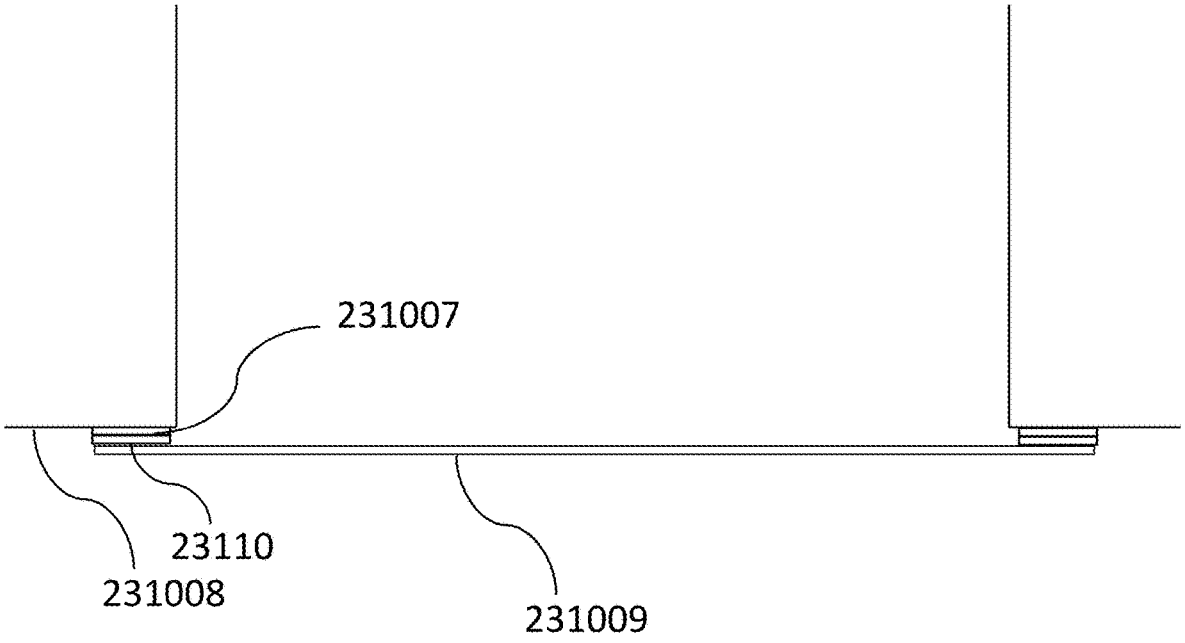
FIG. 22*d* illustrates a view of optional metal plates for use instead of L-shaped fastening mechanisms.

FIG. 22*a* illustrates a top plan view of an L-shaped fastening mechanism, shown generally at 2300. FIG. 22*b* illustrates a view of the L-shaped fastening mechanism wherein the mountable cover sits above and rests on the lower portion of the L-shaped fastening mechanism. FIG. 22*c* illustrates a view of the L-shaped fastening mechanism wherein the mountable cover sits below and is magnetically attached to the lower portion of the L-shaped fastening mechanism. FIG. 22*d* shows an optional support metal plate configuration adapted to be used instead of the L-shaped bracket. FIG. 22*a* illustrates a top plan view of an L-shaped fastening mechanism, shown generally at 2300. The L-shaped fastening mechanism includes a first portion 2301 perpendicular and attached to a second portion 2302. The L-shaped mechanism is appointed to be used with skylight type windows (windows hung on a horizontal plane to the ground, versus vertically hung windows, such as double hung windows). First portion 2301 or the top portion of the L shaped bracket running substantially along the vertical plane or y-axis includes at least one aperture, but may include two apertures of different sizes. The top aperture is preferably a counter-sunk aperture appointed to receive a screw 2303. The lower aperture is appointed to receive a pin/or low profile nail 2304 having a small head so that it does not protrude from the surface of the first portion 2301. Screw 2303 and nail 2304 are adapted to secure the L-shaped bracket to side walls of a skylight well through the sheetrock, drywall, and/or other walling material. In one embodiment, shown in FIG. 22*b*, the top portion 2301 is screwed and nailed to the wall of the skylight well 23105. Second portion 2302 or the lower portion of the L shaped bracket runs substantially along the horizontal plane or x-axis and receives and holds the mountable cover above it as gravity presses down on the mountable cover 23100. In an alternative configuration, as shown in FIG. 22*c*, the top portion 2301 is again screwed and nailed to the wall of the skylight well 23106. Second portion 2302 is composed of metal (preferably the entire L bracket is composed of metal) and the mountable cover 23101 includes magnets 23102 so that it is magnetically attached to the underside of the second portion 2302. In this manner, the mountable cover magnetically attaches to the L bracket and appends below and from the bracket so that the bracket is not visible. In yet another embodiment, shown in FIG. 22*c*, the L bracket is not used and instead metal plates 231007 as discussed herein are anchored (screwed or attached by adhesive) to the top wall of the ceiling 231008 and the mountable cover 231009 with magnets 23110 is magnetically secured to the plates 231007.

Figure 23A:
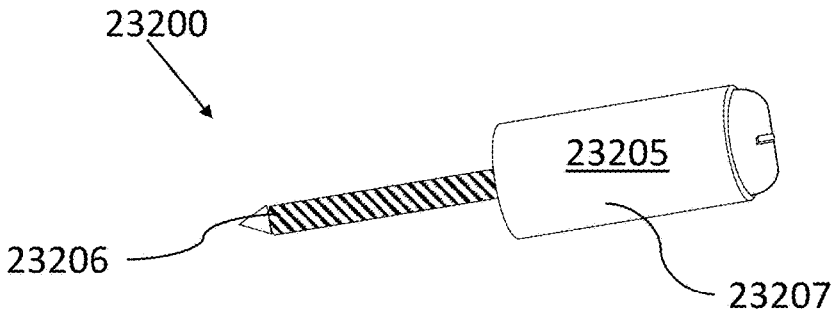
FIG. 23*a* illustrates an embodiment of a custom support pin adapted to be used to secure the mountable cover when the window is a skylight or other window on a horizontal plane.
Figure 23B:
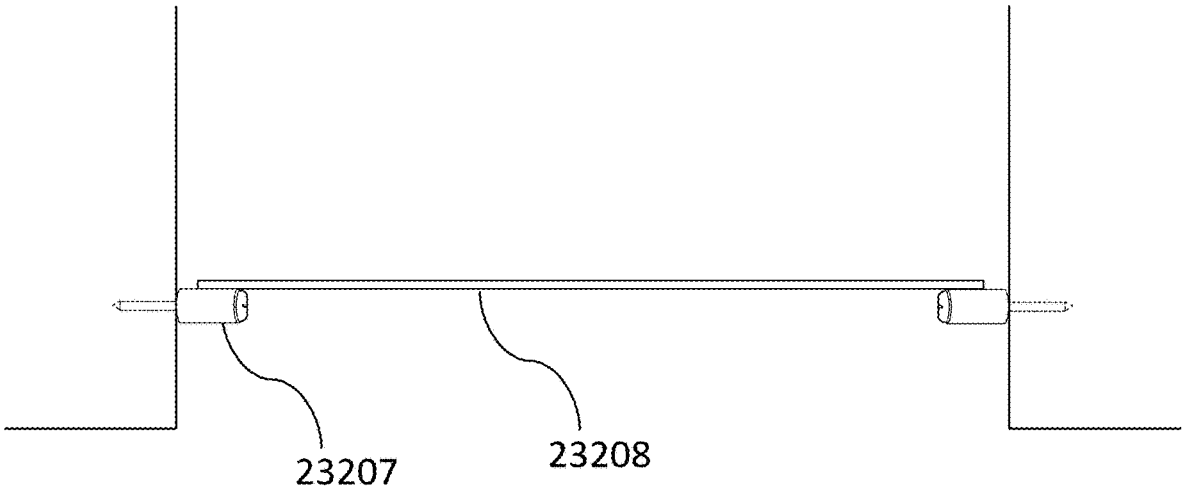
FIG. 23*b* illustrates use of the support pin to secure the mountable cover over a skylight.

FIGS. 23*a*-*b* illustrate an embodiment of a custom support pin adapted to be used to secure the mountable cover when the window is a skylight or other window on a horizontal plane, shown generally at 23200. FIG. 23*a* illustrates an embodiment of a custom support pin adapted to be used to secure the mountable cover when the window is a skylight or other window on a horizontal plane. FIG. 23*b* illustrates use of the support pin to secure the mountable cover over a skylight. Instead of the L-shaped bracket, at least four push screws or support pins 23205 can be used to puncture the sheetrock with a nail portion 23206 and providing a support portion 23207 that extends horizontally to hold the mountable cover 23208 in the skylight well. Accordingly, the mountable cover can sit either on the L-bracket of FIG. 22*a*, FIG. 22*b* or sit on the push pin or support pin shown at 23200 without the need to secure or use the L-bracket.

Figure 24A:
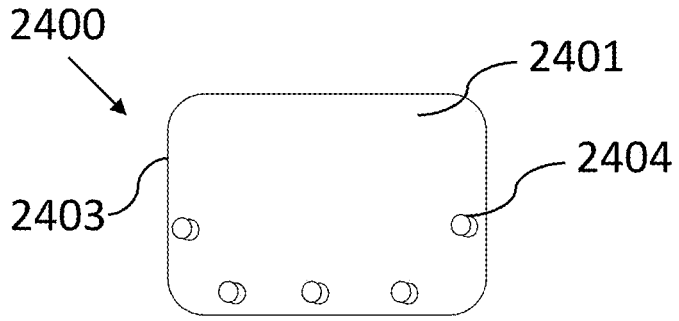
FIG. 24*a* is a top plan view of an embodiment of a plate for magnetic mounting of the subject invention.
Figure 24B:
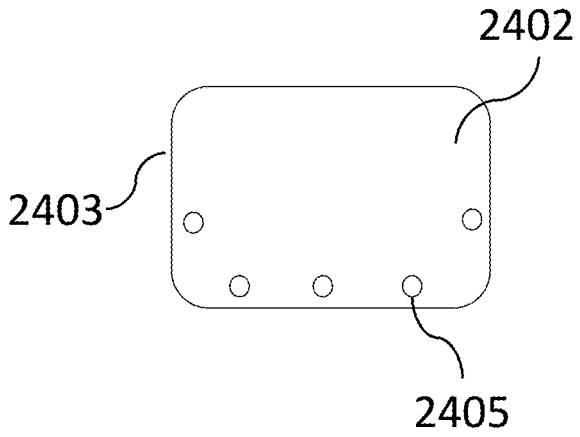
FIG. 24*b* is a bottom view of the plate.
Figure 24C:
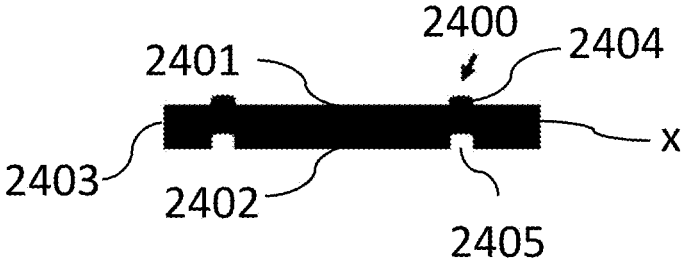
FIG. 24*c* is a side view of the plate.
Figure 24D:
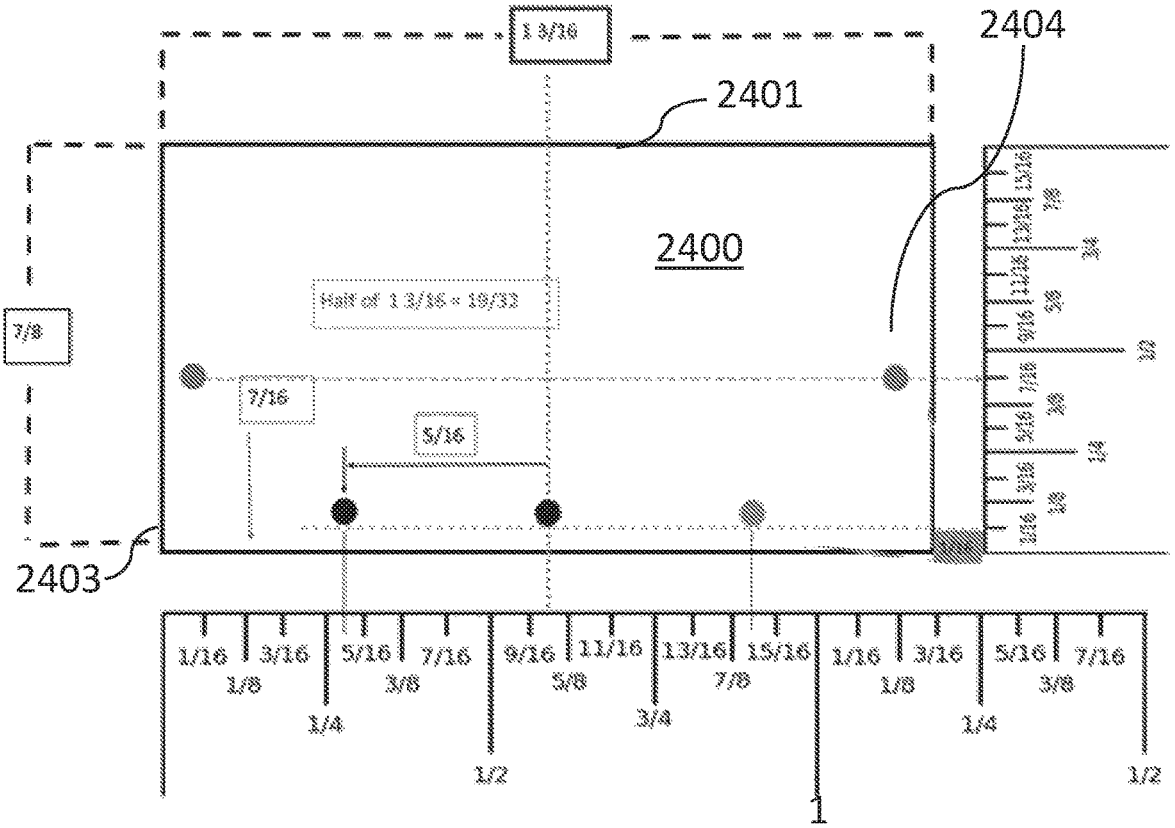
FIG. 24*d* is a top side view of the plate showing preferred plate dimensions.

FIGS. 24*a*-24*d* are views of an embodiment of a plate of the subject invention. FIG. 24*a* is a top plan view of an embodiment of a plate for magnetic mounting of the subject invention, shown generally at 2400. FIG. 24*b* is a bottom view of the plate. FIG. 24*c* is a side view of the plate. FIG. 24*d* is a top side view of the plate showing preferred plate dimensions. Plate 2400 has a top surface 2401, bottom surface 2402 and side walls 2403. Plate 2400 has a plate depth or thickness x. Top surface 2401 includes one or more raised portions 2404 that extend upward from top surface 2401. In the embodiment shown, there are five (5) raised portions 2404 with three (3) raised portions located on a front area of the top surface 2401 and the other two (2) raised portions located opposite from one another on side areas of the top surface 2401. Raised portions 2404 preferably have slightly rounded tips. Bottom surface 2402 includes indents 2405 aligned with raised portions 2404 on the same plane. Bottom surface 2402 preferably is coated with an adhesive for attachment to a window frame or a door/door frame. More preferably, bottom surface 2402 is coated with an adhesive for attachment to a window glass of a window in a window frame and/or a window in a door frame. The bump up, protrusions or raised portions 2404 prevents the magnet from sliding down while flat plates with no protrusions can cause sliding down of the magnet.

Figure 25A:
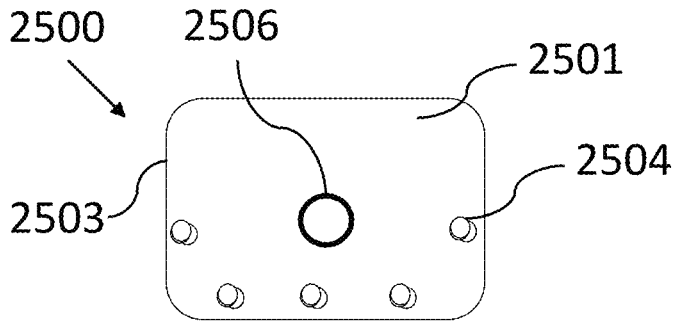
FIG. 25*a* is a top plan view of an embodiment of a plate for magnetic mounting of the subject invention.
Figure 25B:
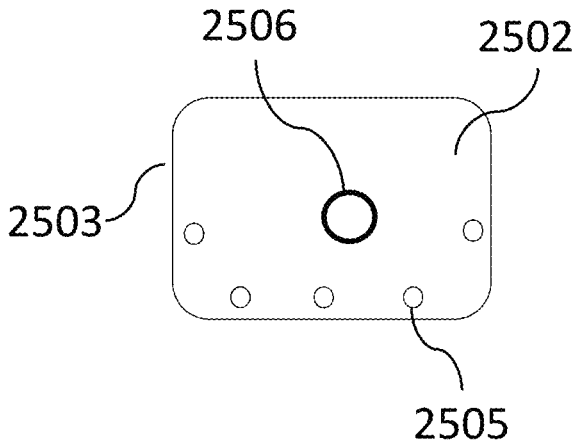
FIG. 25*b* is a bottom view of the plate.
Figure 25C:
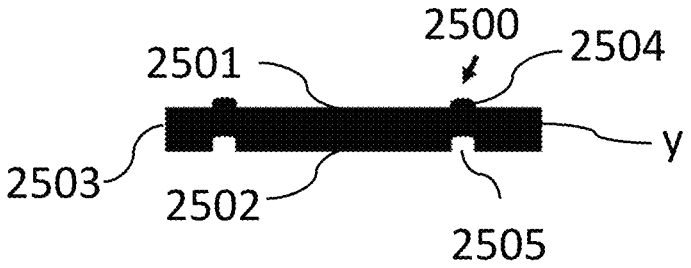
FIG. 25*c* is a side view of the plate.

FIGS. 25*a*-25*c* are views of an embodiment of a plate of the subject invention. FIG. 25*a* is a top plan view of an embodiment of a plate for magnetic mounting of the subject invention, shown generally at 2500. FIG. 25*b* is a bottom view of the plate. FIG. 25*c* is a side view of the plate. Plate 2500 has a top surface 2501, bottom surface 2502 and side walls 2503. Plate 2500 has a plate depth or thickness y. Top surface 2501 includes one or more raised portions 2504 that extend upward from top surface 2501 as discussed hereinabove. A screw hole 2506 is provided in this embodiment for attachment of the plate 2500 to a surface, such as a window or door frame. Raised portions 2504 are integrated within plate 2500, located on a front area and on opposite side walls from one another on top surface 2501. In turn, bottom surface 2502 includes indents 2505 aligned with raised portions 2504 on the same plane. The plate with the screw hole is appointed generally to be used on surfaces that are not compatible with adhesive, such as for example painted wood surfaces as it has been found that the adhesive does not hold well on these types of surface. Instead, therefore the plate with the screw hole would be used to secure the plate.

Figure 26A:
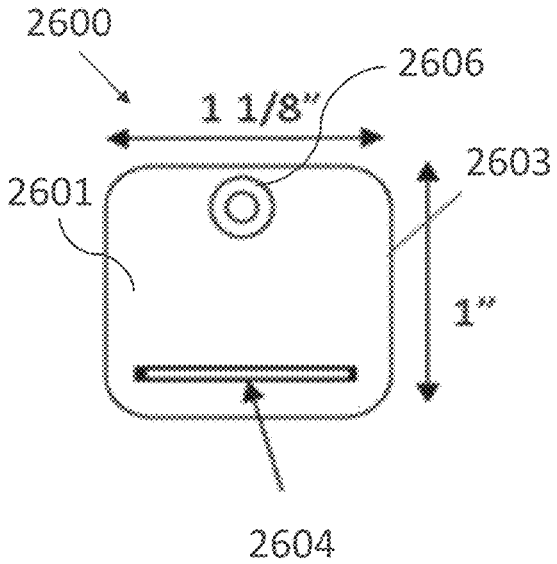
FIG. 26*a* is a top plan view of an embodiment of a plate for magnetic mounting of the subject invention.
Figure 26B:
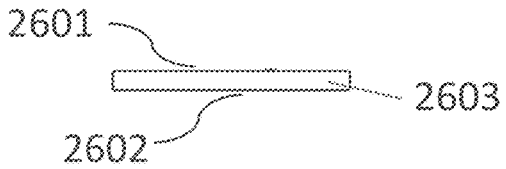
FIG. 26*b* is a side view of the plate.
Figure 26C:
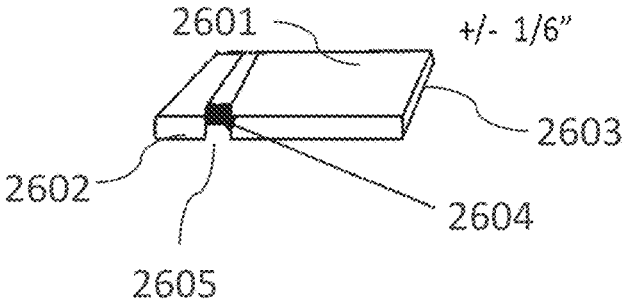
FIG. 26*c* is a top side view of the plate.

FIGS. 26*a*-26*c* are views of an embodiment of a plate of the subject invention. FIG. 26*a* is a top plan view of an embodiment of a plate for magnetic mounting of the subject invention, shown generally at 2600. FIG. 26*b* is a side view of the plate. FIG. 26*c* is a top side view of the plate. Plate 2600 has a top surface 2601, bottom surface 2602 and side walls 2603. Top surface 2601 includes one or more raised portions 2604 that extend upward from top surface 2601 as discussed hereinabove. In the embodiment shown, raised portion 2604 is formed as a bar extending along or near one of the side walls 2603. A screw hole 2606 is provided in this embodiment for attachment of the plate 2600 to a surface, such as a window or door frame. Bottom surface 2602 includes indents 2605 aligned with raised portions 2604 on the same plane. Plate 2600 is made of a steel material so that the magnets can stick to the plates 2600. Raised portion 2604, shown as elongated bar, is located near the edge of the plate and extends about ⅙" from the top surface. Although a single raised portion 2604 or bar is shown, another bar may be provided oppositely on the top surface 2601. Edges can be rounded or square. Plate 2600 may have a thickness ranging from 3⁄64" to 3⁄16".

Figure 27:
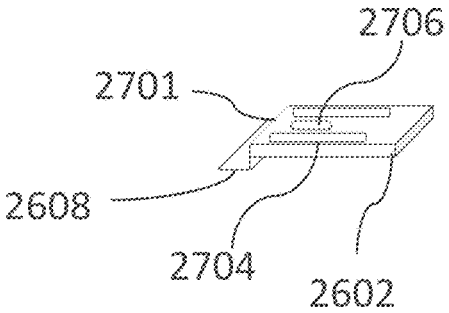
FIG. 27 shows a top side view of an embodiment of a plate of the subject invention.

FIG. 27 shows a top side view of an embodiment of a plate of the subject invention. Plate 2700 has a top surface 2701, bottom surface 2702 and side walls 2703. Top surface 2701 includes two bar-shaped raised portions 2704 and a rise 2708. A screw hole 2706 is provided in this embodiment for attachment of the plate 2700 to a surface, such as a window or door frame.

Figure 28:
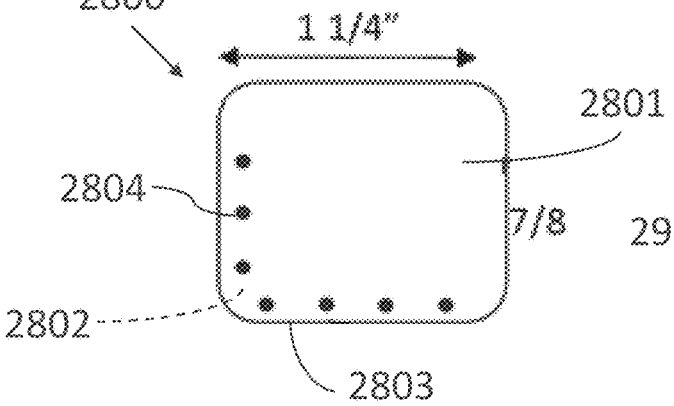
FIG. 28 shows a top side view of an embodiment of a plate of the subject invention.
Figure 29:
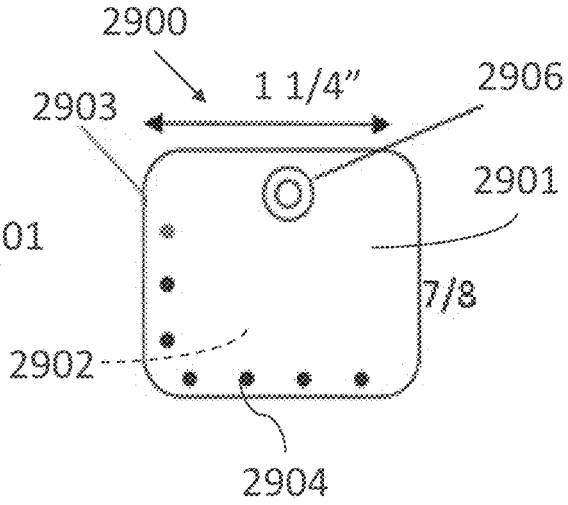
FIG. 29 shows a top side view of an embodiment of a plate of the subject invention.

FIGS. 28 and 29 show top side views of embodiments of a plate of the subject invention, shown at 2800 and 2900, respectively. The plates have a top surface 2801, 2901 bottom surface 2802, 2902 and side walls 2803, 2903. Top surface 2801, 2901 includes a plurality of raised bumps or dots/shaped raised portions 2804, 2904 in an L configuration and being +/−⅙" in height. In plate 2900 a screw hole 2906 is provided in this embodiment for attachment to a surface, such as a window or door frame. Plate 2800 instead includes an adhesive layer on its bottom side for attachment to a window glass or window frame.

Figure 30:
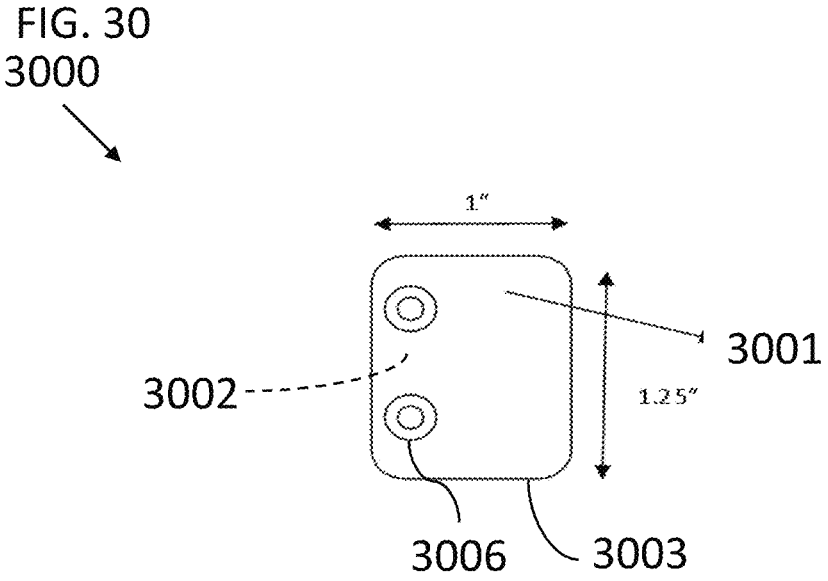
FIG. 30 shows a top side view of an embodiment of a plate of the subject invention.
Figure 31:
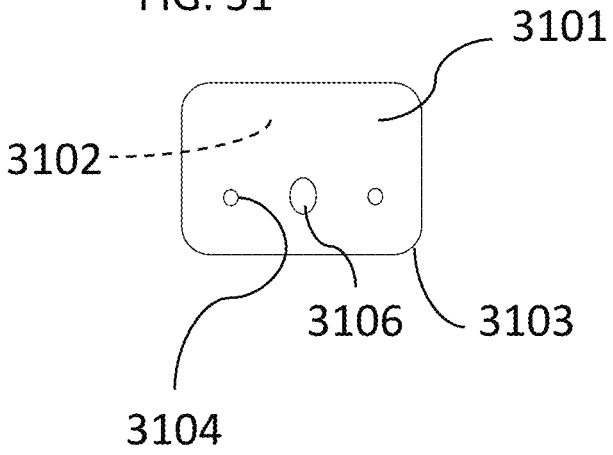
FIG. 31 shows a top side view of an embodiment of a plate of the subject invention.

FIGS. 30 and 31 show top side views of embodiments of a plate of the subject invention, shown at 3000 and 3100, respectively. The plates have a top surface 3001, 3101, bottom surface 3002, 3102 and side walls 3003, 3103. Plate 3100 includes two raised bumps or dots/shaped raised portions 3104, preferably being +/−⅙" high from the top surface 3101. Plate 300 includes two countersunk holes, 3006 to accommodate screws. Plate 3100 includes a screw hole 3106, which is provided in this embodiment for attachment to a surface, such as a window or door frame.

Figure 32A:
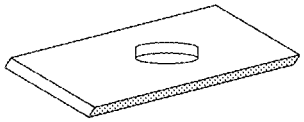
FIG. 32*a* shows a top side view of an embodiment of a plate of the subject invention.
Figure 32B:
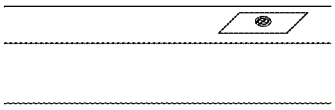
FIG. 32*b* shows a top side view of an embodiment of a plate of the subject invention.

FIGS. 32*a* and 32*b* show top side views of embodiments of a plate of the subject invention. FIG. 32*a* shows a top view of a plate. FIG. 32*b* shows the plate screwed onto a frame, such as a window sash or window frame.

Figure 33A:
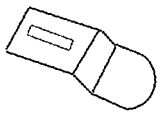
FIG. 33*a* shows a top plan view of a Z-bracket, shown generally at 2600.
Figure 33B:
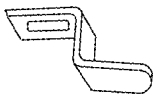
FIG. 33*b* is a side view of the Z-bracket.
Figure 33C:
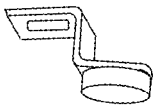
FIG. 33*c* is a side view of the Z-bracket with a spacer.

FIGS. 33*a*-33*c* are views of an embodiment of a Z-bracket for use with the subject invention. FIG. 33*a* is a top plan view of a Z-bracket, shown generally at 2600. FIG. 33*b* is a side view of the Z-bracket. FIG. 33*c* is a side view of the Z-bracket with a spacer. The Z-bracket is particularly applicable for mounting the subject cover on door structures. When mounting the subject cover on doors, the user can use the Z-bracket alone or with spacers. The spacers with the Z-bracket have particular applications when the cover is being mounted on a door that includes a window grill or molding, in order to increase the mounting depth.

Figure 34A:
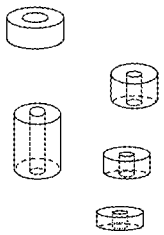
FIG. 34*a* shows a view of spacers of the subject invention.
Figure 34B:
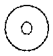
FIG. 34*b* shows a top view of a spacer of FIG. 34*a;*

FIG. 34*a* shows a view of spacers of the subject invention. FIG. 34*b* shows a top view of a spacer of FIG. 34*a*.

Figure 35A:
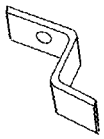
FIG. 35*a* shows a side view of a Z-bracket.
Figure 35B:
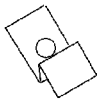
FIG. 35*b* shows a top view of the Z-bracket of FIG. 35*a;*

FIG. 35*a* shows a side view of a Z-bracket. FIG. 35*b* shows a top view of the Z-bracket of FIG. 35*a*.

Figure 36A:
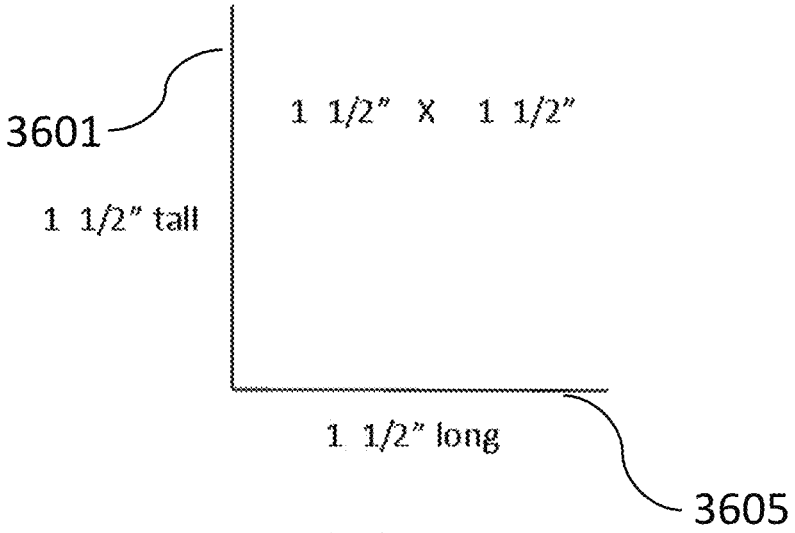
FIG. 36*a* illustrates a side view of an L-shaped bracket.
Figure 36B:
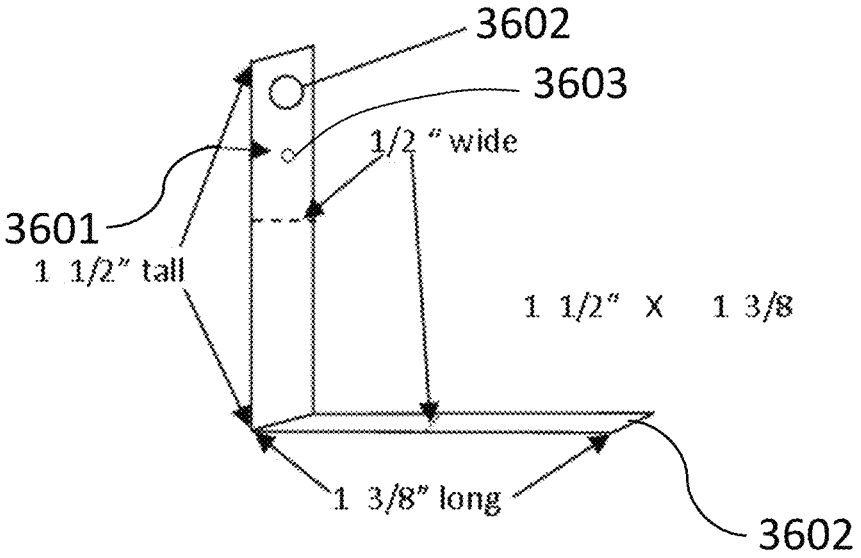
FIG. 36*b* illustrates a side top view of the L-shaped bracket.
Figure 36C:
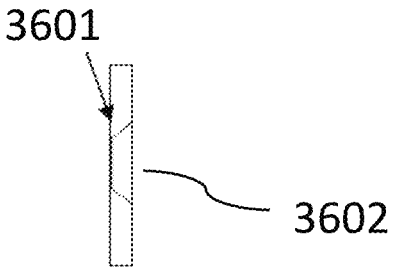
FIG. 36*c* illustrates an embodiment of a hole.
Figure 36D:
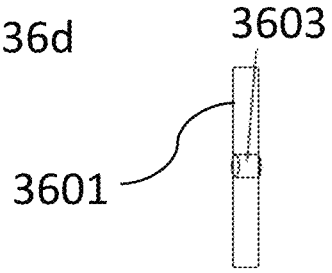
FIG. 36*d* illustrates another embodiment of a hole.

FIGS. 36*a*-36*d* illustrate an embodiment of an L-shaped bracket of the subject invention. FIG. 36*a* illustrates a side view of an L-shaped bracket. FIG. 36*b* illustrates a side top view of the L-shaped bracket. FIG. 36*c* illustrates an embodiment of a hole. FIG. 36*d* illustrates another embodiment of a hole. The bracket includes a top portion 3601 and a bottom portion 3605. Top portion 3601 includes a drilled counter sunk hole 3602 shown in FIG. 36*c*. Top portion 3601 also includes a hole 3603 adapted to receive a finishing nail which is located about ¼ inch below hole's dead center.

Figure 37A:
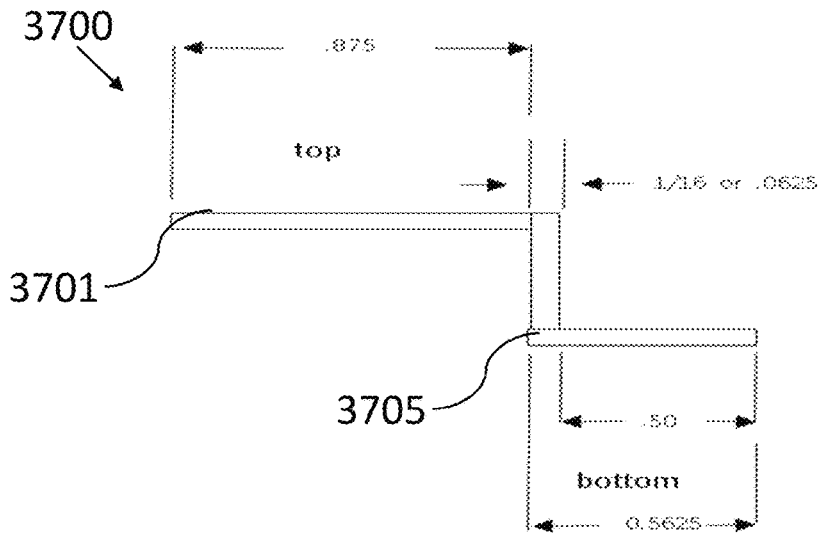
FIG. 37*a* illustrates a side view of a Z-shaped bracket.
Figure 37B:
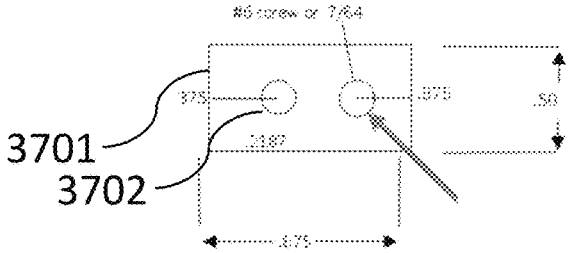
FIG. 37*b* illustrates a top view of the top of the Z-bracket.
Figure 37C:
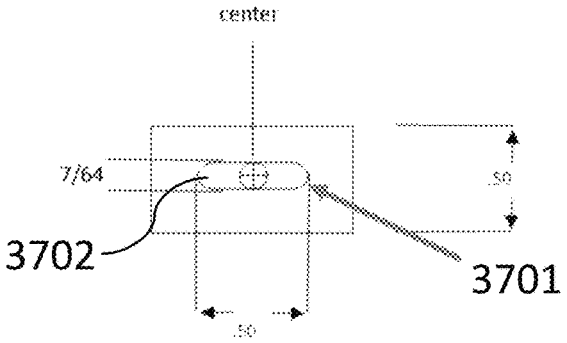
FIG. 37*c* illustrates the hole with capability to adjust the location of the screw.
Figure 37D:
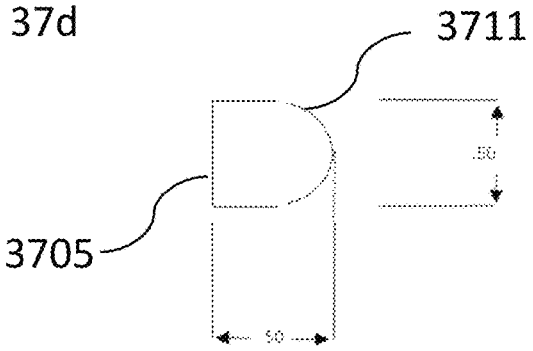
FIG. 37*d* illustrates a top view of the bottom of the Z-bracket.

FIGS. 37*a*-37*d* illustrate an embodiment of a Z-shaped bracket of the subject invention. FIG. 37*a* illustrates a side view of a Z-shaped bracket. FIG. 37*b* illustrates a top view of the top of the Z-bracket. FIG. 37*c* illustrates the hole with capability to adjust the location of the screw. FIG. 37*d* illustrates a top view of the bottom of the Z-bracket. The bracket includes a top portion 3701 and a bottom portion 3705. Top portion 3701 includes a drilled counter sunk hole 3702. Top portion. Bottom portion 3705 includes a hole 3710 for screw attachment to a spacer as needed and/or a magnet. Bottom portion 3705 preferably includes an arced or curved edge 3711 as shown in FIG. 37*d*.

Figure 38A:
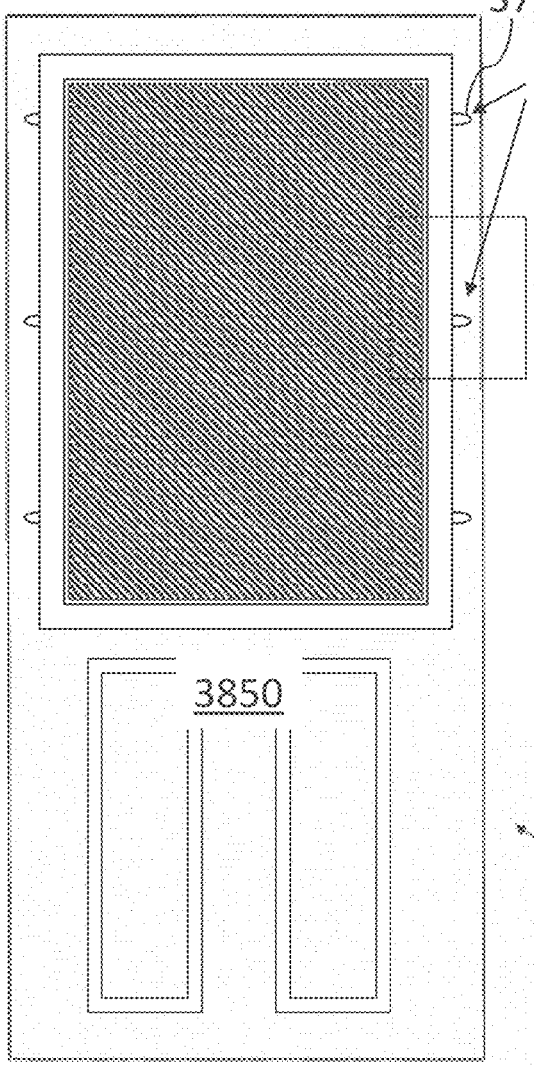
FIG. 38*a* illustrates a top plan view of a metal door with a glass window with the subject cover mounted thereon.
Figure 38B:
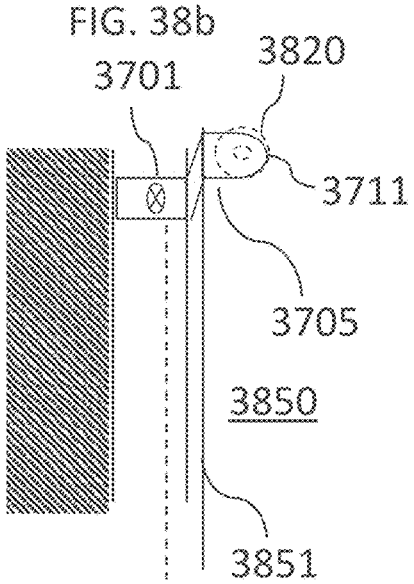
FIG. 38*b* shows a cross-section view of the attachment of the subject cover to the metal door of FIG. 38*a;*
Figure 38C:
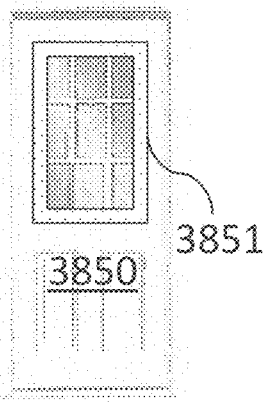
FIG. 38*c* shows the metal door of FIG. 38*a* without the subject cover.

FIG. 38*a* illustrates a top plan view of a metal door with a glass window with the subject cover mounted thereon. FIG. 38*b* shows a cross-sectional view of the attachment of the subject cover to the metal door of FIG. 38*a*. FIG. 38*c* shows the metal door of FIG. 38*a* without the subject cover. As shown in FIGS. 38*a*-*c*, the Z-bracket 3700 top portion 3701 is screwed or attached to a frame of a mounting cover. Bottom portion 3705 includes a magnet 3820 screwed, glued or otherwise attached thereto which aligns with edge 3711. Magnet 3820 attracts to and mounts on metal door 3850. Z-bracket 3700 allows clearance for the frame 3851 of the door. Door 3850 may be a full glass door. The Z-bracket 3700 allows the user to place the mountable cover over the glass. The Z-bracket 3700 allows the user to fasten less than a full length of the cover. Size, length, and shape of the cover can vary for several reasons, like to accommodate the height of molding or size of magnet 3820 needed. The Z-bracket is capable of sliding out or in to allow the user to adjust the bracket which had the magnet attached so that the magnet can touch the metal area to hold the mountable cover. Height can be obtained several ways, by changing the height of the bracket or the height of the magnet or adding a spacer. It is noted that a magnet can be attached on top of the cover's frame. In cases where the door is metal, no plate is needed. However, a spacer may be used if needed to adjust for depth. Magnets preferably have a thickness of about ¼", such as a ½" circle at ¼" thick. Two magnets can result in too much pull. The overall height of the bracket: top of bracket to bottom of bracket is preferably ⅜" to match other spacers including metal thickness. Preferably, the bracket has a thickness of 0.046875" like the metal plates. Different overall heights of brackets, magnets and spacers can be used to accommodate the array of molding heights. The spacer is preferably composed of a polymeric material, and the height of the spacer selected corresponds to the height of the Z-bracket—or the distance between the top portion and bottom portion on the Z-bracket. The spacer height is substantially the same as the height of the Z-bracket. It will be understood by those skilled in the art that the Z-bracket, when reversed, could also be attached to the glass frame, door or window so that the mountable cover sits on the bottom part of the Z-bracket, allowing the installer to place the mountable cover on the glass.

The plate can vary in size by shape or thickness, can be rounded, square, rectangular and polygonal. The thickness can vary. The plates may have a slight rise on the bottom and/or one side of the plate without the adhesive, so that as the user attaches the plate, the rise is on the non-tape side and gives resistance to the magnet allowing the use of smaller pull magnets. The rise can be formed as the raised portions (dots/bumps/or an elongated bar).

Figure 39A:
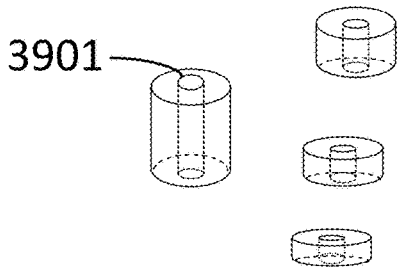
FIG. 39*a* shows a top plan view of a variety of spacers.
Figure 39B:
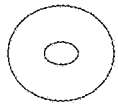
FIG. 39*b* shows a top aerial view of a spacer.
Figure 39C:
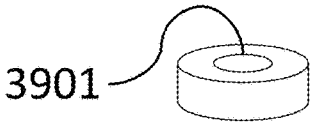
FIG. 39*c* shows a side view of a spacer.

FIG. 39*a* shows a top plan view of a variety of spacers. FIG. 39*b* shows a top aerial view of a spacer. FIG. 39*c* shows a side view of a spacer. The spacers are preferably composed of a plastic material. Alternatively, the spacers may be composed of a flexible material such as rubber, felt, silicone, or the like. The spacer includes an aperture shown at 3901 adapted to receive a screw for mounting the spacer onto a bracket, such as the previously discussed Z-bracket.

Figure 40A:
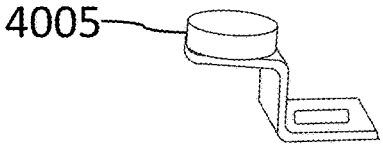
FIG. 40*a* shows a side view of a Z-bracket with a magnet thereon.
Figure 40B:
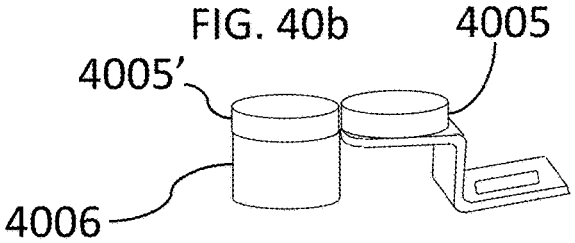
FIG. 40*b* shows a side view of a Z-bracket with a magnet and a spacer.
Figure 40C:
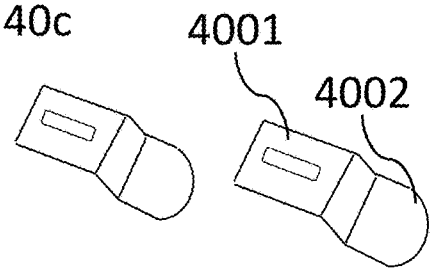
FIG. 40*c* shows a top view of a Z-bracket.
Figure 40D:
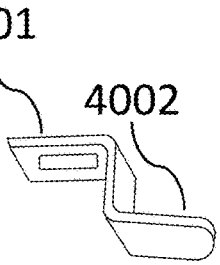
FIG. 40*d* shows a side view of a Z-bracket.
Figure 40E:
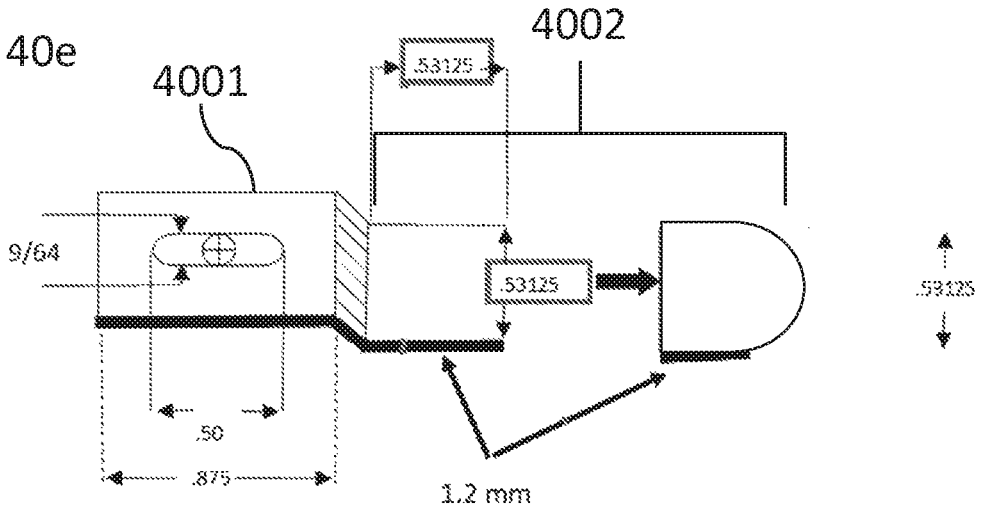
FIG. 40*e* shows a top plan view of the Z-bracket.

FIG. 40*a* shows a side view of a Z-bracket with a magnet 4005 thereon. FIG. 40*b* shows a side view of a Z-bracket with a magnet 4005 and a spacer 4006 with a magnet 4005'. FIG. 40*c* shows a top view of a Z-bracket. FIG. 40*d* shows a side view of a Z-bracket. FIG. 40*e* shows a top plan view of the Z-bracket with a top portion 4001 and bottom portion 4002, constructed as discussed herein. Preferably the Z-bracket is composed of steel so that the magnet can directly attach to the bracket. Alternatively, the Z-bracket may be composed of a polymeric material and the magnet fixed by way of glue, screw, nail or the like.

Figure 41A:
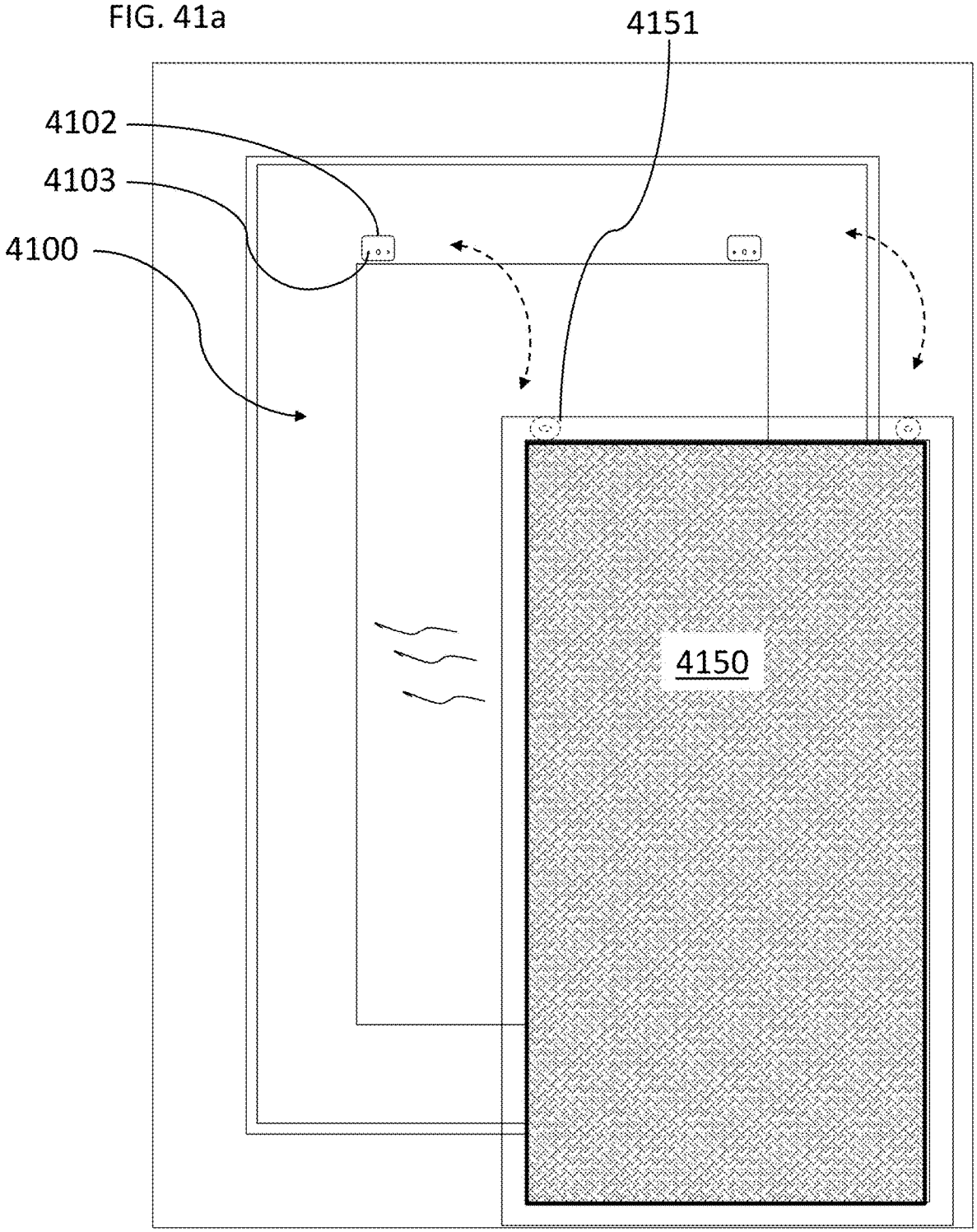
FIG. 41*a* shows a top view of a window having a mountable cover placed thereon.
Figure 41B:
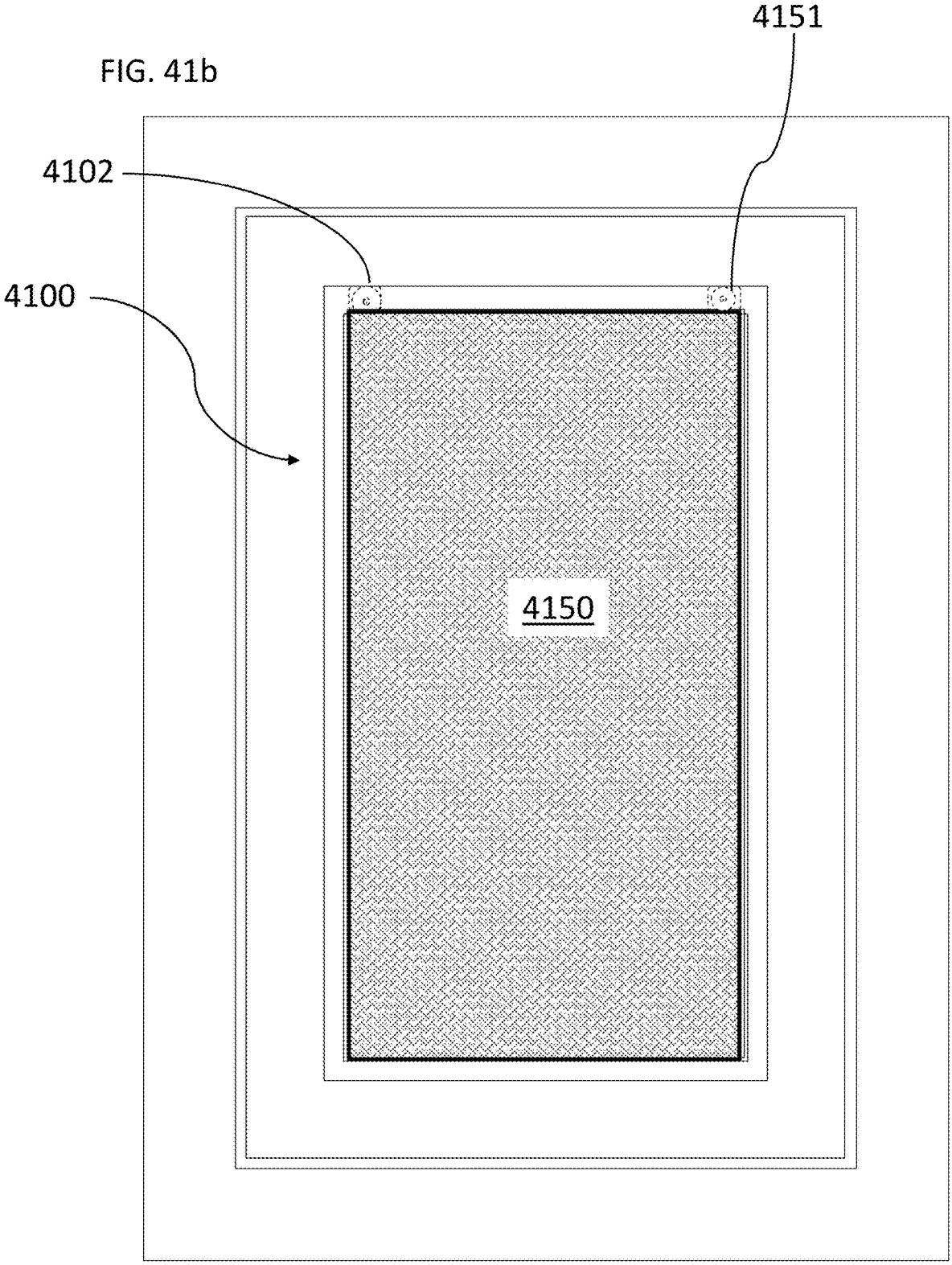
FIG. 41*b* shows a top view of the mountable cover mounted on the window of FIG. 41*a;*
Figure 41C:
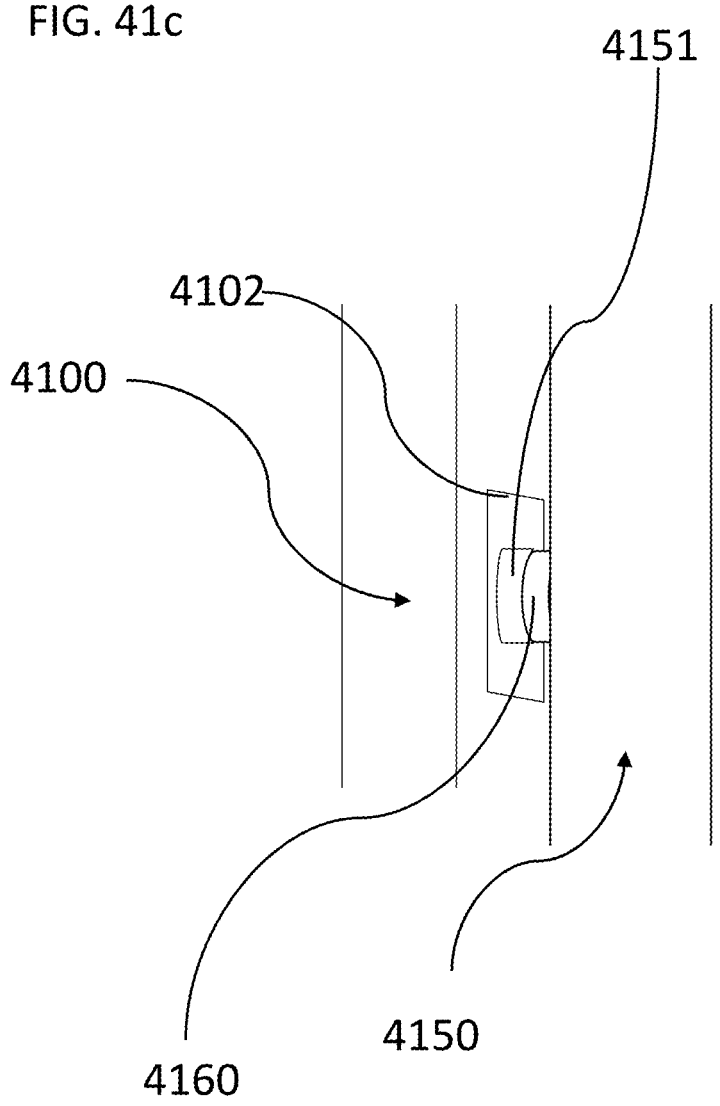
FIG. 41*c* shows a cross-sectional view of the mountable cover with a spacer and magnet mounted on a plate on the frame of a window.

FIG. 41*a* shows a top view of a window 4100 having a mountable cover 4150 placed thereon. Steel plates 4102 are placed fixed via screws or pins to the window frame. Steel plates 4102 include raised portions 4103 for providing support to the magnetic mount. Mountable cover 4150 includes magnets 4151 that magnetically anchor on plates 4102. FIG. 41*b* shows a top view of the mountable cover mounted on the window of FIG. 41*a*. FIG. 41*c* shows a cross-sectional view of the mountable cover 4150 with a spacer 4160 and magnet 4151 mounted on plate 4102 of the frame of a window 4100. In cases where the door is aluminum, for example an aluminum storm door, the plate is appointed to be screwed into the aluminum. Plates can be squares, rectangular, oblong, circular, or the like. Preferably the magnet is always placed on the cover and the plate placed on the window, window frame or door. Screws, if used, countersink into the magnet, plates and/spacers so that the screws sit under the magnet and do not interfere with the surfaces that are magnetically mated.

Figure 42A:
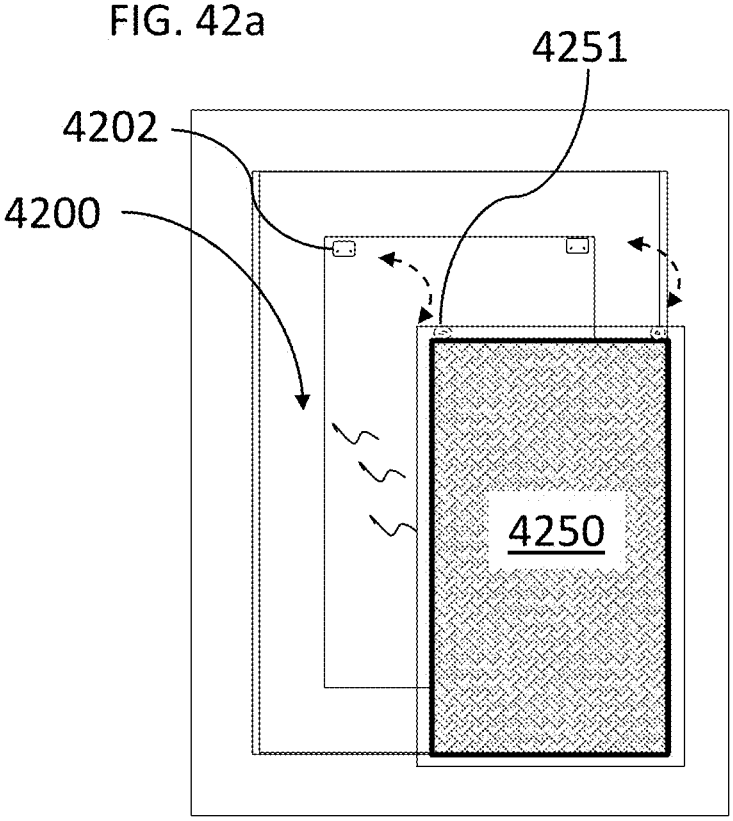
FIG. 42*a* shows a top view of a window having a mountable cover placed thereon.
Figure 42B:
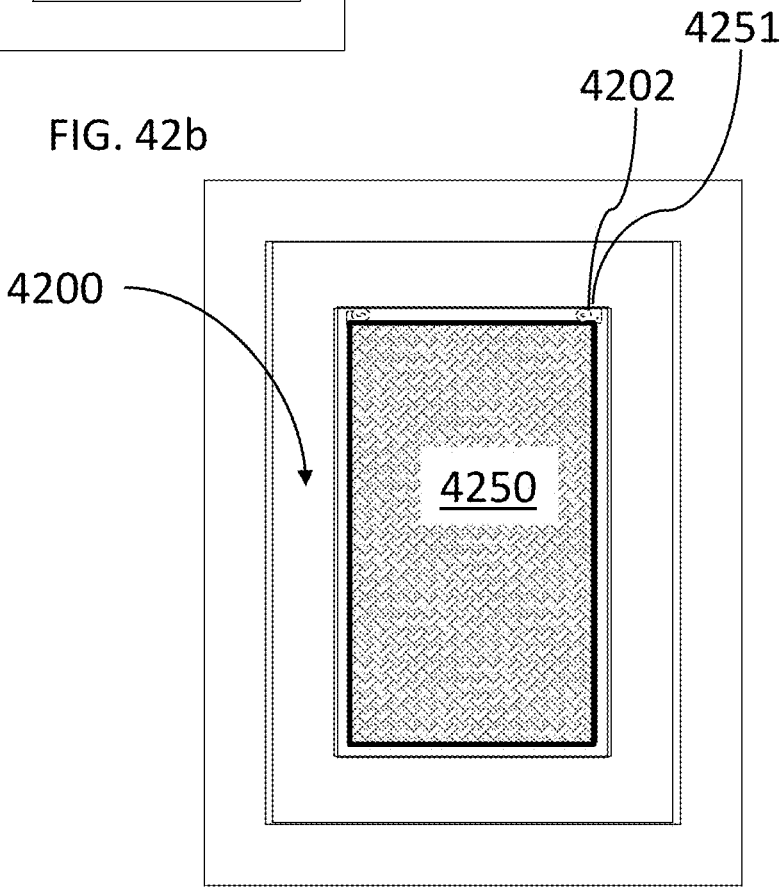
FIG. 42*b* shows a top view of the mountable cover mounted on the window of FIG. 42*a;*

FIG. 42*a* shows a top view of a window 4200 having a mountable cover 4250 placed thereon. Steel plates 4202 are placed fixed via adhesive to the window glass. Steel plates 4202 may include raised portions as discussed herein. Mountable cover 4250 includes magnets 4251 that magnetically anchor on plates 4202. FIG. 42*b* shows a top view of the mountable cover mounted on the window of FIG. 42*a*.

Figure 43A:
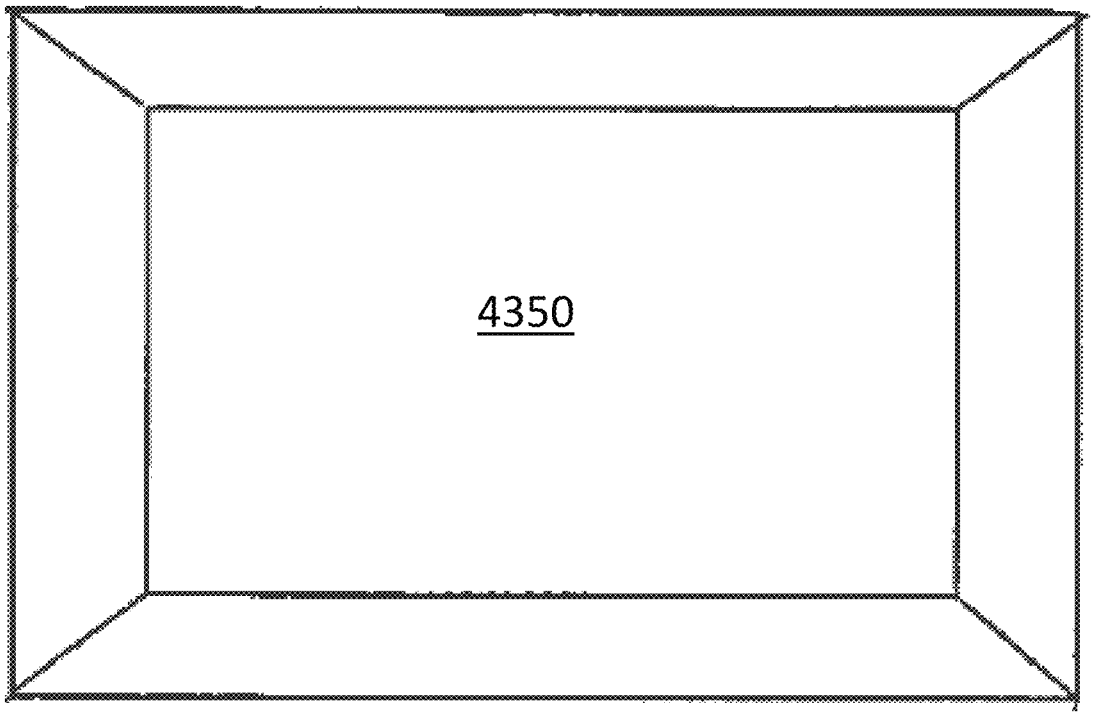
FIG. 43*a* shows a top view of a mountable cover.
Figure 43B:
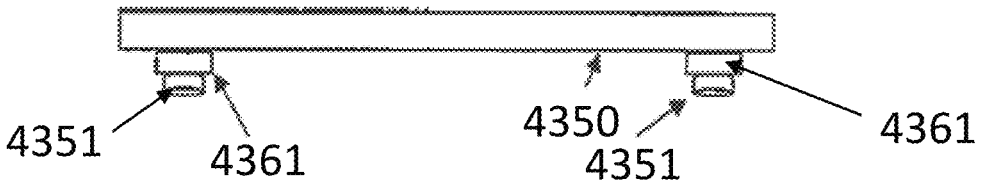
FIG. 43*b* shows a side view of the cover with a spacer and magnets thereon.
Figure 43C:
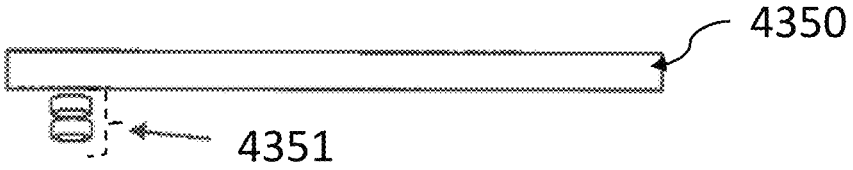
FIG. 43*c* shows one set of spacers and magnets.
Figure 43D:
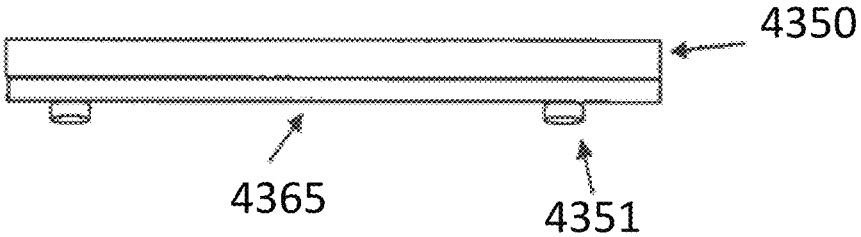
FIG. 43*d* shows an elongated spacer and magnet.

FIG. 43*a* shows a top view of a mountable cover 4350. FIG. 43*b* shows a side view of the cover with a spacer 4361 and magnets 4351 thereon. FIG. 43*c* shows a set of spacers 4361 and magnets 4351. FIG. 43*d* shows an elongated spacer 4365 and magnets 4351 (secured with either a counter-sunk screw or via adhesive backing on the magnet 4351 and/or spacer 4361) thereon. FIG. 43*c* shows a set of two magnets 4351 stacked on top of one another and placed together, instead of using the spacer 4361 to magnet configuration as in FIG. 34*b*. FIG. 43*d* shows an elongated spacer 4365 and magnets 4351. Elongated spacer 4365 may be formed as wood, etc., and is contemplated for use as a spacer. Spacers provide rise to the mounting magnets or brackets and can be made from wood, plastic (plastic washer), fiber, felt, rubber, silicone and/or even metal capable of magnetically bonding to the magnet. The spacer may include a sunk screw hole or may be secured by way of adhesive backing. Magnets correspond to the spacer and plate shapes, which can come in a plethora of different shapes, sizes and colors.

Figure 44A:
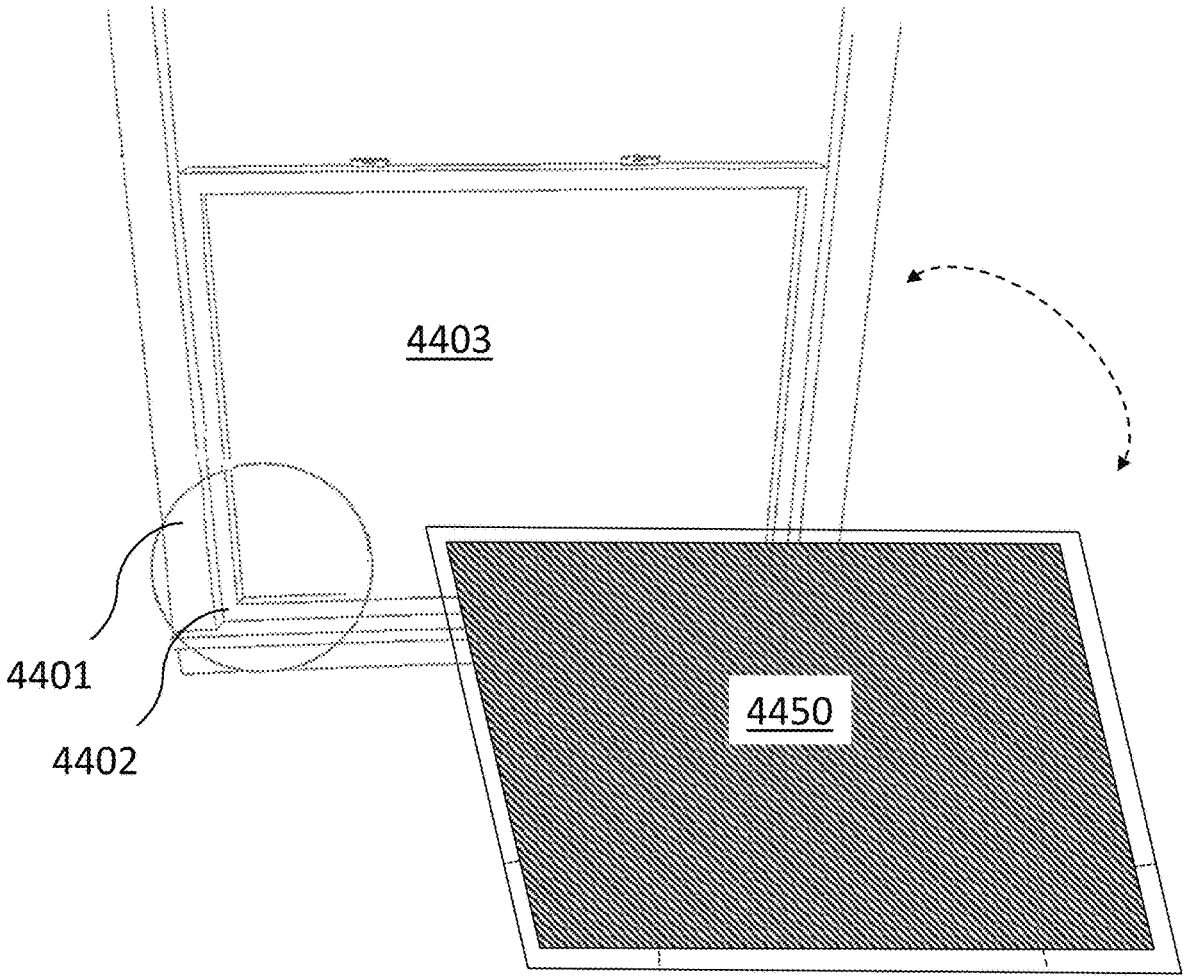
FIG. 44*a* shows a front interior view of a window being adapted to receive a mountable cover.
Figure 44B:
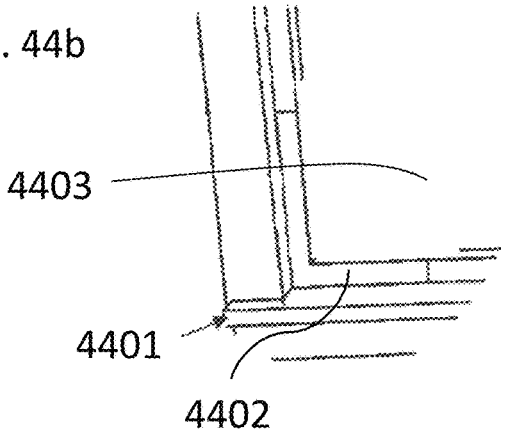
FIG. 44*b* shows a cross-sectional view of a basic window construct showing a window sash within a window frame.

FIG. 44*a* shows a front interior view of a window 4401 being adapted to receive a mountable cover 4450. FIG. 44*b* shows a cross-sectional view of the window to show the basic window construct via window frame 4401 holds a window sash frame 4402 that holds a window glass 4403.

Figure 45A:
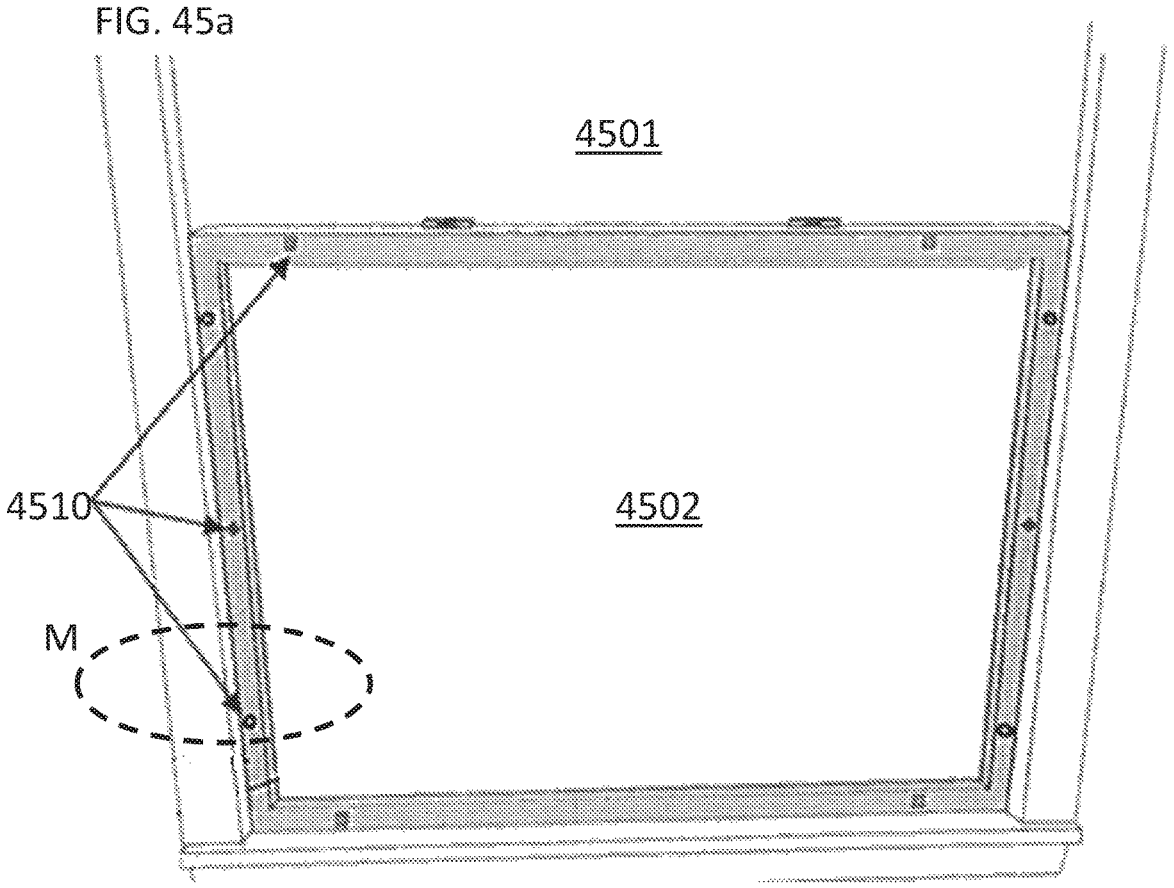
FIG. 45*a* shows a front interior view of a window appointed to receive a mountable cover.
Figure 45B:
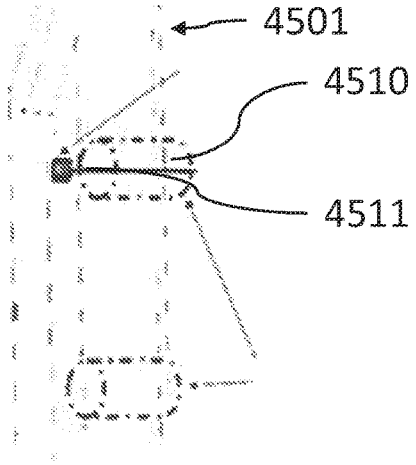
FIG. 45*b* shows a cross-sectional view taken at M.
Figure 45C:
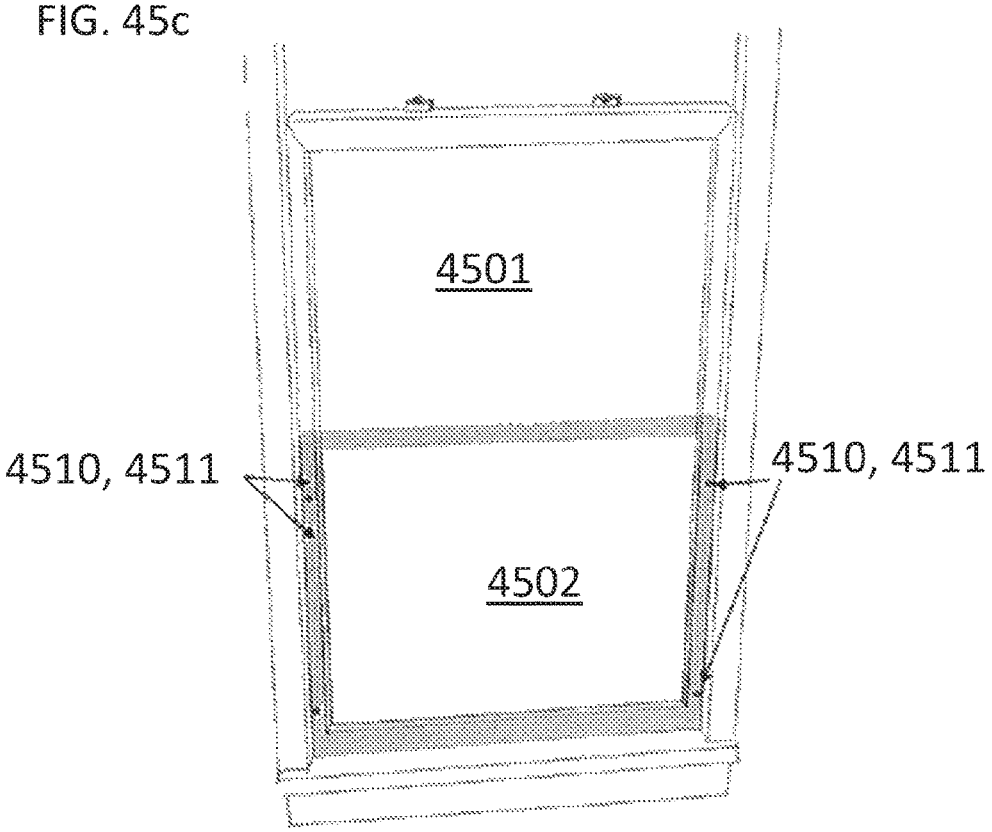
FIG. 45*c* shows another front view of the window with a different aperture arrangement.
Figure 45D:
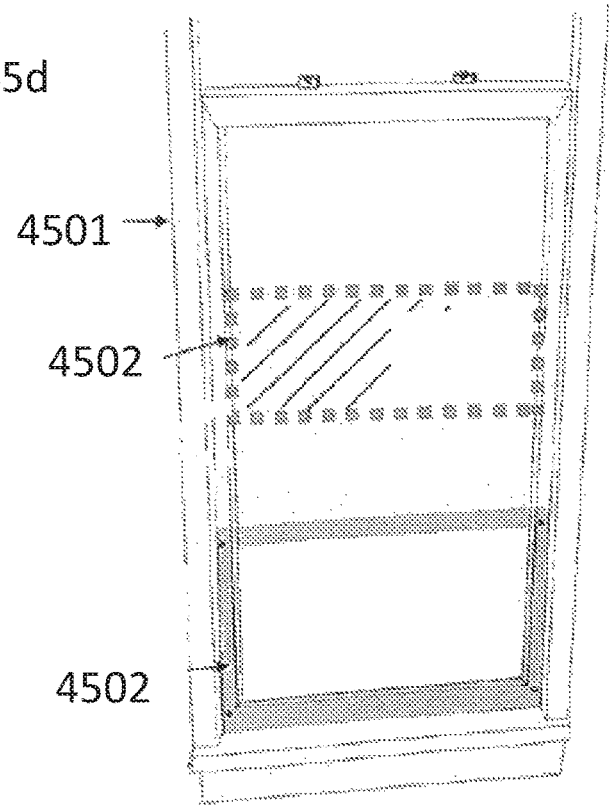
FIG. 45*d* shows a phantom view of the window with a mountable cover capable of moving within a window sash.
Figure 45E:
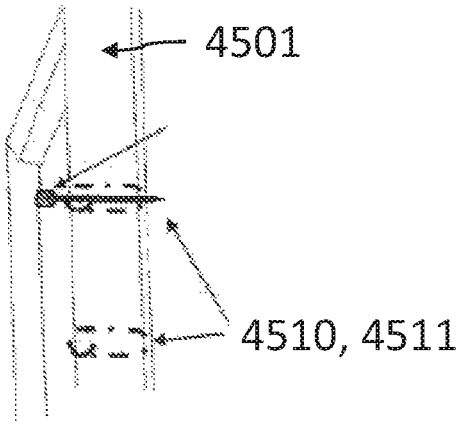
FIG. 45*e* shows another cross-sectional view of the window frame, apertures and pin arrangement.
Figure 45F:
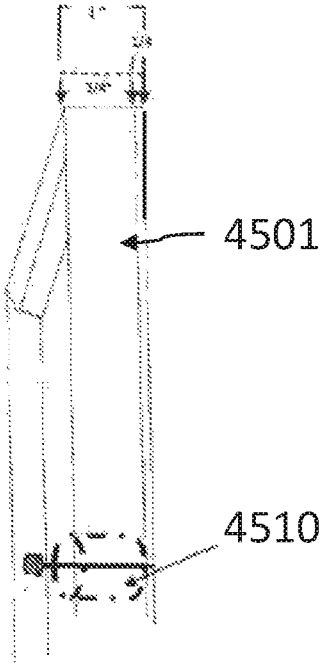
FIG. 45*f* shows another cross-sectional view of the window frame, apertures and pin arrangement.
Figure 45G:
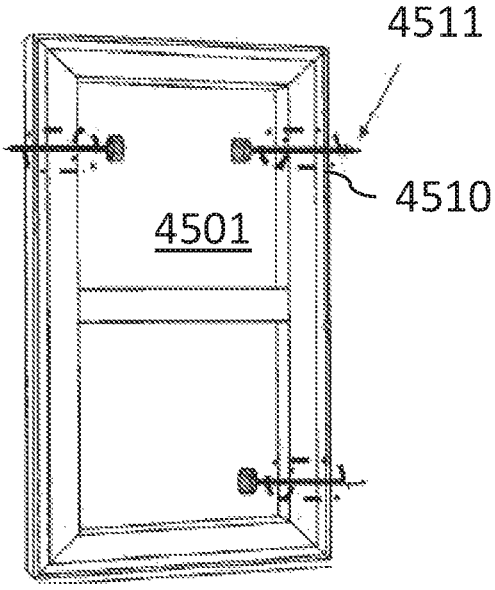
FIG. 45*g* shows a front view of the window frame, apertures and pin arrangement.

FIGS. 45*a*-45*g* show views of a window and mountable cover configuration wherein the fastening mechanism is an aperture that receives a pin or nail or screw, etc. FIG. 45*a* shows a front interior view of a window 4501 appointed to receive a mountable cover 4502 on at least a portion of the window 4501. FIG. 45*b* shows a cross-sectional view taken at M. FIG. 45*c* shows another front view of the window 4501 with a different aperture 4510 arrangement. FIG. 45*d* shows a phantom view of the window 4501 with a mountable cover capable of moving within a window sash 4502 first at 4501*a* then moved to 4501*b*. FIG. 45*e* shows another cross-sectional view of the window 4501 frame, apertures 4510 and pin 4511 arrangement. FIG. 45*f* shows another cross-sectional view of the window 4501 frame, apertures 4510 and pin 4511 arrangement. FIG. 45*g* shows a front view of the window 4501 frame, apertures 4510 and pin 4511 arrangement.

Figure 46A:
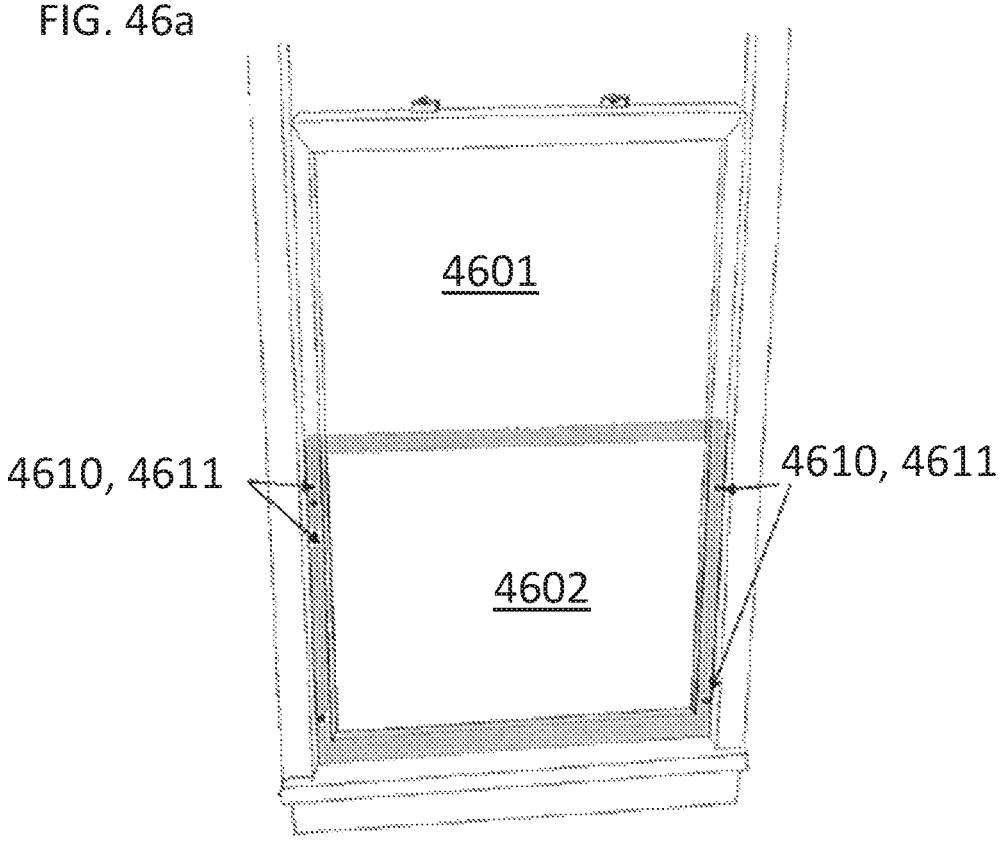
FIG. 46*a* shows a front interior view of a window appointed to receive a mountable cover.
Figure 46B:
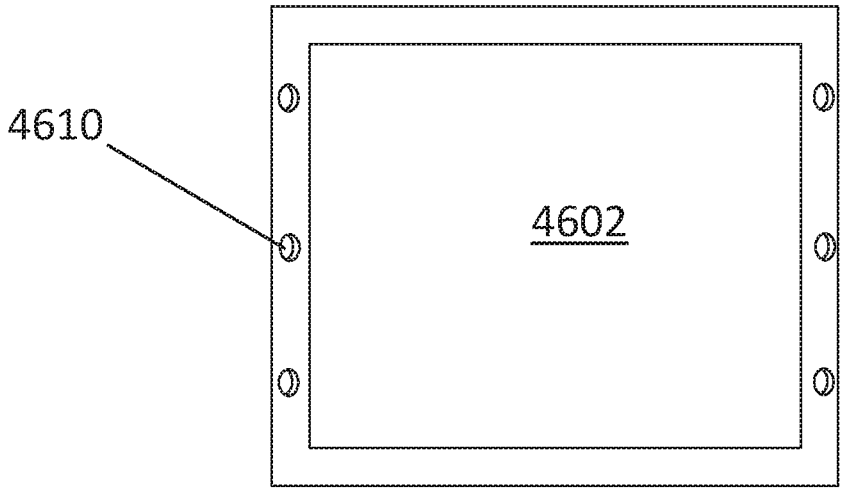
FIG. 46*b* shows a view of the mountable cover.

FIGS. 46*a*-46*b* show views of a window and mountable cover configuration wherein the fastening mechanism is an aperture 4610 located on a front wall of the mountable cover facing the interior of the house/building adapted to receive a pin or nail or screw, etc., to penetrate either a corresponding aperture drilled into the window or to poke into the window wood at 4611. FIG. 46*a* shows a front interior view of a window 4601 appointed to receive a mountable cover 4602 on an interior front wall of a window sash for at least a portion of the window 4601. FIG. 46*b* shows a view of the mountable cover 4602.

Figure 47:
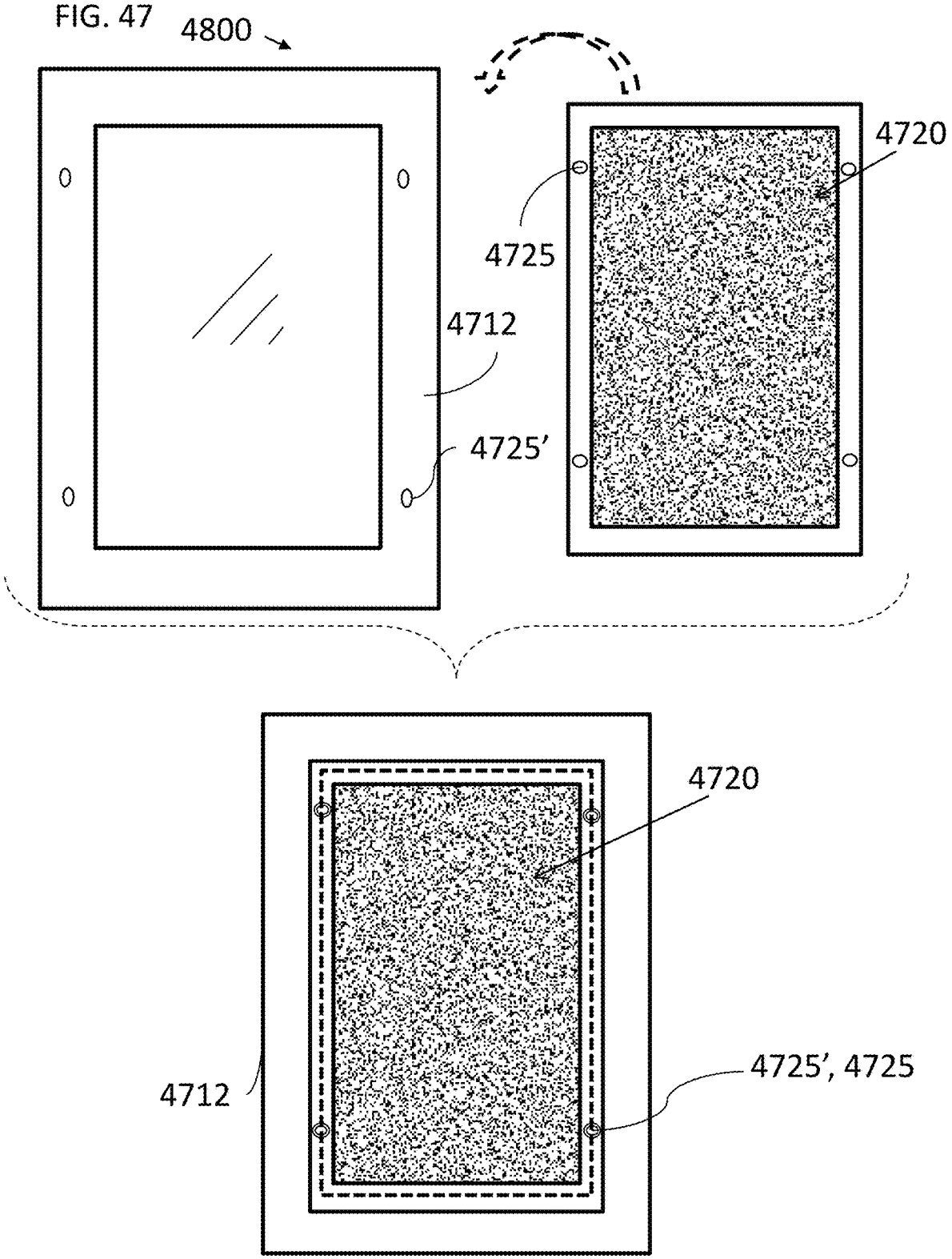
FIG. 47 illustrates a top plan view of an alternate embodiment of the mountable cover, showing an option for the fastening mechanism to mount the cover on the stationary glass/glazing panels of the window.

FIG. 47 illustrates a top plan view of an alternate embodiment of the mountable cover, showing an option for the fastening mechanism to mount the cover on the stationary glass/glazing panels of the window, shown generally at 4700. In the embodiment shown at 4700 a magnetic fastener 4725 located on the frame of a mountable cover 4720. Mating metal, non-magnetic, plates 4725' are mounted on a window sash frame 4712 via adhesive or view counter-sunk screw as discussed herein.

The frames are made of a variety of substances such as all types of wood species including but not limited to oak, poplar, birch, maple, pine, cherry, mahogany, and pressed wood such as bison, chipboard, fiberboard, and hardboard. Other materials that can be utilized include plastics such as polystyrene, polypore, metals such as silver and bronze, aluminum, plaster with gilding. The frame can come in many colors of, stains, paints, dyes, etc. colors can vary from staining, cloth materials, paint materials, colored plastic materials the thickness of a mounting cover from front to back can range from ⅜ to 2" thick. The width of the mounting cover can range from ½ to 5.5" wide. The frame can be joined at corners with a 45-degree miter angle corner cut; it can also butte/join with the corners flat as shown in FIGS. 21 and 22, respectively. Attaching of corners can be done by gluing, nailing, v-nailing, dovetail, screwing, bridle joining, dowel joining, pocket hole joining, etc. even a combination like glue & nails. Ways of joining the bar or bar which go across the frame in an array of locations for dress and support.

The fabrics used can be translucent [diffused view], transparent [clear view] or blackout [complete UV blockage]. The actual composition of the fabrics used can be made of the following but not limited to: cotton, AIDA, bamboo, silk, wool, vinyl, fiberglass, and synthetics such as polyester, nylon, acrylic. Shading material comes in a large array of textures, patterns, designs, colors and degrees of light filtering percentages.

The embodiment concerning a plurality of mountable frames, such as that shown in the Figures generally, have particular applications for large glass exposure doors or windows. Many different adjoining members can be utilized to bold or attach multiple mountable frames together for large glass coverage or to provide the ability to fold down a mountable frame as in FIG. 19. Folding, or adjoining members can also be located on side walls to form larger horizontal mountable frame constructs as shown in FIG. 13 for example. If the door or window frame is metal—front, side, back, garage, storm, patio, sliding, etc.—multiple magnets can be used as the fastening mechanism. Moreover, for these metal doors/windows, adjoining members may be/or include magnetic fasteners. The fastening mechanism utilized shall depend on the glass framing material, i.e. pin, screw, nail, tack, magnet, hook and loop fasteners (Velcro), even spacers with pin/push nails.

Alternative features of the subject invention are contemplated and non-limiting including, for example: the mountable cover may be constructed in a plethora of shapes and sizes, and from a plethora of materials and colors; etc. These features are contemplated in combination with the main embodiments shown in the Figures. The shape of the mounting cover can be round, polygonal, rectangular, etc. In addition the mounting cover is suited for windows as well as skylights.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A mountable cover for a window in a building that includes a window frame that holds a window sash housing a window glass and having a first side facing an interior portion of the building and a second side facing an exterior portion of the building, the mountable cover consisting of:

a. a mounting frame having a back side, front side, top wall, side walls and a bottom wall, said front side of said mounting frame facing an interior portion of said building and said each of said top wall, side walls and bottom wall of said mounting frame being removably mounted against said window;

b. at least one panel located within said mounting frame, said panel comprising a material configured to block at least a portion of light external to and traversing said window glass, said panel sitting parallel to and covering a portion of said window glass to block said light that has traversed said window glass;

c. at least one fastening mechanism comprising a plurality of magnets and a plurality of corresponding metal plates having a top wall, bottom wall and side walls, each of said magnets being fixed on said mounting frame and being configured to engage with one of said metal plates, each of said metal plates being configured to be mounted on said window, said magnets being configured to engage with said metal plates on said window to mount said mountable cover over said window, said metal plates adhesively affixed to said window to abut and sit flush thereagainst; wherein said bottom wall of each of said metal plates comprises an adhesive surface configured to be affixed to said window sash to abut and sit flush thereagainst, and said top wall of each of said metal plates includes at least one raised portion extending from said top wall; wherein when each of said magnets is engaged with said respective metal plate, said magnet is configured to be slidably movable relative to said metal plate, said raised portion being configured to block the sliding movement of said magnet in at least one direction.

2. The mountable cover for a window as recited in claim 1, wherein said raised portion comprises a rounded raised bump extending from said top wall of said metal plate.

3. The mountable cover for a window as recited in claim 1, wherein said raised portion comprises a rounded raised bar extending from said top wall of said metal plate.

4. The mountable cover for a window as recited in claim 1, wherein said metal plate includes an aperture adapted for receiving a screw or nail for affixing said metal plate to said window sash of said window.

5. The mountable cover for a window as recited in claim 1, wherein said fastening mechanism further comprises at least one spacer.

6. The mountable cover for a window as recited in claim 1, wherein said fastening mechanism further comprises a Z-bracket.

7. The mountable cover for a window as recited in claim 1, wherein said window is a skylight.

8. The mountable cover for a window as recited in claim 1, wherein said material of said panel is constructed of a light blocking material.

9. The mountable cover for a window as recited in claim 1, wherein said material is composed of a material selected from the group consisting of cellular, paper, cotton, linen, polyester, wool, viscose and silk.

10. The mountable cover for a window as recited in claim 1, wherein said material is composed of a material selected from the group consisting of vinyl, polyester, and polyvinyl chloride (PVC).

11. The mountable cover for a window as recited in claim 7, wherein said metal plates are configured as L-shaped brackets.

* * * * *